US005959410A

United States Patent [19]

Yamauchi et al.

[11] Patent Number: 5,959,410

[45] Date of Patent: Sep. 28, 1999

[54] CHARGE PUMP POWER FACTOR CORRECTION CIRCUIT FOR POWER SUPPLY FOR GAS DISCHARGE LAMP

[75] Inventors: Tokushi Yamauchi, Woburn, Mass.; Tsutomu Shiomi, Kitakatsuragi-gun, Japan

[73] Assignees: Matsushita Electric Works R&D Laboratory, Inc., Woburn, Mass.; Matsushita Electric Works Ltd., Osaka, Japan

[21] Appl. No.: 08/790,652

[22] Filed: Jan. 29, 1997

[51] Int. Cl.[6] ..... H05B 37/00

[52] U.S. Cl. ..... 315/209 R; 315/307; 315/DIG. 2; 363/132

[58] Field of Search ..... 315/209 R, 219, 315/224, 247, 291, 307, DIG. 5, DIG. 7, DIG. 2; 363/34, 37, 132, 98

[56] References Cited

U.S. PATENT DOCUMENTS 4,564,897 1/1986 Okamoto .
5,001,400 3/1991 Nilssen .
5,410,221 4/1995 Mattas et al. .
5,434,477 7/1995 Crouse et al. .
5,459,651 10/1995 Maehara .
5,488,269 1/1996 El-Hamamsy .

*Primary Examiner*—Don Wong
*Assistant Examiner*—David H. Vu

[57] ABSTRACT

An electric power source device includes a power converting circuit and a load circuit (LD) for receiving an output from the power converting circuit. The power converting circuit includes a rectifier element (DB) for rectifying an input from an alternating current source (AC), a smoothing capacitor (Ce) for smoothing an output from the rectifier element (DB) with a direct current, and switching elements (Q1, Q2) for generating high frequency voltage and current in response to receipt of a voltage of the smoothing capacitor (Ce). The power converting circuit makes use of a current source type charge pump (CSCP) for capturing an input current from the alternating current source (AC) by the use of one of high frequency current loops generated in the circuit as a result of switching on and off of the switching elements (Q1, Q2), and a voltage source type charge pump (VSCP) for capturing the input current from the alternating current source (AC) by the use of one of high frequency voltage nodes generated in the circuit as a result of the switching on and off of the switching elements (Q1, Q2).

46 Claims, 56 Drawing Sheets

---→ Current pumping from AC by VS
---→ Current pumping from AC by CS
←— Current dischange to Ce by VS
←— Current dischange to Ce by CS Mode 5

Mode 6

Mode 7

Mode 8

Q1
on
off

Q2
off
on

Iq1

Iq2
Vdc

Vci2
Vin

Vcp

Vci1

Vcr2

I load

Iin
mode #1
#2
#3
#4
#5
#6
#7
#8

Mode 1

Mode 2

Mode 3

Mode 4

Mode 5

Mode 6

CHARGE PUMP POWER FACTOR CORRECTION CIRCUIT FOR POWER SUPPLY FOR GAS DISCHARGE LAMP

BACKGROUND OF THE INVENTION

1. Field of the Invention

The present invention relates to an electric power converting device for supplying electric power from a commercial power source to a load and, in particular, to an electric power source device for supplying electric power to a lamp such as a discharge lamp, including a fluorescent lamp, or a high intensity discharge lamp including a metal halide lamp and a high pressure sodium lamp.

2. Description of the Prior Art

In the prior art an electric power converting device utilizing switching elements, in order to reduce the harmonic distortion of the input current and also to increase the input power factor, it is known to use at the front stage of a main converting circuit a circuit (hereinafter referred to as a front converting circuit) that is designed to full-wave rectify the commercial alternating current (AC) source and then to shapeing the waveform of the input current into a waveform substantially proportional to the commercial AC power source as to generate a direct current voltage. In this type of the power converting device, using the direct current voltage from the front converting circuit, the main converting circuit provides the load with the desired electric power. By way of example, in a ballast for supplying a high frequency AC power to a fluorescent tube, the main converting circuit is comprised of a booster type chopper circuit and an inverter circuit.

However, with this type of electric power converting device, since the number of component parts added to the front converting circuit (the booster type chopper circuit) for reducing the input current harmonic is relatively large the device itself tends to be bulky in size and high in cost.

In view of the foregoing, various circuits have hitherto been suggested which employ a reduced number of component parts and are lower in cost as compared with those employed in the circuit utilizing a booster type chopper circuit and an inverter circuit, some of which will now be discussed.

Prior Art 1

The circuit according to the Prior Art 1 is disclosed in the Japanese Laid-open Patent Publication No. 4-193067 and is reproduced in FIG. 82. A power factor improving function employed in this circuit is shown in FIG. 83 in the form of an equivalent electric circuit. The equivalent electric circuit shown in FIG. 83 is constructed on the following conditions.

A commercial AC power source AC and full-wave rectifier DB are represented as a voltage source having an instantaneous value Vg.

ii) A smoothing capacitor Ce is represented as a stable direct current voltage source Vdc.

iii) A feedback voltage source (a voltage across the load LD in FIG. 82) for improving the input distortion is represented by a high frequency voltage source Va of a substantially constant amplitude Vp.

Hereinafter, the operation of the power converting circuit under four power states (modes) during one cycle of the high frequency amplitude of the high frequency voltage source Va will be described with reference to FIGS. 84A to 84E. It is to be noted that FIGS. 84A to 84D illustrate respective equivalent circuits of the power converting circuit during the power stages 1 to 4. FIG. 84 illustrates change in waveform of respective voltages of voltage sources Va and Vb, and a voltage Vc and a current Ic of a capacitor Cin. Regions (A) to (D) shown in FIG. 84E correspond respectively to FIGS. 84A to 84D. It is to be noted that for the purpose of description, voltages of the voltage sources are designated by the same reference characters as used for the respective voltage sources.

(a) Power Stage 1;

The equivalent circuit during this stage is shown in FIG. 84A. At the region (A) in FIG. 84E, the amplitude of the high frequency voltage source Va slowly decreases from the maximum value Vp. During this period, diodes D1 and D2 are held in a non-conducting state and a capacitor Cin is in a floating condition with the voltage Vc across the capacitor Cin being equal to the difference between the voltage Vdc and the voltage Vp. The voltage Vc across the capacitor Cin at this time represents a minimum value Vcmin during one cycle of the high frequency amplitude of the high frequency voltage source Va. This stage continues until the high frequency voltage source Va decreases and the potential at a junction between the capacitor Cin and the diodes D1 and D2 consequently attains a value equal to the input potential Vg, that is, Vg=Va+Vcmin.

(b) Power Stage 2;

The equivalent circuit during this stage is shown in FIG. 84B. At the region (B) in FIG. 84E, when the voltage Va of the high frequency voltage source Va decreases and the voltage Vb at the junction between the capacitor Cin and the diodes D1 and D2 consequently attains a value equal to the input voltage Vg (Va+Vcmin=Vg), the diode D1 conducts and a current necessary to charge the capacitor Cin through the diode D1 flows from the input power source voltage source Vg. Since the input power source voltage source has a sufficiently low impedance, the voltage Vb retains a value equal to the input voltage. As the amplitude of the high frequency voltage source Va decreases, the potential across the capacitor Cin increases. At the timing the amplitude of the high frequency voltage source Va attains a minimum value, the diode D1 is brought in a non-conducting state and the voltage across the capacitor Cin attains a maximum value Vcmax.

(c) Power Stage 3;

The equivalent circuit during this stage is shown in FIG. 84C. At the region (C) in FIG. 84E, the voltage Va of the high frequency voltage source Va once having attained the minimum value starts increasing. During this period, the diodes D1 and D2 are kept in the non-conducting state and the capacitor Cin is in the floating condition with the voltage thereacross being kept at the maximum value Vcmax. This stage continues until the voltage Va of the high frequency voltage source Va increases and the potential Vb at the junction between the capacitor Cin and the diodes D1 and D2 consequently attains a value equal to the voltage Vdc of the direct current voltage source Vdc, that is, Va+Vcmax=Vdc.

(d) Power Stage 4;

The equivalent circuit during this stage is shown in FIG. 84D. At the region (D) in FIG. 84E, the voltage Va of the high frequency voltage source Va increases and, when the voltage Vb at the junction between the capacitor Cin and the diodes D1 and D2 attains a value equal to the direct current voltage Vdc, the diode D2 conducts and a current necessary to cause the capacitor Cin to discharge through the diode D2 flows towards the direct current voltage source Vdc. Since the direct current voltage source Vdc has a sufficiently low impedance, the voltage Vb is kept at a value equal to the voltage Vdc. As the amplitude of the high frequency voltage source Va increases, the voltage across the capacitor Cin decreases. The diode D2 is brought into a non-conducting stage when the amplitude of the high frequency voltage source Va attains the maximum value, and the voltage across the capacitor Cin then attains the minimum value Vcmin.

The foregoing four stages are repeated for each cycle of the high frequency voltage source Va. Only during the power stage 2 does the input current flow. Although the duration of each of the four stages varies depending on the magnitude of the input voltage Vg, neither the power stage 1 nor the power stage 3 take place when the input voltage Vg attains a peak value and equal to the voltage Vdc, and each of the power stages 2 and 4 takes place during half the cycle of the high frequency of the high frequency voltage source Va. At this time, the duration of each of the power stages 2 and 4 is maximized.

FIG. 87 is a diagram explanatory of the period during which the input current is captured. In FIG. 87, a region X shown represents a region in which an inductor current becomes a charging current for the smoothing capacitor Ce, and a region Y represents a region in which the inductor current becomes an input current. The region Y will enlarge when the input voltage Vin attains a peak value and decreases as it becomes zero. In other words, the closer the input voltage Vin is to the peak value, the longer the period during which the input current is captured.

Since this prior art circuit may be considered a circuit in which the potential on the capacitor Cin is alternately charged and discharged depending on a displacement of the potential at a voltage node in a resonant circuit which oscillates at a high frequency, to thereby pump up the input current from the power source, it will be referred to as a voltage source type charge pump (VSCP) in the subsequent description. Also, it may be contemplated to use a transformer T at an output side of this circuit as shown in FIG. 88A.

Prior Art 2

The circuit according to the Prior Art 2 is disclosed in the Japanese Laid-open Patent Publication No. 5-38161 and is reproduced in FIG. 85. A power factor improving function employed in this circuit is shown in FIG. 86 in the form of an equivalent electric circuit. The equivalent electric circuit shown in FIG. 83 is constructed on the following conditions.

A commercial AC power source AC and a full-wave rectifer DB are represented as a voltage source having an instantaneous value Vg.

ii) A smoothing capacitor Ce is considered as a stable direct current voltage source Vdc.

iii) A feedback voltage source (a load circuit including a resonant inductor Lr, a resonant capacitor Cr and a load LD in FIG. 85) for improving the input distortion is represented by a high frequency current source Ia of a substantially constant amplitude.

In this prior art circuit of FIG. 85, with a circuit comprising diodes D1 and D2 connected in series with each other between the rectifier element DB and the smoothing capacitor Ce and a charge capacitor Cin connected parallel to the diode D2, the input current is captured from a power source Vg by the utilization of a resonant current generated in a resonant circuit comprised of a resonant capacitor Cr and a resonant inductor Lr.

Even the prior art circuit shown in FIG. 85 has four stages corresponding substantially to the four stages discussed in connection with the Prior Art 1 above. Accordingly, even in the circuit of FIG. 85, when the input power source Vg at a peak time is set to be equal to the voltage Vdc, the period of conduction of the input current is at maximum half the cycle of the high frequency current source Ia.

Since the circuit of FIG. 85 may be considered a circuit in which the potential on the capacitor Cin is alternately charged and discharged by a current loop or a load current in the resonator circuit which oscillates at a high frequency, to thereby pump up the input current from the power source, it will be referred to as a current source type charge pump (CSCP) in the subsequent description.

According to any one of the Prior Arts 1 and 2, the power converting circuit can be assembled with the use of a minimized number of component parts and is effective to draw the input current with high efficiency. Also, it may be contemplated to use a transformer T on an output side of the circuit as shown in FIG. 88B.

Prior Art 3

A further prior art circuit is shown in FIG. 89. The prior art circuit shown in FIG. 89 is substantially similar to that shown in FIG. 82, but differs therefrom in that the power factor improving function including a capacitor Cin' and diodes D1' and D2' is disposed on an low voltage (ground) output end of the rectifier element DB so that it can assume a symmetrical relation with the power factor improving function including the capacitor Cin and the diodes D1 and D2 and connected on a high voltage output end of the rectifier element DB. In this circuit structure, an equivalent circuit of the power factor improving function removed therefrom is shown in FIG. 90. In such case, a circuit portion including the diodes D1 and D2 and the capacitor Cin performs the four power stages during one cycle of the high frequency amplitude of the high frequency voltage Va as discussed in connection with the Prior Art 1, whereas a circuit portion including the diodes D1' and D2' and the capacitor Cin' performs equivalent four stages, but delayed half the cycle of the high frequency amplitude of the high frequency voltage source Va. In other words, it operates in the following manner.

| Diodes D1 & D2<br>Circuit including Cin | Diodes D1' & D2'<br>Circuit including Cin' |
|---|---|
| Power Stage 1 | Power Stage 3 |
| Power Stage 2 | Power Stage 4 |
| Power Stage 3 | Power Stage 1 |
| Power Stage 4 | Power Stage 2 |

Accordingly, the input current flows during half the cycle of the high frequency amplitude of the high frequency voltage source Va and flows at maximum during one cycle period. In this way, the period of conduction of the input current is enlarged and any possible increase of the volume of a high frequency filter circuit used in the input source can be suppressed.

Prior Art 4

A still further prior art circuit is shown in FIG. 91. The prior art circuit shown in FIG. 91 is substantially similar to that shown in FIG. 85, but differs therefrom in that the power factor improving function including a capacitor Cin' and diodes D1' and D2' is disposed on a ground end of the rectifier element DB so that it can assume a symmetrical relation with the power factor improving function including the capacitor Cin and the diodes D1 and D2 and connected on a high voltage output end of the rectifier element DB. In this circuit structure, a capacitor Cr is connected between a junction of the diodes D1 and D2 and the load circuit, and a capacitor C2' is connected between a junction of the diodes D1' and D2' and the load circuit to avoid any possible shortcircuitting of the power source. An equivalent circuit of the power factor improving function removed therefrom is shown in FIG. 92. Even the prior art circuit of FIG. 91 performs the operations alternately for half the cycle and, therefore, the period of conduction of the input current is enlarged and any possible increase of the volume of a high frequency filter circuit used in the input source can be suppressed.

Prior Art 5

An example of the Charge Pump Power Factor Correction (CPPFC) circuit of a symmetrical design described in connection with the Prior art 3 or 4 is disclosed in the U.S. Pat. No. 4,511,823, which is reproduced in FIG. 93. The circuit disclosed therein performs a power factor improving operation comparable to and similar to that accomplished by the circuit (FIGS. 89 and 90) in the Prior Art 3. Also, the circuit discussed in connection with the Prior Art 4 (FIG. 91 and 92) is disclosed in this patent. Accordingly, even in the circuit disclosed in this US patent, the period of conduction of the input current is enlarged and any possible increase of the volume of a high frequency filter circuit used in the input source can be suppressed.

Some examples of application to the high intensity discharge lamp (HID) lamp stabilizer (HID ballast) will now be described.

Prior Art 6

The circuit often used as a stabilizer for the high intensity discharge lamp is shown in FIG. 94. This circuit of FIG. 94 comprises a rectifier section for an input power source AC, a power factor improving function (PFC) section 11, an output control section 13, and a polarity inverting section (a low frequency inverter circuit) 15 and is so designed that a rectangular wave output appropriately controlled in dependence on change in impedance of the HID lamp can be supplied to the HID lamp. Since in this circuit the inductor, which is a relatively bulky component part, and expensive switching elements are employed, it is difficult to downscale the device, rendering the latter to be expensive.

Prior Art 7

A circuit shown in FIG. 95 is similar to the circuit disclosed in the Japanese Laid-open Patent Publication No. 4-193067, which corresponds to the circuit of FIG. 82 that is designed so as to convert a high frequency output to be applied to the load circuit LD into a direct current output through a rectifier bridge Do. Even this circuit functions in a manner similar to the circuit described in connection with the Prior Art 1 in that a node through which the capacitors Cr1 and Cc are connected with each other is utilized as a high frequency voltage source to effect alternate charge and discharge of the capacitor Ci1 to draw the input current at a high frequency.

A circuit shown in FIG. 96 is similar to the circuit disclosed in the Japanese Laid-open Patent Publication No. 5-38161, which corresponds to the circuit of FIG. 85 having an output section designed to convert the high frequency output to be applied to the load circuit LD into a direct current output through a rectifier bridge Do. Even this circuit functions in a manner similar to that accomplished by the circuit of FIG. 95. In other words, in those circuits, it is possible to supply an electric power to a waveform distortion of the input current and an output with a minimized number of inductors.

In the prior art circuits described above, during one high frequency cycle of a high frequency feedback (voltage or current) power source, that is, during one switching cycle of the switching elements Q1 and Q2 in the specific circuit shown in FIGS. 82, 85, 95 or 96, the input current can only be supplied only during a time equal to half cycle. (See FIG. 87). Accordingly, where the amount of an electric power Win substantially equal to the amount of an output power Wout is desired to be drawn from the input power source efficiently (that is, so that since the alternating current input voltage Vin is fixed and the input current $Iin=\eta \cdot Win/Vin$, the input power factor $\eta$ can be approximately equal to 1), the wave height value of the input current drawn during one high frequency cycle tends to be relatively high. In other words, as compared with the case in which it is operated under a zero-cross discontinuous current mode with the booster type chopper circuit (the wave height value of the high frequency input current being twice the input current waveform after a low frequency filter for input rectification), the period of conduction of the input current is reduced half or lower and, therefore, it will readily be seen that the wave height value tends to be doubled (the wave height value of the high frequency input current being four times the input current waveform after the low frequency filter for input rectification). Thus, because of the wave height value is high, component parts of the low frequency filter circuit for input rectification tend to become bulky in size and component parts (rectifier DB, diodes D1 and D2 and so on) through which the high frequency input current flow also tend to become bulky and, accordingly, even though the number of components may be reduced as a result of increase of part rating, the cost does not decrease so much.

The previously discussed prior art circuits have the following problems as well.

The capacitor Cin can be regarded as connected parallel to the capacitor Cr and the load LD when the diodes D1 and D2 conduct. The current flowing through the resonant inductor Lr and the switching elements Q1 and Q2 becomes a current flowing through the capacitor Cin in addition to the current flowing through the load LD and the capacitor Cr and, accordingly, as compared with the case in which no capacitor Cin is connected, a relatively high current flows through the inductor Lr and the switching elements Q1 and Q2.

In order to substantially eliminate such a problem that as a result of change of the angle of conduction of the capacitor Cin with the input voltage a relatively large low frequency ripple proportional to the input voltage tends to occur at an output to the load LD, the resonant capacitor Cr must have a sufficiently high capacitance so that the resonant circuit system will not be affected regardless of whether conduction or non-conduction of the capacitor Cin (regardless of whether or not the capacitor Cin is connected parallel to the resonant capacitor Cr and the load LD). In other words, assuming that the capacitors Cr and Cin have respective capacitances Cr and Cin, the capacitance Cr has to be of a value approximately equal to the sum of the capacitances Cin and Cr because the capacitance Cin is far lower than the capacitance Cr. However, increase of the capacitance Cr results in increase of an invalid current which does not participate in the output power and, therefore, further increase of the current flowing through the inductor Lr and the switching elements Q1 and Q2 would be required to reduce the low frequency ripple of the output.

This equally applies to the circuit shown in FIG. 96.

A similar problem occurs in the system wherein the PFC section shown in FIG. 82 is arranged symmetrically as shown in FIGS. 89 and 93. By way of example, the capacitor Cin shown in FIG. 82 is divided into the capacitors Cin and Cin' shown in FIGS. 89 and 93 and the capacitors Cin and Cin' has a capacitance divided half. For this reason, the amount of the current flowing into one of the capacitors Cin and Cin' is reduced half and the angle of conduction of the high frequency input current is increased, accompanied by reduction of the wave height value to a half value. However, since the capacitors Cin and Cin' conduct simultaneously and the composite capacitance thereof is connected parallel to the load (lamp), the currents flowing out of or into the capacitors Cin and Cin' are combined together and, thus, the circuit is the same as that shown in FIG. 82. Accordingly, in order to reduce the low frequency ripple of the current flowing through the load, the resonant capacitor Cr must have an increased capacitance and, hence, further increase for the current flowing through the resonant inductor Lr and the switching elements Q1 and Q2 is needed to reduce the low frequency ripple of the output.

Similarly, in the circuit of FIG. 85 according to the Prior Art 2, In the case of the circuit of FIG. 84 in which a circuit current in a resonant circuit including the resonant inductor Lr and the resonant Capacitor Cr (that is, the current flowing through the resonant inductor Lr) is used as a high frequency current source and the input current is drawn at a high power factor, the load current flowing through the load LD and the current flowing through the capacitor Cr during conduction of the diodes D1 and D2 participate in the input current. However, where because of the load current being of a relatively low value the input current cannot be sufficiently drawn, the resonant capacitor Cr must have an increased value and the circuit current in the resonant circuit must be increased. In this way, increase of the circuit current results in the necessity of the resonant inductor Lr and the switching elements Q1 and Q2 to have an increased size, resulting in increase of the cost.

The capacitor Cin conducts during conduction of the diodes D1 and D2 and is connected in series with a resonant circuit including the resonant inductor Lr, a resonant capacitor Cr and a load LD. The angle of conduction of the resonant capacitor Cin during one high frequency cycle changes with change in potential of the input voltage and due to this change a large low frequency ripple occurs in an output of the load LD. To reduce this low frequency ripple, the capacitor Cin must have an increased capacitance, the impedance of the capacitor Cin must be reduced and the resonant circuit must be designed to be less affected regardless of the presence or absence of connection of the capacitor Cin.However, if the capacitance of the capacitor Cin is increased, in order for a sufficient amount of the input current to be drawn by causing a positive polarity side potential of the diode D2 to be shifted to the voltage Vdc across the smoothing capacitor Ce and the input voltage Vg through alternate charge and discharge of the capacitor Cin, a high resonant current resulting from increase of the capacitance of the capacitor Cr is needed. This brings about a further increase of the conduction current of the resonant inductor Lr and the switching elements Q1 and Q2, resulting in increase of the size of each of the resonant inductor Lr and the switching elements Q1 and Q2.

This equally applied to the circuit of FIG. 96. Also, as is the case with the relationship between the circuit of FIGS. 89 and 93 and the circuit of FIG. 82, although even in the circuit system of FIG. 90 the angle of conduction of the high frequency input current is increased with the wave height value thereof consequently reduced to a half value, the current flowing through the resonant circuit will increase by the reason discussed above, accompanied by increase in conduction current of the resonant inductor Lr and the switching elements Q1 and Q2. This in turn brings about increase in size of the resonant inductor Lr and the switching elements Q1 and Q2.

As hereinabove discussed, in the prior art circuits in which the high frequency voltage (or current) oscillation in the load circuit is utilized to efficiently draw the input current at a high frequency, although the number of the necessary component parts can be reduced, reduction in cost is not effective because of increase in size of the component parts.

Also, where the output transformer T is used as shown in FIG. 88 with the primary side resonant current set appropriately, the use of the transformer T constitutes one of causes of increase in cost because the transformer is a bulky component part.

SUMMARY OF THE INVENTION

The present invention is intended to substantially resolve the problems associated with improvement in power factor and increase of the resonant circuit current for reduction of the output ripple and has for its object to provide an improved power source device employing a highly efficient, handy input power factor improving circuit wherein ratings of the component parts are reduced by enlarging the angle of conduction of the input current during one high frequency cycle, thereby making it possible to reduce the cost.

In one preferred embodiment of the present invention, a power source device comprises an electric power converting circuit including a rectifier element for rectifying an input from an alternating current source, a smoothing capacitor for smoothing an output of the rectifier element with a direct current, and switching elements for generating a high frequency voltage and a high frequency current in response to receipt of a voltage of the smoothing capacitor; and a load circuit for receiving an output from the power converting circuit. The power converting circuit comprises a current source type charge pump (CSCP) operable to capture the input current from the alternating current power source by the utilization of one of high frequency current loops generated in the circuit as a result of switching on and off of the switching elements, and a voltage source type charge pump (VSCP) for capturing the input current from the alternating current power source by the utilization of one of high frequency voltage nodes generated in the circuit as a result of switching on and off of the switching elements. When the input current is to be captured from the alternating current power source by the utilization of those charge pumps, the current input period can be enlarged by the utilization of the difference in phase between the current input periods of those charge pumps. For this reason, not only can the peak value of the current be suppressed, but the breakdown strength of the component parts can be reduced, and therefore, in the power source device having the power factor correcting function, reduction of the size and cost of the device can be accomplished.

In another preferred embodiment of the present invention, in place of the voltage source type charge pump, an additional current source type charge pump is employed so that the two current source type charge pumps are used to capture the current from the alternating current power source. Even this alternative device brings about effects similar to those brought about by the device using the voltage and current source type charge pumps.

BRIEF DESCRIPTION OF THE DRAWINGS

This and other objects and features of the present invention will become clear from the following description taken in conjunction with preferred embodiments thereof with reference to the accompanying drawings, in which like parts are designated like reference numerals and in which.

DETAILED DESCRIPTION OF THE EMBODIMENTS

Figure 1:
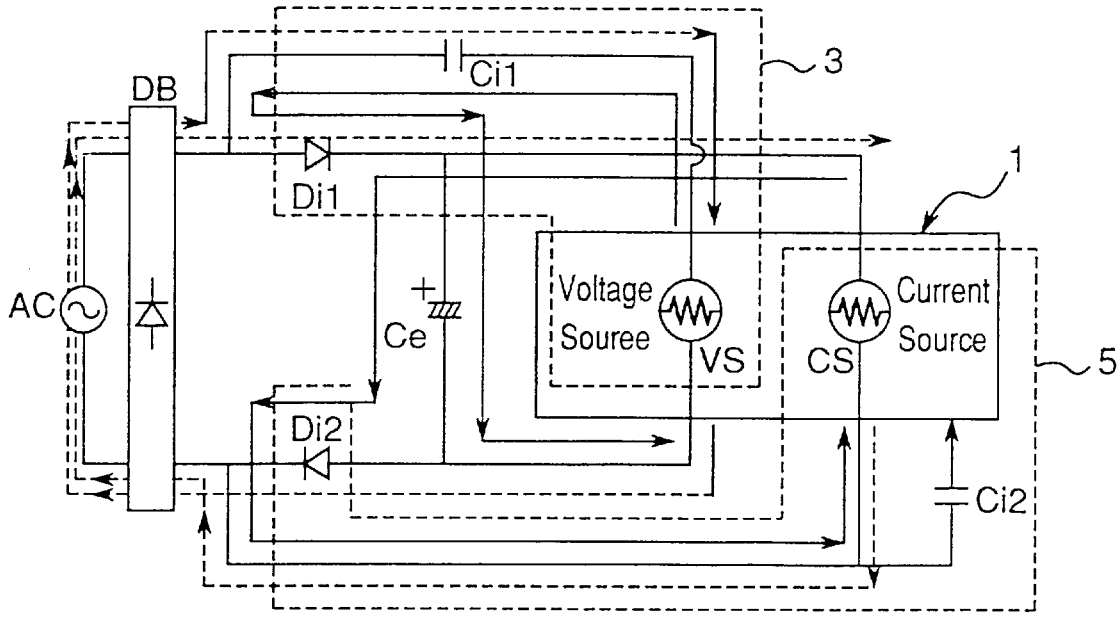
FIG. 1 is a circuit diagram showing a first basic circuit structure of a power source device according to the present invention.

1. First Embodiment 1-1. Basic Structure:

Referring to FIG. 1, there is shown a basic structure of a power source device according to a first preferred embodiment of the present invention. The power source device shown therein comprises a full wave rectifier element DB for rectifying an output from a commercial alternating current (AC) power source AC to provide a full wave rectified power, a smoothing capacitor Ce for smoothing an direct current output from the rectifier element DB, a diode Di1 and a charge capacitor Ci1 which define a circuit through which an electric current from the commercial AC power source AC can be captured by the utilization of a high frequency voltage oscillation generated therein, a diode Di2 and a charge capacitor Ci2 which define a circuit through which an electric current from can be captured by the utilization of a high frequency current oscillation generated therein, and a circuit 1. The circuit 1 includes one or more switching elements, an active element such as, for example, an inductance element and/or a capacitor forming a resonant circuit, and a load (not shown). The circuit 1 is so designed and so configured that high frequency voltage and current are generated as a result of the switching elements being alternately switched on and off at high speed.

For the purpose of the present invention, one of various nodes, in the circuit 1 at which the high frequency voltage is generated, and one of various current loops in the circuit 1, in which the high frequency current is generated, may be considered as a voltage source VS and as a current source CS, respectively. Accordingly, one of positive and negative outputs of the full wave rectifier element DB for rectifying the power from the commercial AC power source AC is coupled with the voltage source VS through the first charge capacitor Ci1, and the other of the positive and negative outputs of the full wave rectifier element DB is coupled with the second charge capacitor Ci2 to thereby form a loop circuit including the current source CS. A smoothing capacitor Ce of a high capacitance is connected across the rectifier element DB. A diode Di1 is connected in a forward going fashion between a junction of the rectifier element DB with the first charge capacitor Ci1 and a diode Di2 is connected in a forward going fashion between a junction of the rectifier element DB with the second charge capacitor Ci2.

In this circuit construction, the charge capacitor Ci1, the diode Di1 and the voltage source VS altogether constitute a voltage source type charge pump (VSCP) which forms a voltage source type input current capturing means as discussed hereinbefore in connection with the Prior Art 1, whereas the charge capacitor Ci2, the diode Di2 and the current source CS altogether constitute a current source type charge pump (CSCP) which forms a current source input current capturing means as discussed hereinbefore in connection with the prior art 2. By the utilization of those two charge pumps, an input current from the AC power source AC is drawn from a substantially full range of the AC power source AC and is subsequently charged into the smoothing capacitor Ce for conversion into a direct current so that a harmonic distortion of the input current from the AC power source AC can be reduced to achieve a high power factor. Hereinafter, the function of reducing the harmonic distortion of the input current from the AC power source AC is referred to as PFC (Power Factor Correction) and a circuit system in which the PFC is accomplished by the utilization of a charge pump technology is generally referred to as CPPFC (Charge Pump PFC) circuitry.

The CPPFC circuitry will now be discussed in detail.

(a) CPPFC (Input Power Factor Improving Charge Pump):

The circuit in which a high frequency input current flows through a load (resonant) circuit and in which alternate charge and discharge of a capacitor and a clamp are utilized to draw the input current proportional to the sine wave of the input voltage. As an application thereof, it is to be understood as including a circuit in which an input current path from the input power source to the load (resonant) circuit is provided with an inductance element for accomplishing continuous charge and discharge of the capacitor.

(b) Voltage Source Type CPPFC (VSCP):

One of the CPPFC circuits in which a voltage oscillation in the load (resonant) circuit is utilized to draw the input current. In this system, the use of a current source (an inductor) is necessitated to obtain the voltage oscillation and the inductor is superimposed with a load current and the input current.

(c) Current Source Type CPPFC (CSCP):

One of the CPPFC circuits in which a current of the load (resonant) circuit flows through an input power source. Although this system is considered as having a high efficiency, a load (lamp) current is generally insufficient to draw a sufficient input current and, therefore, the efficiency would not increase since the resonant current must be increased.

In the practice of the present invention, it is to be noted that VSCP and CSCP are so designed as to bring about a phase difference in a period in which the current is pumped up from the AC power source AC. Accordingly, if a combination of VSCP and CSCP is employed such as accomplished in the present invention, due to the phase difference between the power source VS and the current source CS, the period during which VSCP pumps up the current from the AC power source AC displaced from the period during which CSCP pumps up the current from the AC power source AC, and vice versa, and therefore, the period during which the input current Iin is pumped up during each switching cycle (a high speed switching on and off of a switching element) is correspondingly prolonged so that as compared with the case in which only one of VSCP and CSCP is utilized to pump up the input current Iin necessary for an output power to a predetermined load, the peak value of the input current Iin can be reduced to make it possible to provide a power source device having a PFC function requiring no component part of a high breakdown strength, compact in structure and inexpensive in cost.

Figure 2:
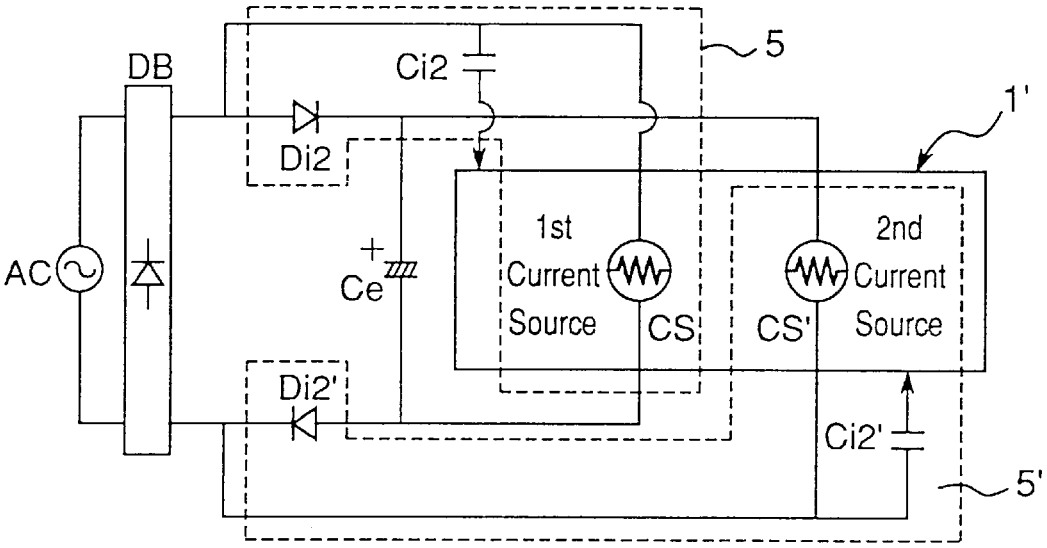
FIG. 2 is a circuit diagram showing a second basic circuit structure of the power source device according to the present invention.

FIG. 2 illustrates a basic structure of the power source device that is different from that shown in and discussed with reference to FIG. 1. In the circuit shown in FIG. 2, in place of VSCP employed in the circuit shown in FIG. 1, a second CSCP is employed to pump up the input current. In other words, the second CSCP 5' is made up of a current source CS', different from the current source CS in the circuit of FIG. 1, a diode Di1' and a charge capacitor Ci2'. Thus, the circuit of FIG. 2 makes use of the two current type charge pumps to pump up the input current to bring about effects similar to those afforded by the circuit of FIG. 1.

In any event, specific circuit structures of the power source device based on the principle discussed hereinabove will be described hereinafter.

1-2. Circuits:

1-2-1. Circuit Example 1a

Figure 3:
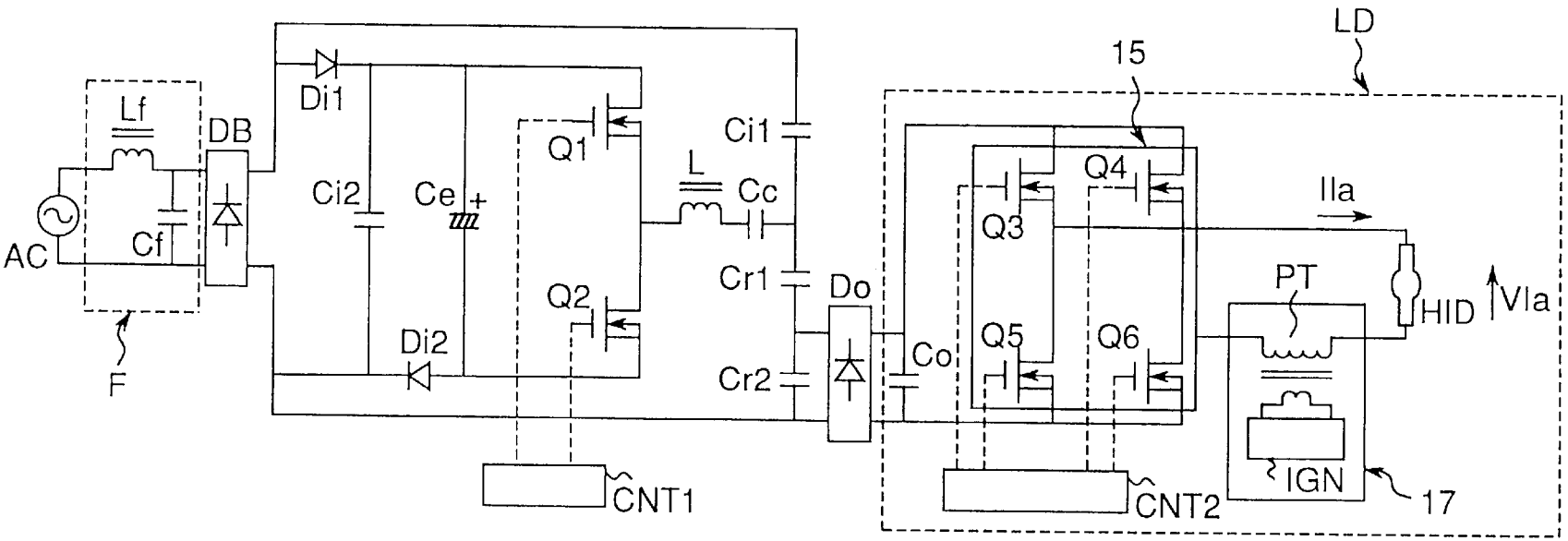
FIG. 3 is a circuit diagram showing the power source device according to a circuit example 1a of the present invention.

Referring now to FIG. 3, there is shown a specific circuit of the power source device. The power source device shown therein comprises an AC power source AC, a high frequency filter F, a rectifier element DB, a smoothing capacitor Ce for smoothing an output from the rectifier element DB, first and second switching elements Q1 and Q2 capable of being switched on and off at high speed in response to a voltage applied from the smoothing capacitor Ce, a resonator circuit including a resonant inductor Lr and resonant capacitors Cr1 and Cr2, a VSCP circuit including a diode Di1 and a charge capacitor Ci1, and a CSCP circuit including a diode Di2 and a charge capacitor Ci2. The power source device shown therein is so designed and so configured as to supply an electric power to a load circuit LD through a rectifier element Do connected across the resonant capacitor Cr2. Each of the first and second switching elements Q1 and Q2 is employed in the form of a MOSFET that is controlled by a control signal fed from a control circuit CNT1.

More specifically, a direct current voltage charged on the smoothing capacitor Ce and a high frequency voltage across the resonant capacitor Cr2 are rectified by a half-bridge inverter, basically comprised of the switching elements Q1 and Q2, the inductor L, a coupling capacitor Cc and the resonant capacitors Cr1 and Cr2, and an output rectifying diode bridge Do, respectively, and are subsequently smoothed by the capacitor Co to provide a desired direct current (DC) output voltage Vo. By alternately establishing a first state in which switching elements Q3 and Q5 are switched on and switching elements Q4 and Q6 are switched off and a second state in which the switching elements Q3 and Q5 are switched off and the switching elements Q4 and Q6 are switched on, the DC output voltage Vo can be converted into a rectangular wave output of a low frequency. In other words, the DC output voltage Vo is converted into the rectangular wave output of a low frequency by a polarity inverting circuit 2 operable to alternately establishing the first and second states at a low frequency according to a signal generated from a control circuit CNT2. It is to be noted that the coupling capacitor Cc referred to herein-above is inserted for cutting a direct current component and that the switching elements Q1 to Q6 are employed in the form of MOSFETs, the switching on and off of those switching elements being controlled by the signal generated by the control circuit.

Figure 4:
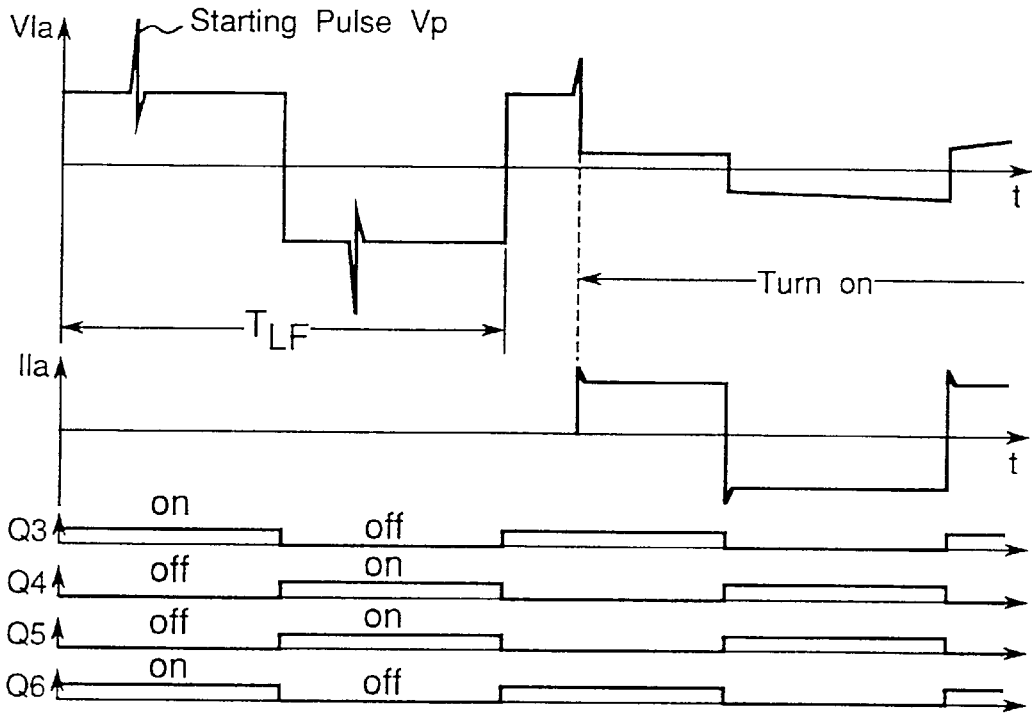
FIG. 4 is a diagram showing output waveforms in the power source device shown in FIG. 3.

This rectangular wave output is supplied to a final-stage load such as, for example, a high intensity discharge (HID) lamp HID through a high voltage pulse transformer PT, thereby completing a discharge lamp ignitor for igniting the high intensity discharge lamp HID. Reference characters IGN and PT, both shown in FIG. 3, constitute an ignitor circuit 3 wherefor a high voltage pulse required to start up the high intensity discharge lamp HID can be generated. Accordingly, once the high intensity discharge lamp HID is started up and turned on, generation of the high voltage pulse ceases. At this time, in the load circuit LD, the switching elements are switched on and off at respective timings as shown in FIG. 4 and a voltage VIa applied to the high intensity discharge lamp HID and a current IIa flowing through the high intensity discharge lamp HID vary in respective manners as shown in FIG. 4.

Figure 5:
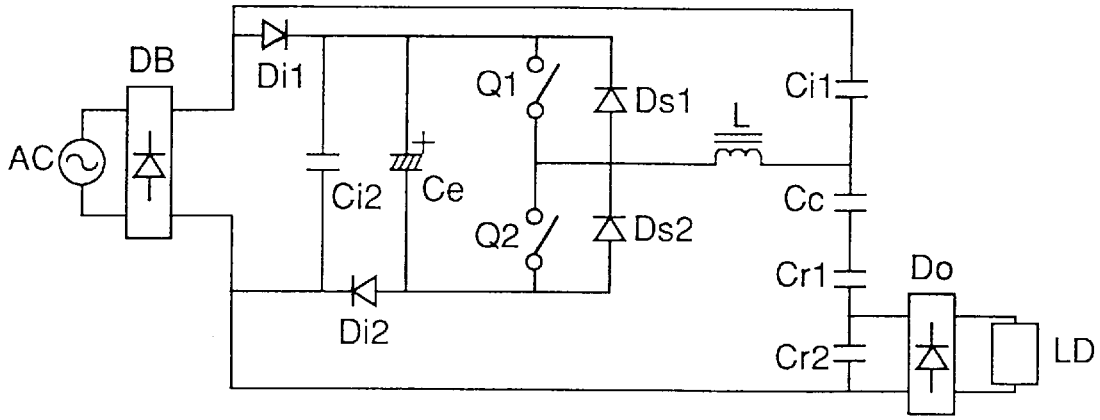
FIG. 5 is a diagram showing a simplified form of the circuit of the power source device shown in FIG. 3.

While the HID lamp ignitor device according to the present invention has been described as to its structure, the present invention does not directly pertains to the load circuit LD and is directed to the circuit and the function ultimately necessitated to obtain the direct current generated in the capacitor Co. Accordingly, for the sake of brevity, the circuit shown in FIG. 3 is simplified as shown in FIG. 5. The high frequency filter F comprised of the capacitor Cf and the inductor Lf is used to smooth a high frequency current so that an averaged low frequency current can be supplied to the AC power source AC and, for the sake of brevity, the high frequency filter F is not shown in the circuit of FIG. 5 and also in other equivalent circuits. In simplifying the circuit of FIG. 3, the following points are taken into consideration:

i) The load circuit is expressed by a block LD.

ii) The position of the capacitor Cc is changed to an equivalent position.

iii) The switching elements Q1 and Q2 are replaced by equivalent switches, respectively.

iv) Stray diodes Ds1 and Ds2 are added to the associated switching elements Q1 and Q2.

v) The high frequency filter at the power source is omitted.

Figure 6:
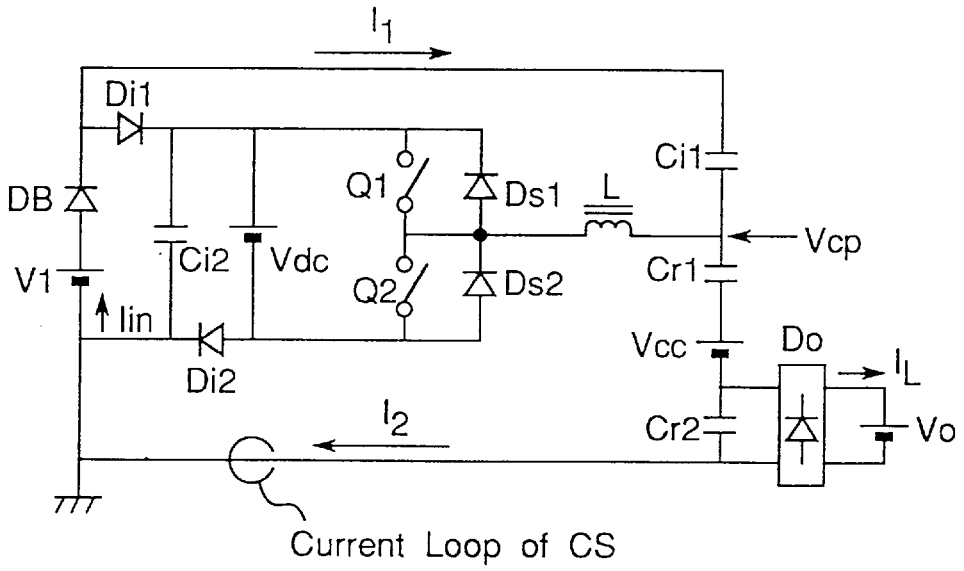
FIG. 6 is a diagram showing a further simplified form of the circuit of the power source device shown in FIG. 3.

In the description that follows, the circuit shown in FIG. 5 is further simplified as shown in FIG. 6 to facilitate a better understanding of the operation during one switching cycle. It is, however, to be noted that the various capacitor have different capacitances, specific values of which have such a relationship as Ce >>Cc>>Ci1, Ci2, Cr1>>Cr2. In further simplifying the circuit of FIG. 5, the following points are taken into consideration:

vi) Since the switching frequency of the switching elements is sufficiently high with respect to the frequency (for example, 50 Hz to 60Hz) of the AC power source AC and change in voltage of the AC power source AC can be regarded as not occurring during the switching cycle, the AC power source AC is replaced by a direct current (DC) voltage source Vin.

vii) Since change in voltage on the smoothing capacitor Ce can be regarded not occurring during the switching cycle, the smoothing capacitor Ce is replaced by a DC voltage source Vdc.

viii) Since though the capacitor Cc is included in the resonant circuit the voltage across the capacitor Cc is a DC voltage containing a high frequency ripple component, the capacitors Cc and Cr1 are expressed by a new capacitor Cr1 of a capacitance corresponding to a composite capacitance of the capacitors Cc and Cr1 and the DC voltage present at the capacitor Cc is replaced by a DC voltage source Vcc.

ix) Since the output to the load can be considered acquiring a smoothed DC voltage, the load LD is replaced by a DC voltage source Vo.

Referring to FIG. 6, VSCP has a Vcp node which serves as a voltage source VS and includes a charge capacitor Ci1 and a diode Di1, whereas CSCP includes a charge capacitor Ci2 and a diode Di2 with a current source CS defined by a current loop for a current flowing across the resonant capacitor Cr1. According to this structure, since the voltage source VS and the current source CS are within the same resonant system, the period during which the input current Iin is captured can be increased by the utilization of the difference in phase between the current and the voltage.

Hereinafter the operation of this circuit will be described. This circuit has approximately eight operating modes for each switching cycle. Assuming that Mode 1 starts at the time the current of the switching element Q2 changes from a negative polarity to a positive polarity while the switching elements Q1 and Q2 are off and on, respectively, operation of the circuit under each of Modes 1 to 8 will now be described with reference to FIGS. 7A to 7H, respectively. It is to be noted that in FIGS. 7A to 7H, not only the path of flow of current and rise and fall of the voltage during each of those modes are shown, and waveforms of principal current and voltage are shown in FIGS. 8A and 8J. It is also to be noted that in the description that follows, the voltage Vcp represents a voltage at a junction between the resonant inductor L, the resonant capacitor Cr1 and the current I1 represents a current flowing across the charge capacitor Ci1, and the current I2 represents a current flowing through the current loop of the current source CS.

Figure 7A:
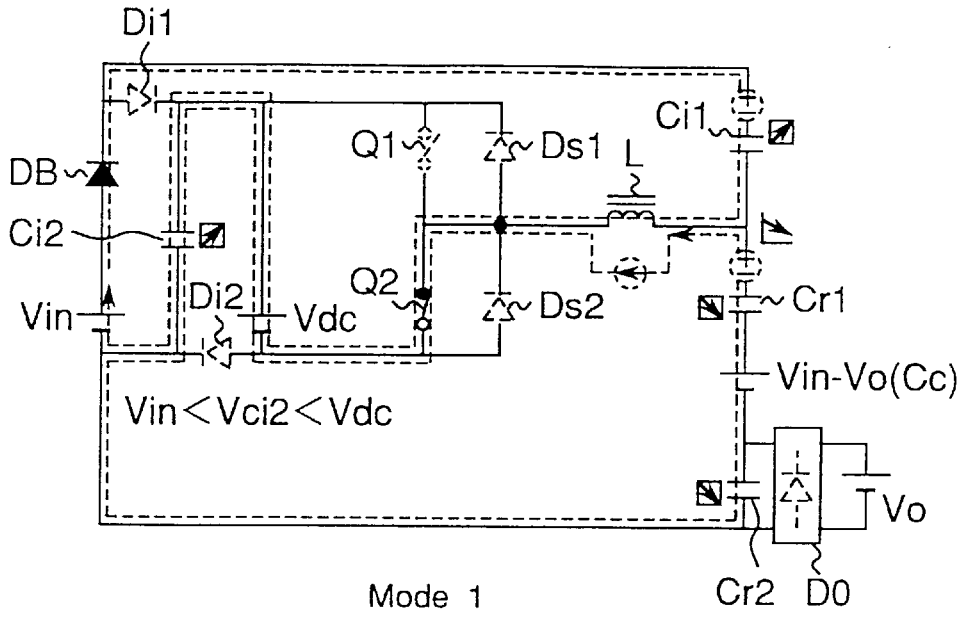
FIGS. 7A to 7H are diagrams explanatory of paths of flow of a current during respective modes of operation of the power source device showing in FIG. 3.
Figures 8A, 8B, 8C, 8D, 8E, 8F, 8G, 8H, 8I, 8J:
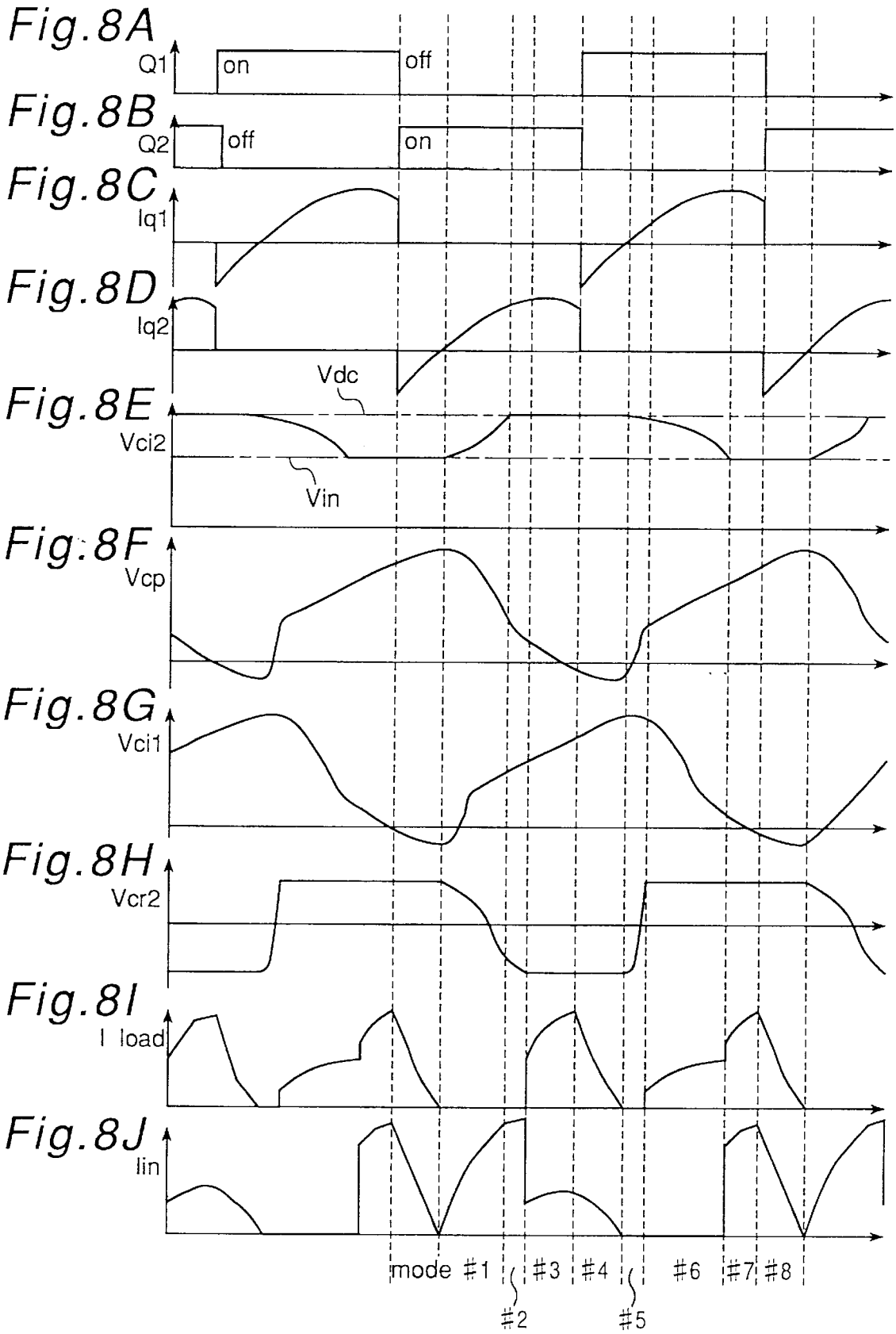
FIGS. 8A to 8J are diagrams showing waveforms of currents and voltages appearing in various part of the circuit of the power source device shown in FIG. 3.

(A) Mode 1;

The path of flow of the current during Mode 1 is shown in FIG. 7A. During Mode 1, the switches Q1 and Q2 are off and on, respectively, and it is assumed: Vcp>0 and Vcp>Vdc−Vc2. (In practice, however, Vci2=Vin and Vcp>Vdc−Vin.) The current I2 flows from the power source Vdc through the charge capacitor Ci2 to the resonant capacitor Cr2, the DC voltage source Vcc, the resonant capacitor Cr1, the resonant inductor L and the switch Q2. The voltage Vci2 on the charge capacitor Ci2 increases, accompanied by fall of the voltage Vcp. Since the voltage Vcp changes (decreases), the current I1 flows from the DC voltage source Vin to the rectifier element DB, the charge capacitor Ci1, the resonant inductor L, the switch Q2, the DC voltage source Vdc and the charge capacitor Ci2. In other words, the current I1 flows so as to attain a relationship of Vci1=Vin−Vcp and the charge capacitor Ci1 is charged by the DC voltage source Vin. In this way, VSCP pumps up the input current Iin from the AC power source AC. At this time, the CSCP dose not operate.

Figure 7B:
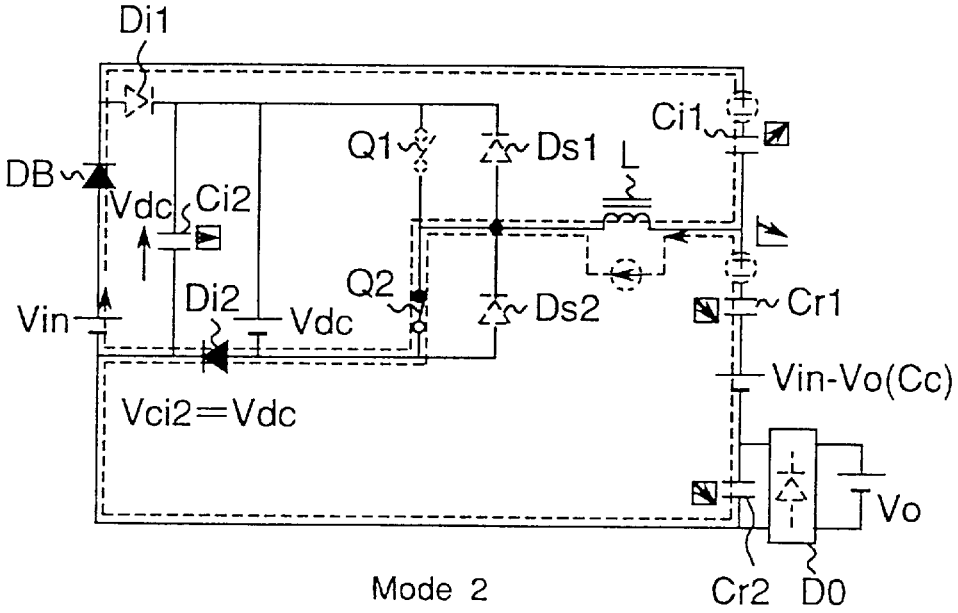

(B) Mode 2;

The path of flow of the current during Mode 2 is shown in FIG. 7B. During Mode 2, the switches Q1 and Q2 remain off and on, respectively. When the voltage VCi2 on the charge capacitor Ci2 attains a value equal to the voltage of the DC voltage source Vdc, the diode Di2 is brought in a conductive state. The current I2 flows from the node Vcp to the inductor L, the switch Q2, the diode Di2, the resonant capacitor Cr2, the DC voltage source Vcc and the resonant capacitor Cr1. Since the voltage Vcp changes (decreases), the current I1 flows from the DC voltage source Vin to the rectifier element DB, the charge capacitor Ci1, the resonant inductor L, the switch Q2 and the diode Di2. In other words, the current I1 flows so as to attain a relationship of Vci1=Vin−Vcp and the charge capacitor Ci1 is charged by the DC voltage source Vin. In this way, VSCP pumps up the input current Iin from the AC power source AC. At this time, the CSCP still does not operate.

Figure 7C:
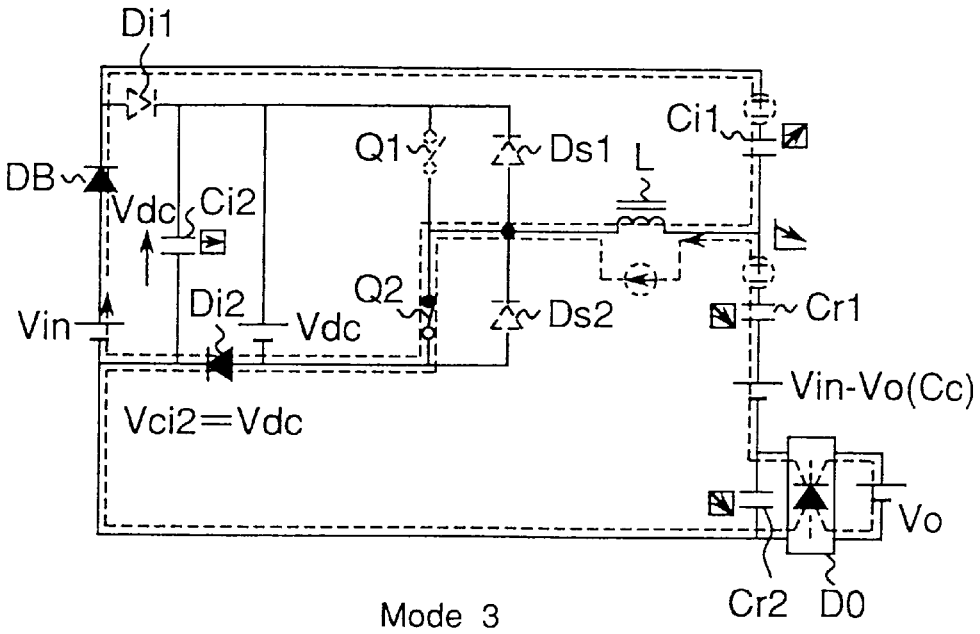

(C) Mode 3;

The path of flow of the current during Mode 3 is shown in FIG. 7C. During Mode 3, the switches Q1 and Q2 remain off and on, respectively. When the voltage Cr2 across the resonant capacitor Cr2 attains a value equal to−Vo, the rectifier element Do is brought in a conductive state to supply an electric power to the load (included in the DC voltage source Vo). The current I2 flows from the node Vcp to the inductor L, the switch Q2, the diode Di2, the rectifier element Do, the DC voltage sources Vo and Vcc and the resonant capacitor Cr1. For this reason, the voltage Vcp decreases and, hence, the current I1 flows from the DC voltage source Vin to the rectifier element DB, the charge capacitor Ci1, the resonant inductor L, the switch Q2 and the diode Di2. In other words, the current I1 flows so as to attain a relationship of Vci1=Vin−Vcp and the charge capacitor Ci1 is charged by the DC voltage source Vin. In this way, VSCP pumps up the input current Iin from the AC power source AC. At this time, the CSCP still does not operate and an output current is supplied to the load.

Figure 7D:
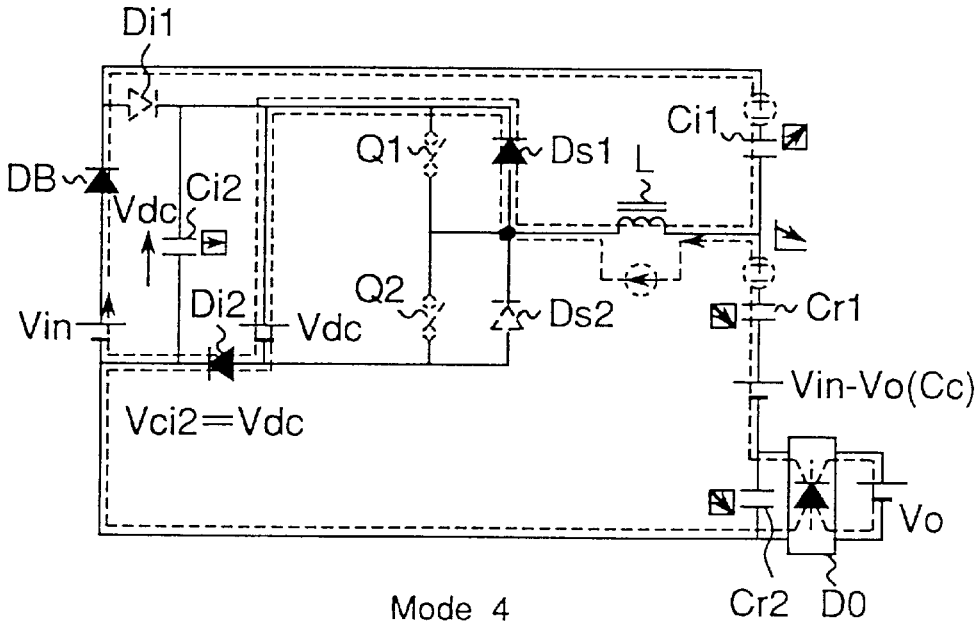

(D) Mode 4;

The path of flow of the current during Mode 4 is shown in FIG. 7D. At the start of Mode 4, the switches Q1 and Q2 are switched on and off, respectively. When the switches Q2 and Q1 are switched off and on, respectively, the current of the resonant inductor L continue to flow by the effect of a magnetic flux of the resonant inductor L. For this reason, the current I2 flows from the resonant inductor l to the stray diode Ds1, the DC voltage source Vdc, the diode Di2, the rectifier element Do, the DC voltage sources Vo and Vcc and the resonant capacitor Cr1. Since the voltage Vcp changes (decreases), the current I1 flows from the DC voltage source Vin to the rectifier element DB, the charge capacitor Ci1, the resonant inductor L, the stray diode Ds1, the DC voltage source Vdc and the diode Di2. In other words, the current I1 flows so as to attain a relationship of Vci1=Vin−Vcp and the charge capacitor Ci1 is charged by the DC voltage source Vin. In this way, VSCP pumps up the input current Iin from the AC power source AC and CSCP charges the smoothing capacitor Ce. At this time, this circuit provides the load with an output current.

Figure 7E:
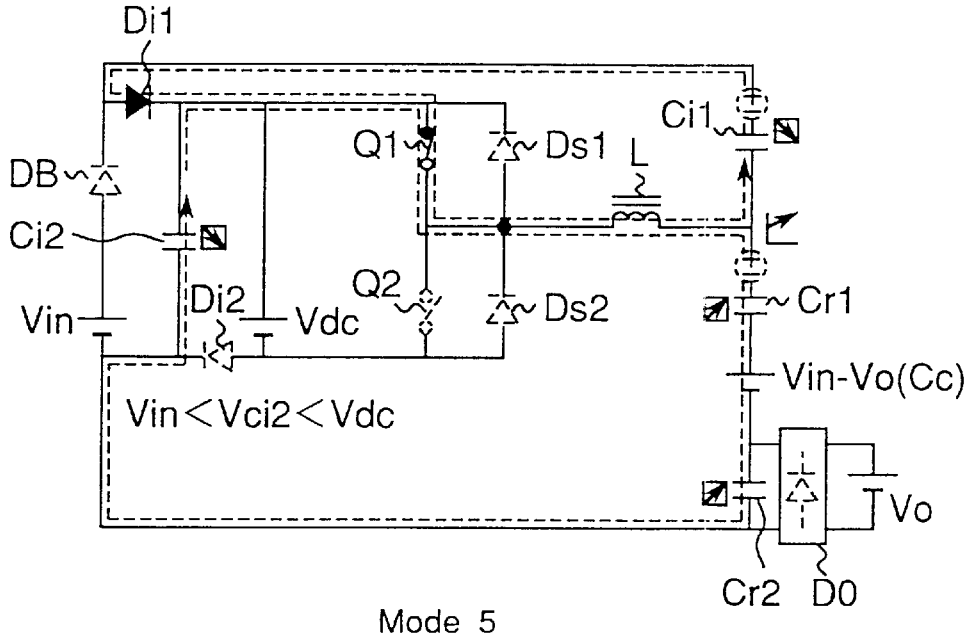

(E) Mode5;

The path of flow of the current during Mode 5 is shown in FIG. 7E. during Mode 5, the switches Q1 and Q2 remain on and off, respectively. In this mode, when the current of the resonant inductor L becomes zero and commutated, the current I2 flows from the charge capacitor Ci1 to the switch Q1, the resonant inductor L, the resonant capacitor Cr1, the DC voltage source Vcc and the resonant capacitor Cr2. Since the resonant capacitor Cr2 is charged in a direction reverse to that in which it has been charged, the rectifier element Do is brought in a non-conductive state to interrupt the supply of an electric power to the load. At this time, the voltage Vcp increased. Increase of the voltage Vcp allows the current I1 to flow from the charge capacitor Ci1 to the diode Di1, the switch Q1 and the resonant inductor L. During this mode, neither VSCP or CSCP operate.

Figure 7F:
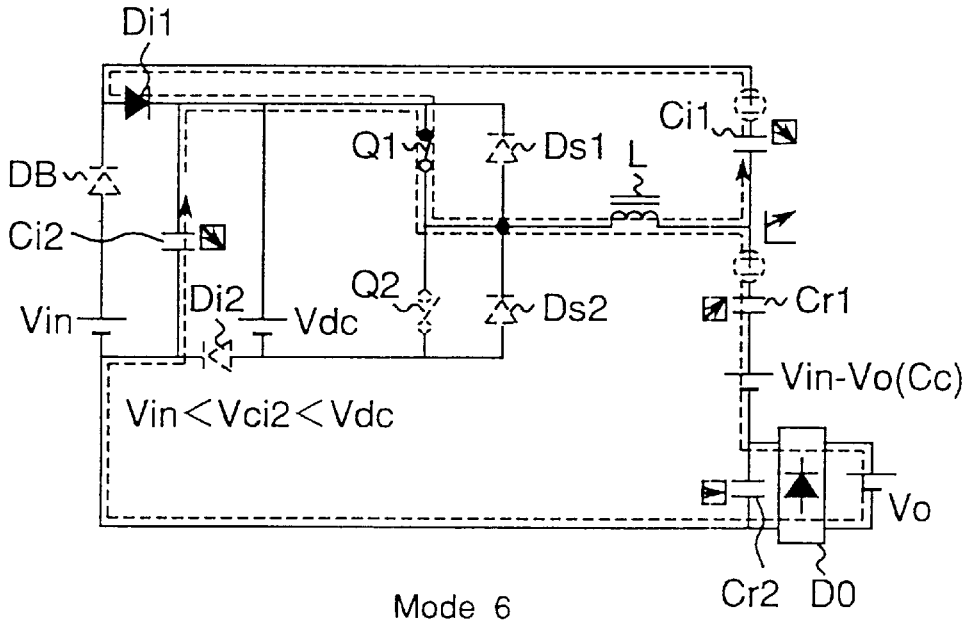
Figure 7G:
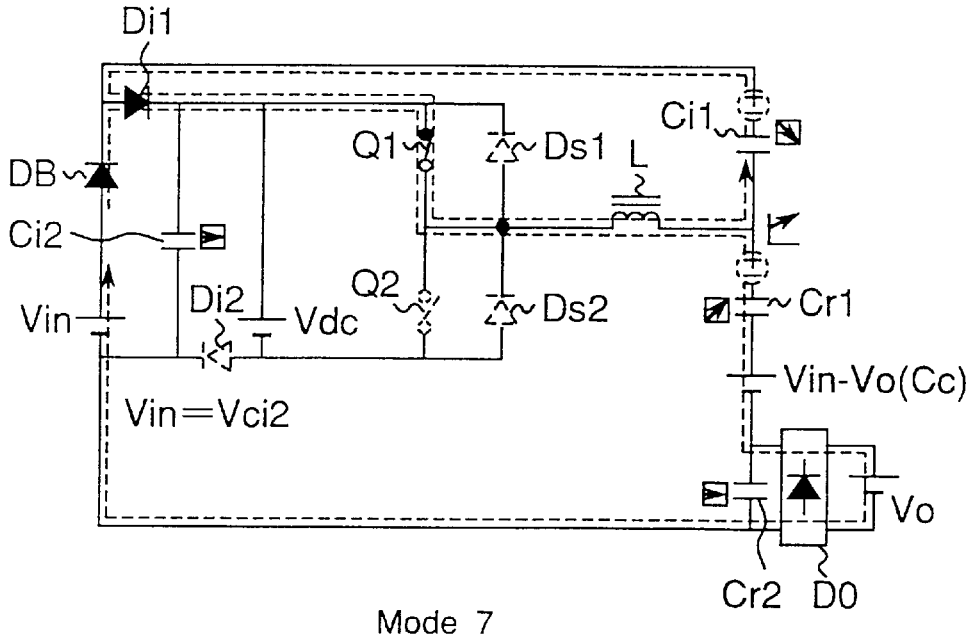

(F) Mode 6;

The path of flow of the current during Mode 6 is shown in FIG. 7F. During Mode 6, the switches Q1 and Q2 remian on and off, respectively. In this mode, the resonant capacitor Cr2 is charged by the current I2 and, when the voltage VCr2 of the resonant capacitor Cr2 attains a value equal to Vo, the rectifier element Do is brought in a conductive state to initiate the supply of an electric power to the load. The current I2 flows from the charge capacitor Ci2 to the switch Q1, the resonant inductor L, the resonant capacitor Cr1, the DC voltage source Vcc, the rectifier element Do and the DC voltage source Vo. At this time, Vcp increases and the current I1 flows from the charge capacitor Ci1 to the diode Di1, the switch Q1 and the resonant inductor L. At this time, the circuit provides the load with the output current. During this mode, neither VSCP or CSCP operate. (G) Mode 7;

The path of flow of the current during Mode 7 is shown in FIG. 7G. During Mode 7, the switches Q1 and Q2 are switched on and off, respectively. In this mode, when the voltage Vci2 on the charge capacitor Ci2 attains a value equal to Vin, the rectifier element DB is brought in a conductive state. The current I2 flows from the DC voltage source Vin to the rectifier element DB, the diode Di1, the switch Q1, the resonant inductor l, the resonant capacitor Cr1, the DC voltage source Vcc, the rectifier element Do and the DC voltage source Vo. At this time, the circuit provides the load with the output current. During this mode, the VSCP does not operates, but CSCP pumps up the input current Iin from the AC power source AC.

Figure 7H:
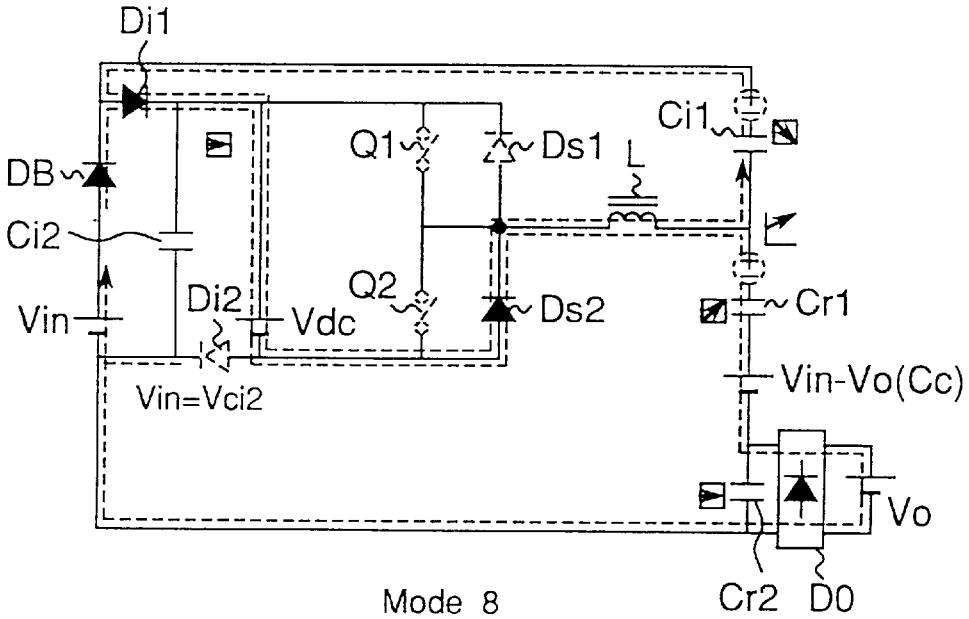

(H) Mode 8;

The path of flow of the current during Mode 8 is shown in FIG. 7H. At the start of Mode 8, the switches Q1 and Q2 are switched off and on, respectively. When the switches Q1 and Q2 are switched off and on, respectively, the current I2 flows from the DC voltage source Vin to the rectifier element DB, the diode Di1, the DC voltage source Vdc, the stray diode Ds2, the resonant inductor L, the resonant capacitor Cr1, the DC voltage source Vcc, the rectifier element Do and the DC voltage source Vo. Also, the current I1 flows from the charge capacitor Ci1 to the diode Di1, the DC voltage Vdc, the stray diode Ds2 and the resonant inductor L. At this time, VSCP charges Ce and CSCP pumps up the current Iin from the AC power source AC and charges Ce.

The foregoing Modes 1 to 8 are repeated.

As hereinabove described, VSCP pumps up the current Iin from the AC power source AC during each of Modes 1 to 4 and CSCP pumps up the current Iin from the AC power source AC during each of Modes 7 and 8. Thus, VSCP and CSCP have their phases of operation different from each other and, therefore, the period during which the current Iin is pumped up from the AC power source AC during one switching cycle can be prolonged as compared with the circuit in which only one of VSCP and CSCP is employed. Moreover, it is possible to employ the resonant capacitor Cr2 having a relatively low capacitance to thereby reduce an invalid current, which does not participate in an output and, yet, to reduce a low frequency ripple of the output. In other words, where the capacitance of the resonant capacitor Cr2 is reduced to a relatively low value, CSCP alone results in a low frequency ripple which would attain a maximum value in the vicinity of the peak of the input voltage whereas VSCP alone results in a low frequency ripple which would attain a minimum value in the vicinity of the peak of the input voltage. In addition, as compared with the case wherein one of VSCP and CSCP is employed, the charge capacitors Ci1 and Ci2 may have relatively low and high capacitances, respectively and, therefore, any possible influence each of those capacitors may bring on the output during conduction thereof can advantageously be minimized. Accordingly, the composite ripple thereof is smaller and more flat than that brought about when only one of either VSCP and CSCP is employed. Therefore, as compared with the prior art, it is possible to provide a the power source device of a type having the PFC function, in which no component parts of a high breakdown strength need be employed and which is inexpensive to manufacture. It is to be noted that, although in the practice of the embodiment now discussed, the two resonant capacitors Cr1 and Cr2 have been employed, three or more resonant capacitors may be employed.

1-2-2. Circuit Example 1b

Figure 9:
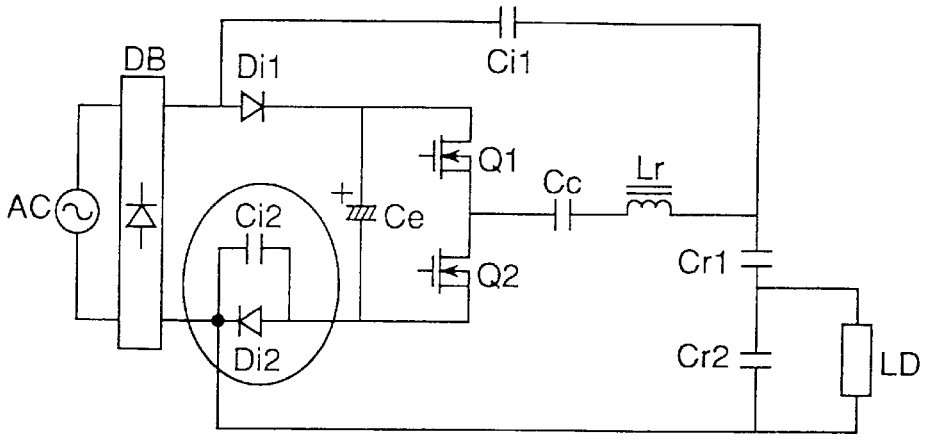
FIGS. 9 to 14 are circuit diagrams showing the power source device according to circuit examples 1b, 1c, 1d, 1e, 1 f and 1g, respectively, of the present invention.

Another specific circuit of the power source device according to the Circuit Example 1b of the present invention is shown in FIG. 9. The charge capacitor Ci2 according to the Circuit Example 1b is connected parallel to the diode Di2. Even the power source device according to the Circuit Example 1b can serve the purpose of the present invention.

1-2-3. Circuit Example 1c

Figure 10:
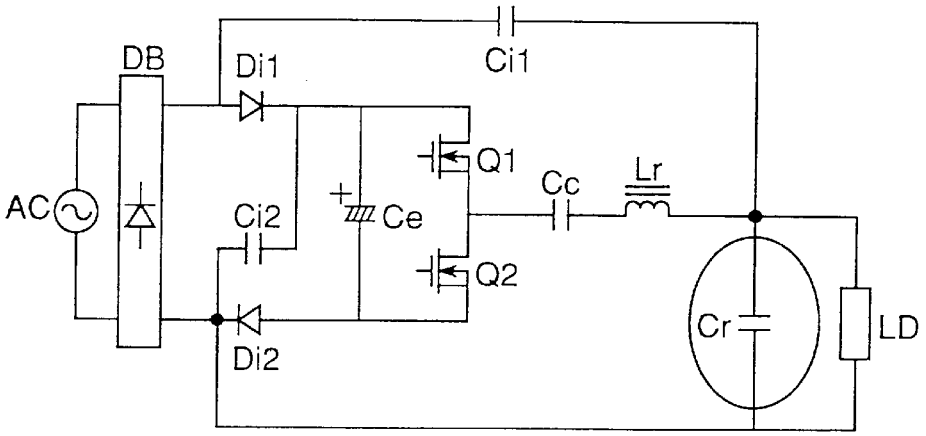

A different specific circuit of the power source device according to the Circuit Example 1c of the present invention is shown in FIG. 10. In the power source device shown in FIG. 10, a single resonant capacitor Cr is employed. Where the voltage Vce on the smoothing capacitor Ce is equal to the voltage Vo, no voltage division by means of any resonant capacitor is needed to allow the device as a whole to function optimally with the use of the single resonant capacitor Cr.

1-2-4. Circuit Example 1d

Figure 11:
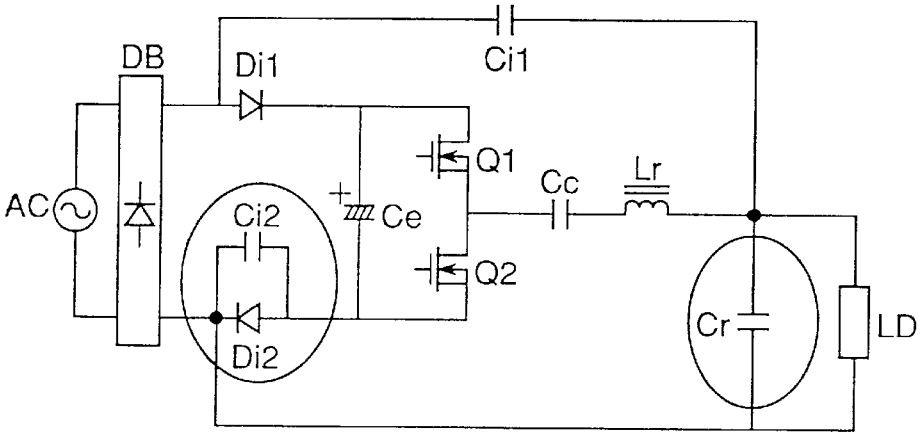

A further specific circuit of the power source device according to the Circuit Example 1d of the present invention is shown in FIG. 11. The circuit shown in FIG. 11 makes use of the single resonant capacitor Cr as is the case with the circuit according to the Circuit Example 1c and also of the charge capacitor Ci2 connected parallel to the diode Di2 as is the case with the circuit according to the Circuit Example 1b.

1-2-5. Circuit Example 1e

Figure 12:
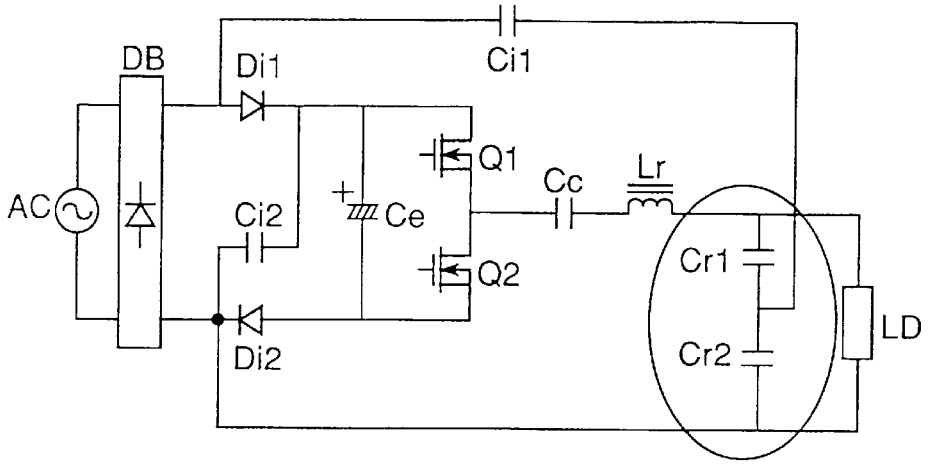

A still further specific circuit of the power source device according to the Circuit Example 1e of the present invention is shown in FIG. 12. The circuit shown in FIG. 12 is substantially similar to that shown in FIG. 9, but differs therefrom in that one of the opposite terminals of the charge capacitor Ci1 which is connected with the resonant inductor Lr in the circuit of FIG. 9 is connected with a junction between the resonant capacitors Cr1 and Cr2 as shown in FIG. 12. In other words, where the voltage Vce on the smoothing capacitor Ce is higher than the voltage Vo on the load LD an appropriate junction in a series circuit of the plural resonant capacitors Cr1 and Cr2 may be used as a power source VS such as shown in FIG. 12.

1-2-6. Circuit Example 1f

Figure 13:
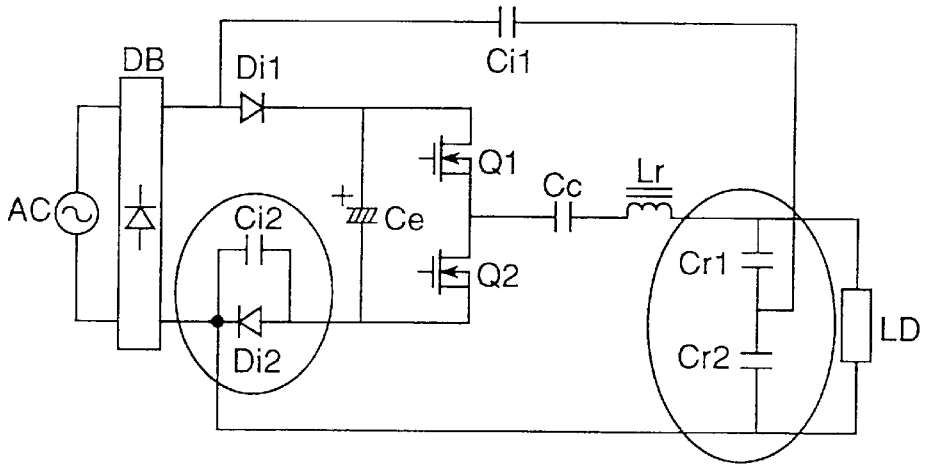

A yet further specific circuit of the power source device according to the Circuit Example 1f of the present invention is shown in FIG. 13. The circuit shown in FIG. 13 is substantially similar to that shown in FIG. 12, except that the charge capacitor Ci2 is connected parallel to the diode Di2.

1-2-7. Circuit Example 1g

Figure 14:
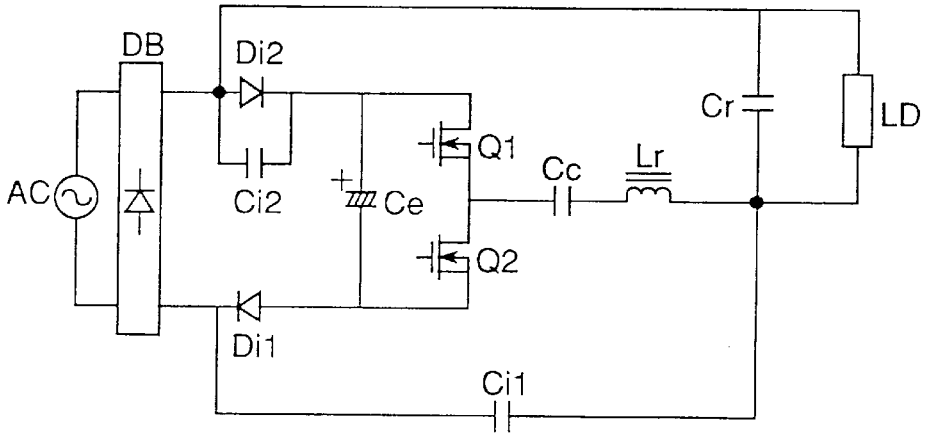

A yet further specific circuit of the power source device according to the Circuit Example 1g of the present invention is shown in FIG. 14. The circuit shown in FIG. 14 is substantially similar to that according to the Circuit Example 1d, except that as shown in FIG. 14 the polarities of the load LD and the polarities of the rectifier element DB connected with VSCP and CSCP are reversed to those in the circuit according to the Circuit Example 1d shown in FIG. 11. It is to be noted that the function and effects similar to those accomplished by the power source device according to any one of the foregoing Circuit Examples can be appreciated even if the polarities are reversed in any one of further embodiments and circuit examples of the present invention which will be described hereinafter.

Figure 15:
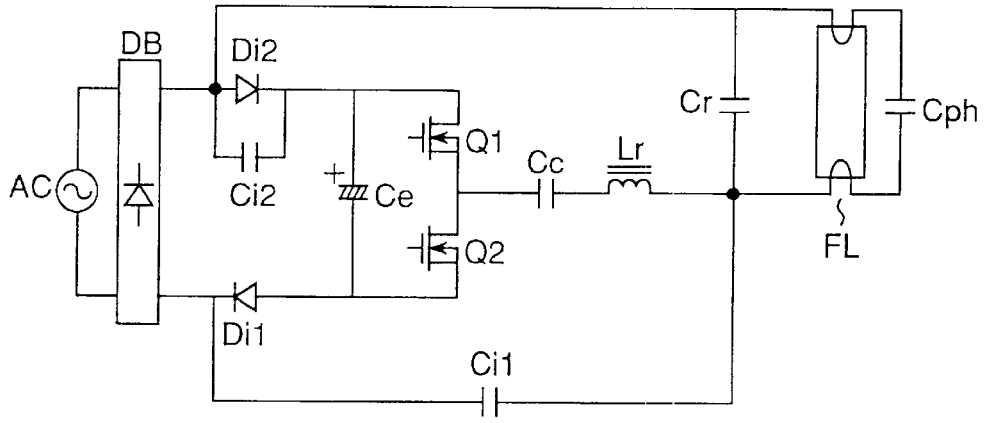
FIG. 15 is a diagram showing application of the power source device according to the circuit example 1g to a fluorescent lamp ballast.

It is also to be noted that in any one of the foregoing Circuit Examples, where a high frequency output is to be applied to the load, the output need not be rectified by the rectifier Do such as shown in the Circuit Example 1a. By way of example, as shown in FIG. 15 no rectifier is needed where the power source device is used in conjunction with a fluorescent lamp ballast.

1-2-8. Circuit Example 1h

Figure 16:
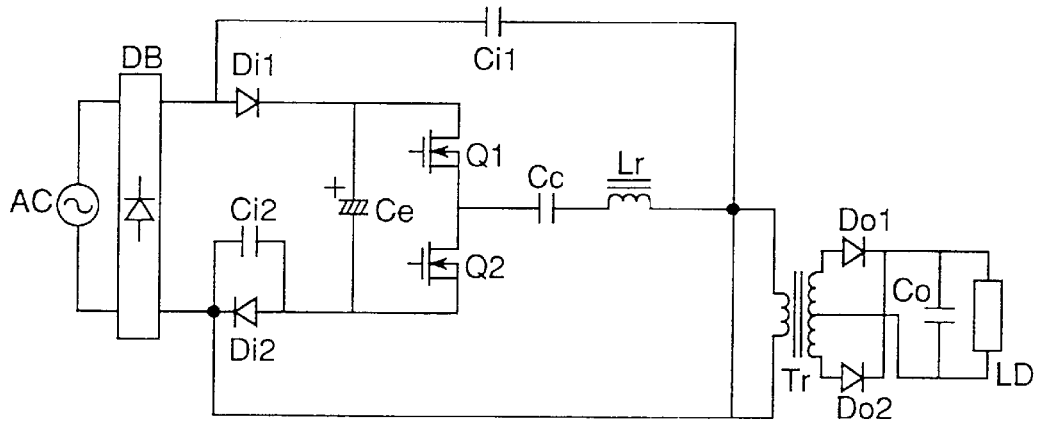
FIGS. 16 and 17 are circuit diagrams showing the power source device according to circuit examples 1h and 1i, respectively, of the present invention.

A yet further specific circuit of the power source device according to the Circuit Example 1h of the present invention is shown in FIG. 16. The circuit shown in FIG. 16 is substantially similar to the foregoing circuit, except that a transformer Tr is employed.

1-2-9. Circuit Example 1i

Figure 17:
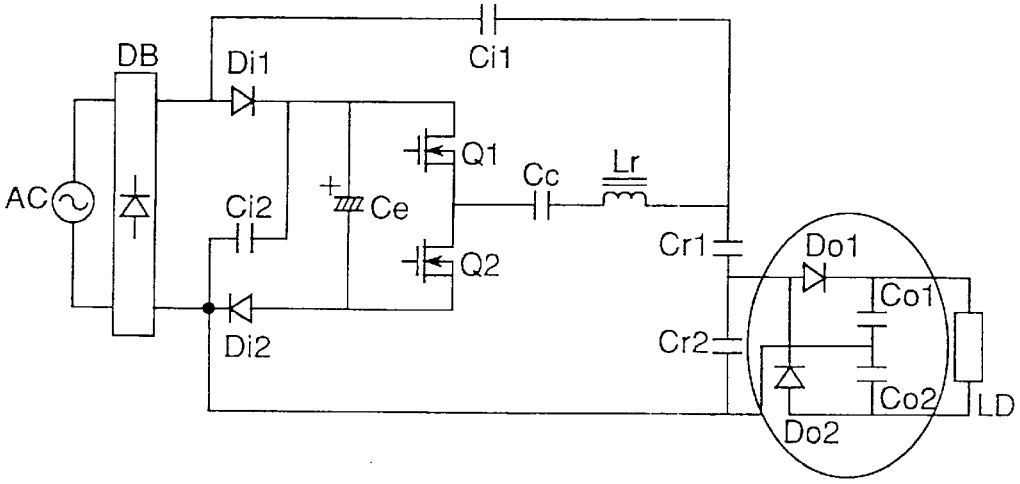

A yet further specific circuit of the power source device according to the Circuit Example 1i of the present invention is shown in FIG. 17. The circuit shown in FIG. 17 makes use of the rectifier Do in the form of a doubled voltage rectifying circuit made up of diodes Do1 and Do2 and capacitors Co1 and Co2 connected as shown in FIG. 17 so that a high voltage DC output can be obtained.

1-3. Effects:

As hereinabove described, with the power source device according to any one of the foregoing Circuit Examples, in a power transforming circuit operable to control an electric power, inputted from the AC power source AC, to a desired value and then to output it to the load, there is employed CSCP as a current source type input current capturing means for capturing an input current from the AC power source AC by the utilization of a high frequency oscillated current flowing in the high frequency current loop in the power transforming circuit and, also, VSCP as a voltage source type input current capturing means for capturing the input current from the AC power source AC by the utilization of a high frequency oscillated voltage at the high frequency voltage node in the power transforming circuit. The power source device so constructed makes it possible to reduce the breakdown strength of such various component parts as the switching elements, inductors and capacitors that form the power source device and also to provide the inexpensive and compact power source device having the PFC function because the input current Iin can be captured from the AC power source AC by means of both of CSCP and CSCP and because the period during which the input current Iin can be captured from the AC power source AC can be prolonged.

Also, with respect to the input current, the utilization of the load current can be maximized by VSCP and any shortage can be compensated for by VSCP and, therefore, the resonant capacitor Cr can have a low capacitor, that is, the current invalid to the input and output can be reduced, to reduce the resonant circuit current to thereby provide the output having a reduced low frequency (doubled frequency of Vin) ripple.

2. Second Embodiment 2-1. Summary:

As is well known to those skilled in the art, the fluorescent lamp or the like requires a relatively high voltage to be applied thereto at a start-up time so that a discharge can take place in the fluorescent lamp. In the standard inverter circuit used therefor, the resonant condition is so adjusted that the voltage necessary to start up resonant capacitors at opposite ends of the fluorescent tube can be generated by varying the operating frequency from the frequency at which the fluorescent lamp is lit.

Where VSCP shown in connection with the Prior Art 1 is to be employed, a charge capacitor Cin is connected to a load end, but where the high voltage is applied across the fluorescent tube for starting the fluorescent tube while the latter is turned off, there may be a possibility that the voltage Vce across the smoothing capacitor Ce may be excessively increased by the function of VSCP.

As a solution to the problem discussed above, there is such a circuit as shown in FIG. 18. The circuit shown in FIG. 18 comprises an AC power source AC, a rectifier element DB, a smoothing capacitor Ce, series-connected switching elements Q1 and Q2, a diode Di1, a charge capacitor Ci1, a first resonant circuit including a resonant inductor L1 and a resonant capacitor Cr1, a second resonant circuit including a resonant inductor L2 and a resonant capacitor Cr2, and a coupling capacitor Cc. The smoothing capacitor Ce and a series circuit of the switching elements Q1 and Q2 are connected parallel to each other, the first resonant circuit is connected parallel to the switching element Q2, and a series circuit including the coupling capacitor Cc and the second resonant circuit is connected parallel to the resonant capacitor Cr1. The load circuit LD is connected parallel to the resonant capacitor Cr2. A junction between the smoothing capacitor Ce and the switching element Q2 is connected with a low voltage output end of the rectifier element DB, and a junction between the smoothing capacitor Ce and the switching element Q1 is connected with a high voltage output end of the rectifier element DB through the diode D1. The charge capacitor Ci is connected at one end with the high voltage output end of the rectifier element DB and at the other end with a junction between the resonant capacitor Cr1 and the resonant inductor L1. In this circuit, the junction between the resonant inductor L1 and the resonant capacitor Cr1 is utilized as a high frequency voltage source VS and VSCP is comprised of the diode Di1 and the charge capacitor Ci1.

Figure 18:
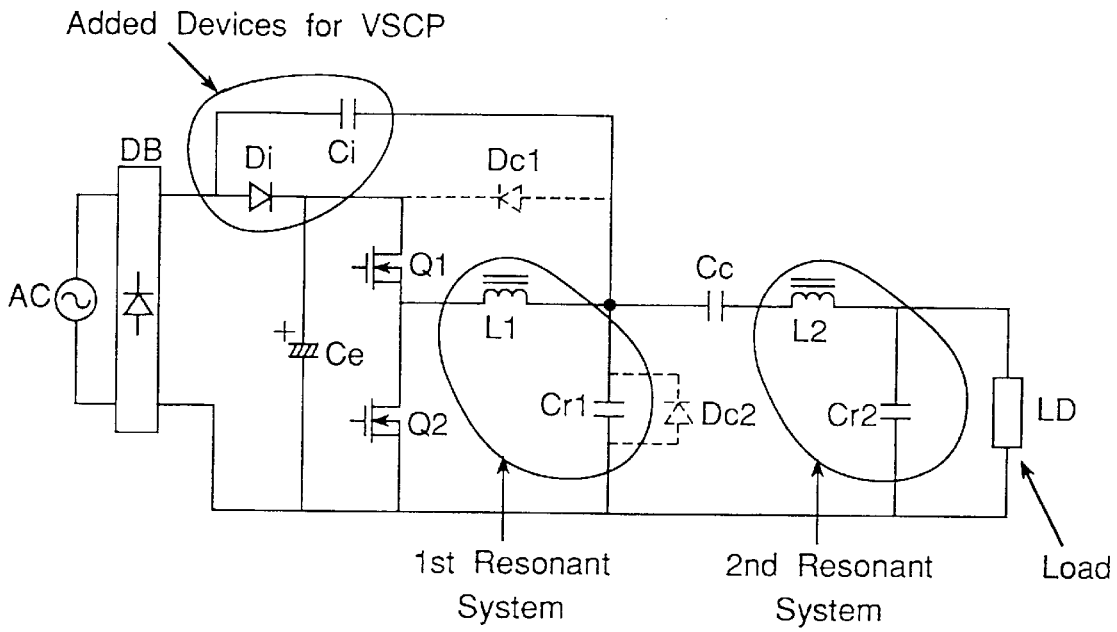
FIG. 18 is a circuit diagram disclosed by Wei Chenetal showing the power source device of a double-stage resonant circuit system.

The circuit shown in FIG. 18 makes use of the first resonant circuit, in addition to the second resonant circuit coupled with the fluorescent tube to generate a high voltage, to allow the first resonant circuit to perform the VSCP function to thereby suppress any possible excessive increase of the voltage Vce across the smoothing capacitor. This circuit is disclosed by Wei Chen et al., "Reduction of Voltage Stress in Charge Pump Electronic Ballast", 1996 IEEE Power Electronics Specialists Conference Proceedings, Vol. 2, pp. 887–893,June, 1996.

The second preferred embodiment of the present invention which will now be described hereinafter has been designed to employ the idea of the first preferred embodiment of the present invention in such a two-stage resonant circuit system as disclosed by Wei Chen et al., supra. Some circuit examples of the power source device utilizing VSCP in the first resonant system and, yet, added with CSCP will now be described.

2-2. Circuit Structures:

2-2-1. Circuit Example 2a

Figure 19:
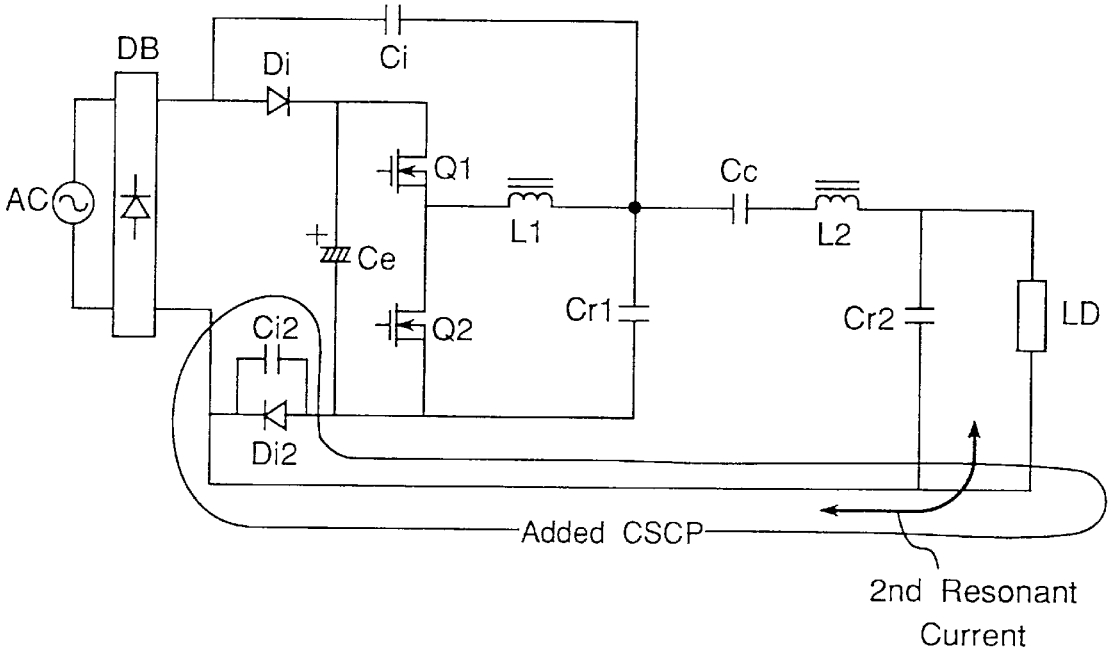
FIGS. 19 to 22 are circuit diagrams showing the power source device according to circuit examples 2a, 2b, 2c and 2d of the present invention.

Referring to FIG. 19, there is shown an electric circuit diagram of the power source device according to a first Circuit Example 2a. The circuit shown therein is substantially similar to that shown in FIG. 18, except that a parallel circuit of a diode Di2 and a charge capacitor Ci2 is inserted between a junction of a smoothing capacitor Ce with a switching element Q2 and a low voltage output end of a rectifier element DB and, also, except that a junction of a resonant capacitor Cr2 with the load LD, which has been connected in the circuit of FIG. 18 with a resonant capacitor Cr1, is separated from the resonant capacitor Cr1 and, instead, connected with a junction of the rectifier element DB and the diode Di2.

In the circuit shown in FIG. 19, the VSCP function is performed with a junction between a resonant inductor L1 and the resonant capacitor Cr1 used as a voltage source Vs, and the CSCP function is performed by the utilization of a current flowing through the second resonant circuit used to suppress an excessive increase of the voltage Vce on the smoothing capacitor Ce. In this circuit, the current source CS for CSCP is served by the resonant inductor L2.

According to the circuit structure shown in FIG. 19, even in the case of the power source device susceptible to a relatively large fluctuation of the load, such as a ballast for supplying a high frequency AC power to the fluorescent lamp, not only can the effect of suppressing the excessive increase of the voltage be accomplished by the two-stage resonance, but such effects as accomplished by VSCP and CSCP discussed hereinbefore can also be obtained. Accordingly, as is the case with the foregoing embodiment of the present invention, the compact and inexpensive power source device utilizing a reduced breakdown strength of various component parts can be obtained.

2-2-2. Circuit Example 2b

Figure 20:
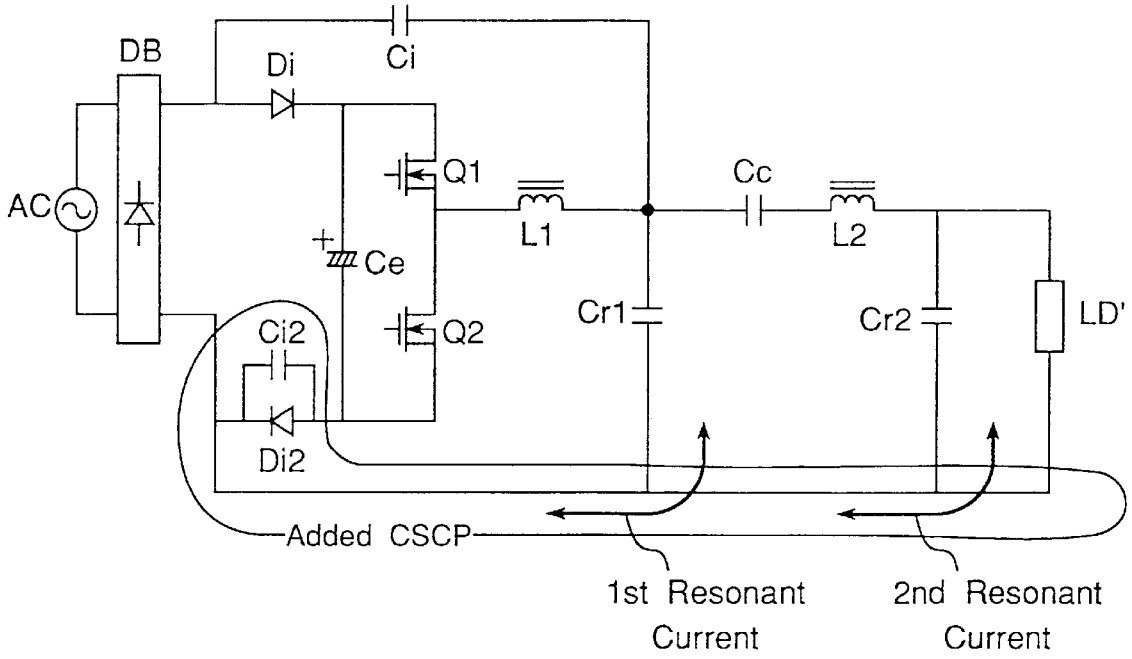

An electric circuit diagram of the power source device according to a second Circuit Example 2b is shown in FIG. 20. The circuit shown therein is substantially similar to that shown in FIG. 19, except that one end of the resonant capacitor Cr1, which in the circuit of FIG. 19 has been connected with the switching element Q2, is separated from the switching element Q2 and connected with a junction between the rectifier element DB and the diode Di2. In other words, CSCP employed in the circuit shown in FIG. 20 comprises a first resonant system including the resonant inductor L1 and the resonant capacitor Cr1, a second resonant system including the resonant inductor L2 and the resonant capacitor Cr2, the capacitor Ci2 and the diode Di2.

Thus, in the circuit shown in FIG. 20, the respective resonant currents flowing through the first and second resonant systems are utilized to accomplish CSCP. In the Circuit Example 2a the resonant current is represented by a current flowing through the load and, therefore, if the load circuit LD is under a no-load condition such as occurring before the start-up of the lamp, the invalid current which flows through the resonant capacitor Cr2 for generating the high voltage across the resonant capacitor Cr2 tends to become large. Since during the no-load condition pumping of the input current Iin from the AC power source AC by CSCP tends to increase, the CSCP function need be reduced. However, according to the Circuit Example 2b, in order to eliminate the problem discussed above, arrangement has been made to allow the first resonant current to participate in the CSCP function as well and, accordingly, the CSCP function can be stabilized relative to a load condition.

2-2-3. Circuit Example 2c

Figure 21:
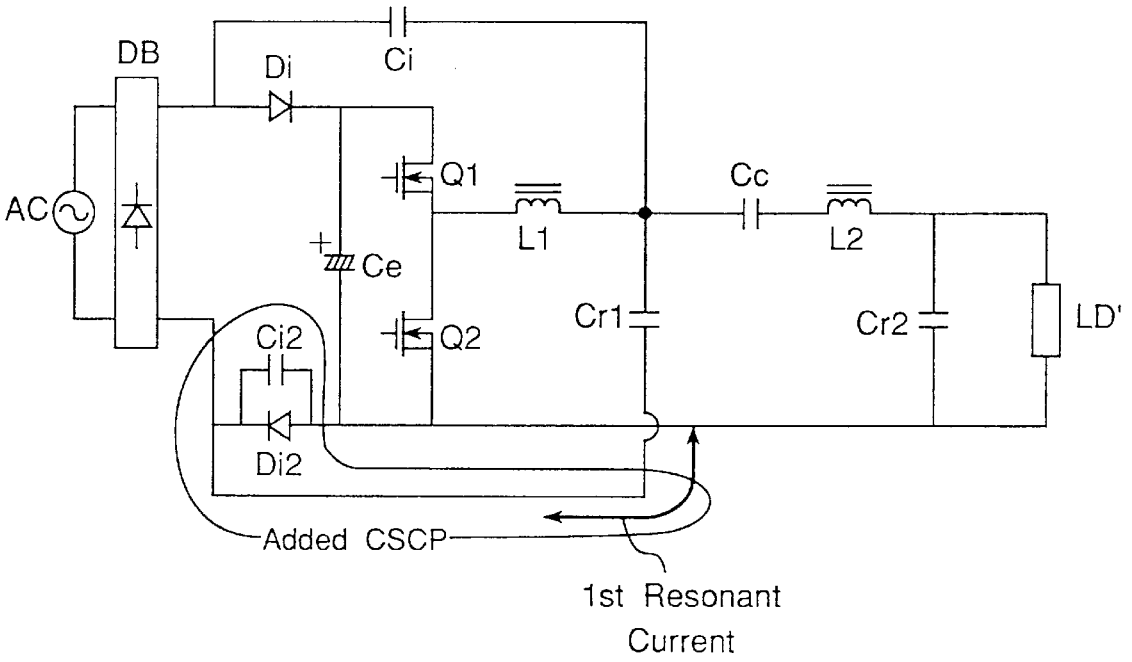

An electric circuit diagram of the power source device according to a third Circuit Example 2c is shown in FIG. 21. The circuit shown therein is substantially similar to that shown in FIG. 20, except that one end of the resonant capacitor Cr2, which has been connected with a junction between the rectifier element DB and the diode Di2 in the circuit of FIG. 20, is separated from such junction and connected with a low voltage side of the smoothing capacitor Ce. CSCP employed in this circuit comprises the first resonant system including the resonant inductor L1 and the resonant capacitor Cr1, the charge capacitor Ci2 and the diode Di2.

According to the Circuit Example 2c, the CSCP function is accomplished by the utilization of the current flowing through the first resonant system for providing the load LD with a high frequency output, that is, the current flowing through the resonant capacitor Cr1. Since no second resonant current is utilized, the CSCP function more stable than that accomplished by the Circuit Example 2b can be obtained regardless of the condition of the load LD.

2-2-4. Circuit Example 2d

Figure 22:
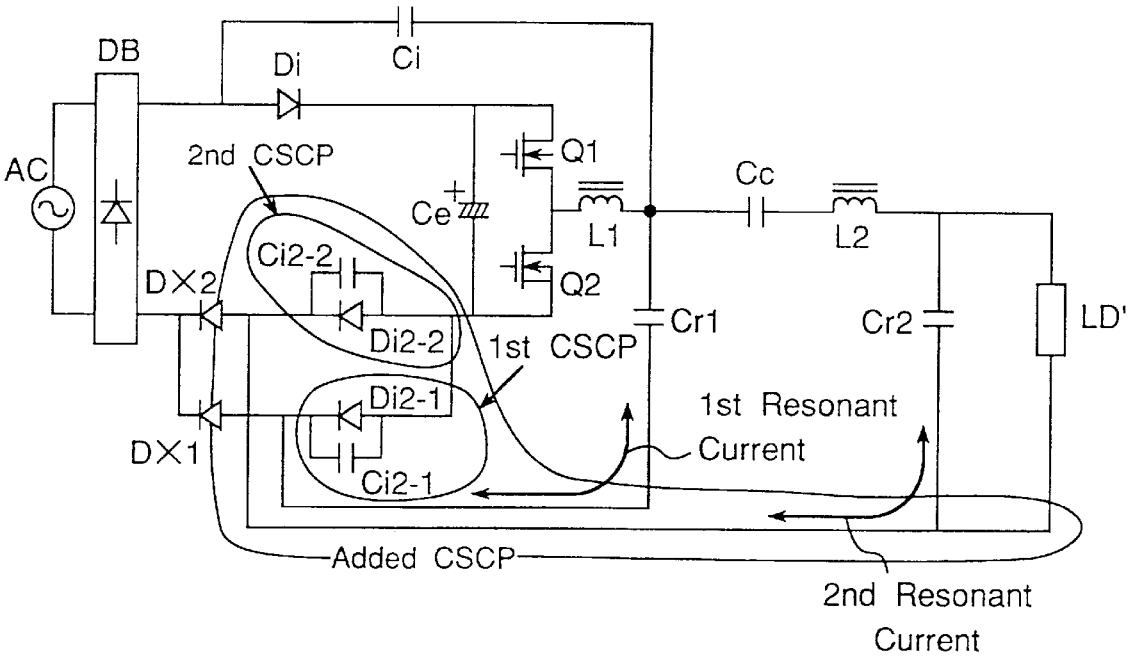

An electric circuit diagram of the power source device according to a fourth Circuit Example 2d is shown in FIG. 22. The circuit shown therein makes use of a first CSCP, made up of a first resonant system including a resonant inductor L1 and a resonant capacitor Cr1, a charge capacitor Ci2-1 and a diode Di2-1, and a second CSCP made up of a second resonant system including a resonant inductor L2 and a resonant capacitor Cr2, a charge capacitor Ci2-2 and a diode Di2-2. In this circuit shown in FIG. 22, since the VSCP function and the first and second CSCP functions are performed in different phases, the period during which the input current Iin can be pumped up from the AC power source AC can be increased, accompanied by reduction of the peak value of the current flowing through the circuit and, therefore, the inexpensive and compact power source employing the various component parts having a reduced breakdown strength can be obtained.

2-3. Effects:

With the power source device according to the second embodiment of the present invention, since even in the inverter circuit utilizing the two-stage resonant systems, the period during which the input current Iin can be pumped up from the AC power source AC during each switching cycle can be increased, the breakdown strength of the various component parts such as the switching elements, inductors and capacitors can be reduced to allow the inexpensive and compact power source device having the PFC capability to be obtained.

Figure 23:
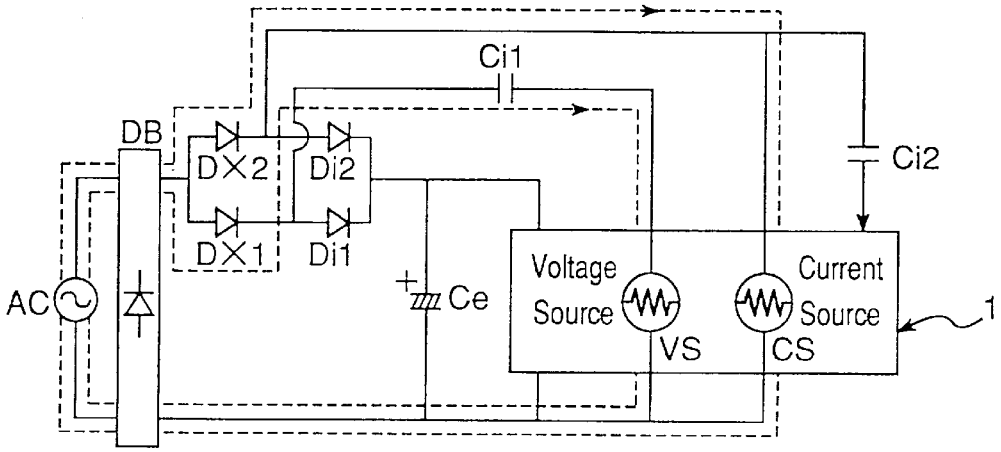
FIG. 23 is a circuit diagram showing a basic circuit of the power source device according to a third preferred embodiment of the present invention.

3. Third Embodiment 3-1. Summary:

A basic circuit structure according to a third preferred embodiment of the present invention is shown in FIG. 23. The power source device shown therein comprises an AC power source AC, a rectifier element DB, a smoothing capacitor Ce, CSCP, VSCP and a circuit 1. While in the previously described first embodiment of the present invention CSCP and VSCP have been described as connected with the different polarities of the rectifier element DB, CSCP and VSCP in the third embodiment of the present invention are connected with the same polarity of the rectifier element DB. The circuit 1 includes one or more switching element, an active element such as an inductor and/or a capacitor, and a load. In this circuit 1, a high frequency voltage and a high frequency current are generated as a result of high speed switching on and off of the switching elements. In this embodiment, one of various nodes at which the high frequency voltage is generated, and one of various current loops in which the high frequency current is generated, are considered as a voltage source VS and as a current source CS, respectively.

Referring to FIG. 23, VSCP is comprised of a diode Di1, a charge capacitor Ci1 and a voltage source VS. In this VSCP, the charge capacitor Ci1 is connected between one of positive and negative outputs of the rectifier element DB for rectifying the power from the AC power source AC and the voltage source VS through a diode Dx1, and the diode Di1 is connected in a forward going fashion between the charge capacitor Ci1 and a smoothing capacitor Ce. CSCP is comprised of a diode Di2, a charge capacitor Ci2 and the current source CS. In this CSCP, a loop of the current source CS is formed through the diode Dx2 in cooperation with the same output of the rectifier element DB as that to which VSCP is connected, with the charge capacitor Ci2 connected therewith, and the diode Di2 is connected in a forward going fashion between the charge capacitor Ci2 and the smoothing capacitor Ce. The diodes Dx1 and Dx2 referred to above are employed to avoid any possible interference in function between VSCP and CSCP.

By those two charge pumps (that is, CSCP and VSCP), the input current from the AC power source AC is drawn from a substantially full range of the AC power source AC and is subsequently charged into the smoothing capacitor Ce for conversion into a direct current so that a harmonic distortion of the input current from the AC power source AC can be reduced to achieve a high power factor.

In this embodiment, VSCP and CSCP are so configured as to pump up the current from the AC current source AC at different phases. Accordingly, when VSCP and CSCP are combined together in the manner described above, the difference in phase between the voltage source VS and the current source CS results in a displacement of the period during which the current is pumped up from the AC power source AC by VSCP and CSCP, and due to the phase difference between the power source VS and the current source CS, the period during which the input current Iin is pumped up during each switching cycle (a high speed switching on and off of a switching element) is correspondingly prolonged so that as compared with the case in which only one of VSCP and CSCP is utilized to pump up the input current Iin necessary for an output power to a predetermined load, the peak value of the input current Iin can be reduced to make it possible to provide a power source device having a PFC function requiring no component part of a high breakdown strength, compact in structure and inexpensive in cost. Hereinafter, circuit examples of the power source device based on the basic circuit structure according to the third embodiment of the present invention will be discussed.

3-2. Circuit Structures:

3-2-1. Circuit Example 3a

Figure 24:
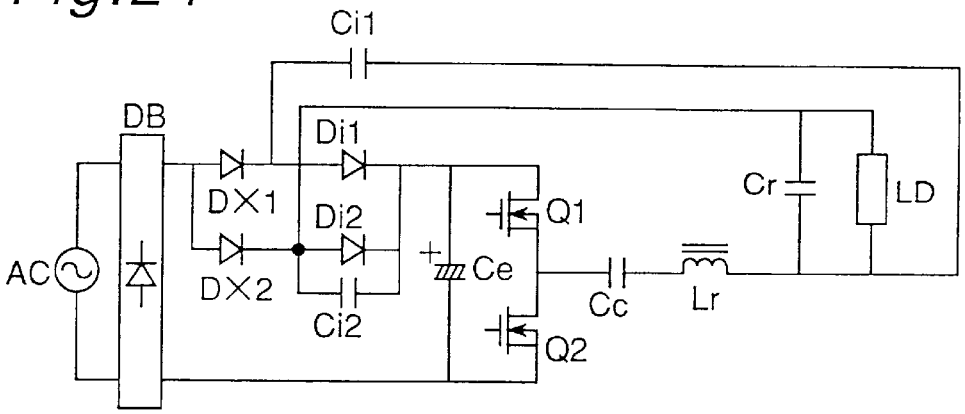
FIGS. 24 to 26 are circuit diagrams showing the power source device according to circuit examples 3a, 3b and 3c, respectively, of the present invention.

An electric circuit diagram of the power source device according to a first Circuit Example 3a is shown in FIG. 24. The circuit 1 includes switching elements Q1 and Q2, a coupling capacitor Cc, a resonant inductor Lr, a resonant capacitor Cr and a load LD, all of which are connected in a manner as shown in FIG. 24.

In this circuit, CSCP is comprised of the charge capacitor Ci2 and the diode Di2 with the current source CS served by the current loop, including the resonant inductor Lr and the resonant capacitor Cr to generate a resonant current, and a load current of a half-bridge inverter made up of the switching elements Q1 and Q2. On the other hand, since VSCP is comprised of the charge capacitor Ci1 and the diode Di12 with the voltage source VS served by one end of the resonant capacitor so that a resonant voltage of the resonant capacitor Cr can be utilized.

In this Circuit Example 3a, VSCP and CSCP are disposed on a positive side of the output of the rectifier element DB. As hereinbefore discussed, though any one of VSCP and CSCP pumps up the input current Iin from the AC power source AC during the process of decrease of any one of the voltage source VS and the current source CS from a maximum value down to a minimum value, since the Circuit Example 3a makes use of the resonant current and the resonant voltage within the same resonant circuit, the phase difference occurs as a matter of course between the voltage source VS and the current source CS and, therefore, the period during which the input current Iin is pumped up from the AC power source AC during each switching cycle expands as compared with that accomplished in the prior art circuit, making it possible to provide the inexpensive and compact power source device wherein the circuit elements of a relatively low breakdown strength are employed.

3-2-2. Circuit Example 3b

Figure 25:
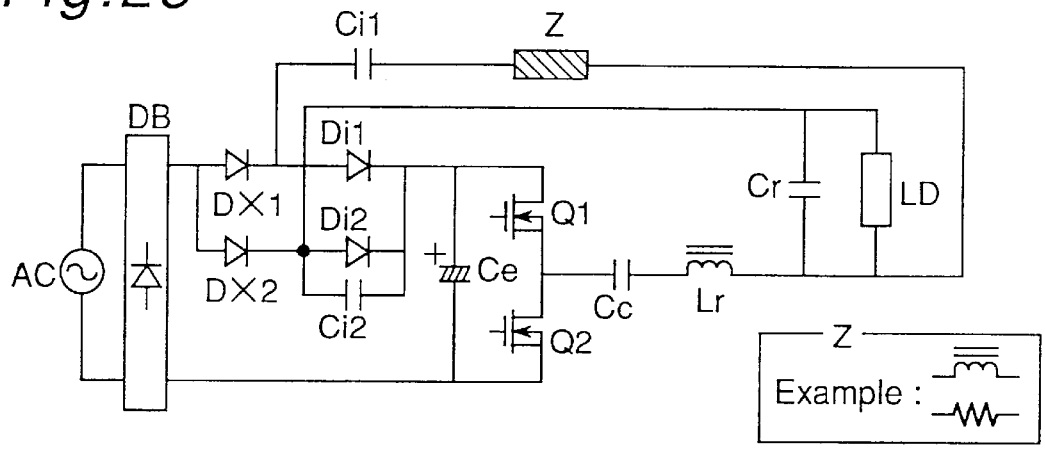

An electric circuit diagram of the power source device according to a second Circuit Example 3b is shown in FIG. 25. The circuit shown therein is substantially similar to that shown in FIG. 24, except that an impedance Z such as, for example, an indictor element or a resistor is inserted between the charge capacitor Ci1 and the resonant capacitor Cr as a current limiting element for limiting the current. The use of the impedance Z such as shown in FIG. 25 is effective to reduce the peak value of the current flowing through the charge capacitor Ci1.

3-2-3. Circuit Example 3c

Figure 26:
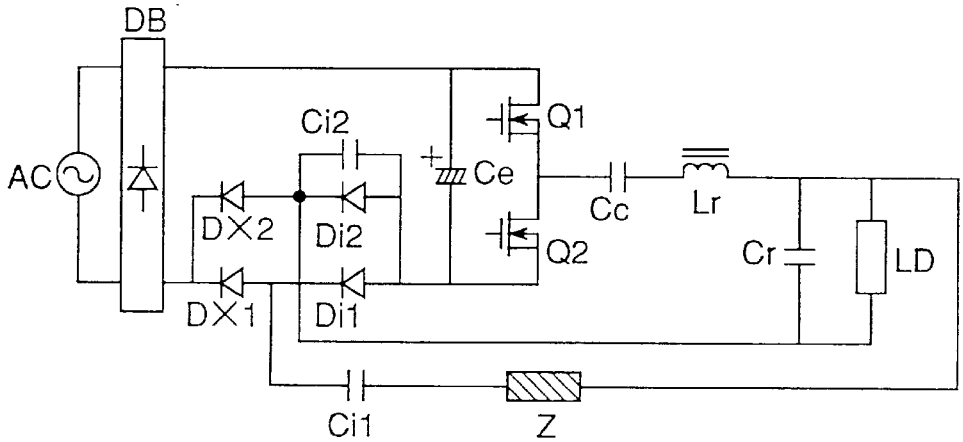

An electric circuit diagram of the power source device according to a third Circuit Example 3c is shown in FIG. 26. In this circuit, VSCP and CSCP are connected with a negative side of the rectifier element DB.

3-3. Effects:

Since the power source device according to this embodiment is provided with CSCP and VSCP both connected with the same polarity of the rectifier element DB, the period during which the input current Iin can be pumped up from the AC power source AC during each switching cycle can be increased, making it possible to provide the inexpensive and compact power source device in which the component parts such as the switching elements, inductors and capacitors having a reduced breakdown strength can be employed.

Also, since one polarity of the rectifier element DB and one polarity of the smoothing capacitor Ce are directly connected with each other, the stability of the circuit is high and, in particular, high frequency electromagnetic noises can be reduced.

Figure 27:
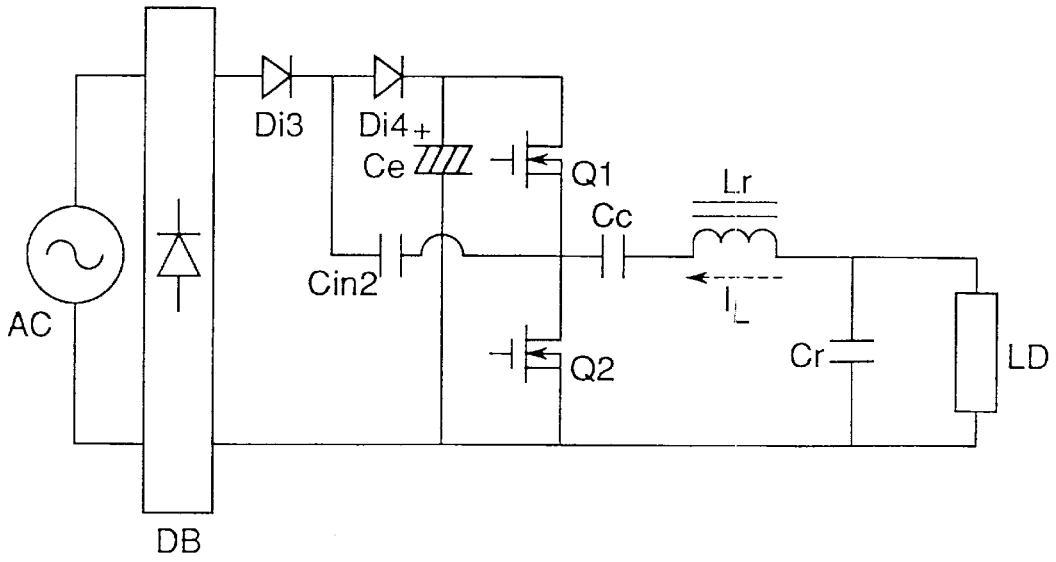
FIG. 27 is a circuit diagram showing the power source device of the CSCP system disclosed in the U.S. Pat. No. 5,488,269.

4. Fourth Embodiment 4-1. Summary:

As another circuit system of CSCP shown in connection with the Prior Art 2, there is a circuit shown in FIG. 27 and disclosed in the U.S. Pat. No. 5,488,269. The circuit comprises an AC power source AC, a rectifier element DB for receiving an output from the AC power source AC, a smoothing capacitor Ce, series-connected switching elements Q1 and Q2, a resonant circuit including a resonant capacitor Lr and a resonant capacitor Cr, a load circuit, series-connected diodes Di3 and Di4, and a charge capacitor Cin2. The smoothing capacitor Ce and the pair of the switching elements Q1 and Q2 are connected parallel to each other, a series circuit of a coupling capacitor and the resonant circuit being connected parallel to the switching element Q2, and the load circuit is connected parallel to the resonant capacitor Cr. One end of the smoothing capacitor is connected with a low voltage output end of the rectifier element DB; a pair of diodes Di3 and Di4 are connected between a high voltage output end of the rectifier element DB and the other end of the smoothing capacitor; and the charge capacitor Cin2 is connected between a junction of the diode Di3 with the diode Di4 and a junction of the switching element Q1 with the switching element Q2. The diodes Di3 and Di4 and the charge capacitor Cin2 altogether constitute a CSCP circuit.

In the case of this circuit system, of currents flowing through the resonant inductor Lr, a flywheel current flowing through a stray diode of the switching elements Q1 and Q2 is utilized to accomplish alternate charge and discharge of the charge capacitor Cin2.

Figure 28:
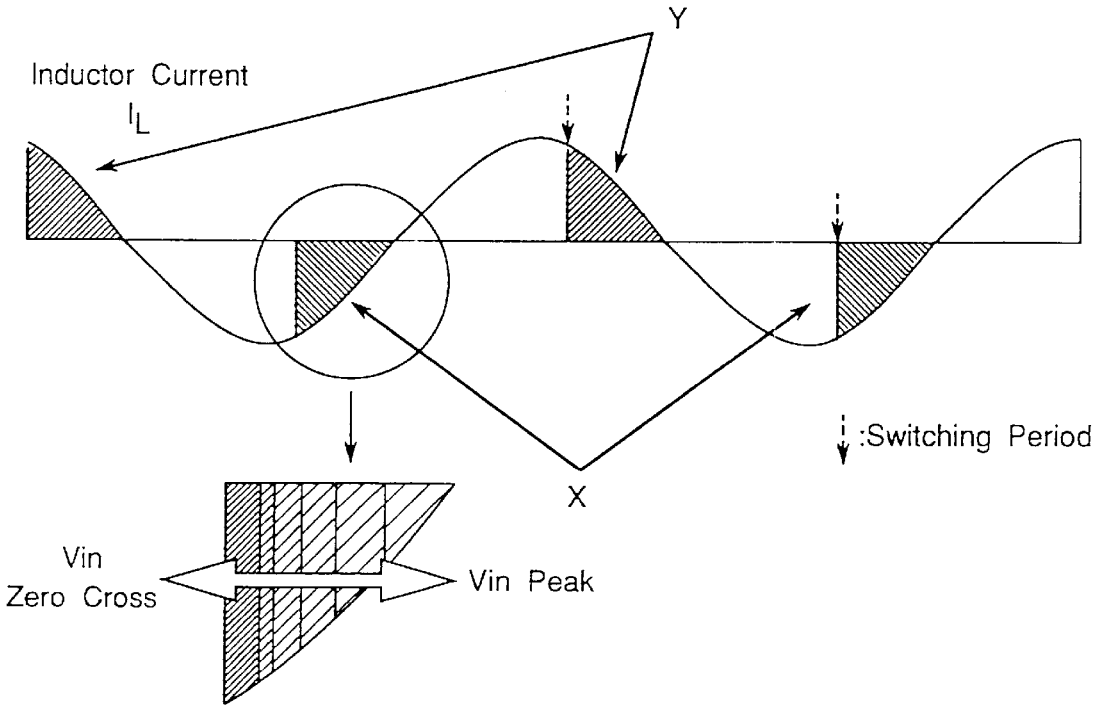
FIG. 28 is a diagram showing a relationship between the input current and the resonant current in the power source device shown in FIG. 27.

Hereinafter, various modes of operation of this circuit will be described. Mode 1;

Without the switching element Q2 being turned on after the switching element Q1 has been turned off (Hereinafter, the timing during which the switching elements Q1 and Q2 are turned off is referred to as a dead-off time.), a continuous current IL flowing through the resonant inductor (such current IL being hereinafter referred to as an inductor current) is allowed to flow through the charge capacitor Cin2. At this time, the charge capacitor Cin is charged by the AC power source AC through the rectifier element DB until the voltage across the charge capacitor Cin attains a value equal to the absolute value of the input voltage Vin (the voltage of the AC power source AC). The charge period during which the charge capacitor Cin is charged is indicated by X in FIG. 28 (It is to be noted that the period indicated by Y in FIG. 28 represents a period during which it will becomes a charging current to be charged on the smoothing capacitor Ce.). As shown in FIG. 28, the charging period expands (in a rightward direction as viewed in FIG. 28) in accordance with the input voltage Vin, the maximum of which is represented by the entire area.

Mode 2;

When the voltage across the charge capacitor Cin attains a value equal to the absolute value of the input voltage Vin, a stray diode of the switching element Q2 is turned on, with the circuit consequently operating in a manner similar to the standard half-bridge circuit.

Mode 3;

When while the switching element Q2 is turned on during the operation under Mode 2 described above, the direction of flow of the inductor current IL reverses to a positive direction, it flows through the switching element Q2.

Mode 4;

When the switching element Q2 is turned off, the continuous inductor current IL flowing through the resonant inductor Lr flows through the charge capacitor Cin2 without the switching element Q1 being turned on. At this iime, the charge capacitor Cin2 charges the smoothing capacitor Ce through the rectifier diode Di4 and, on the other hand, discharges until the voltage across the charge capacitor Cin2 attains a zero value.

Mode 5;

When the charge on the charge capacitor Cin2 is discharged and becomes zero, the stray diode of the switching element Q1 is turned on, with the circuit consequently operating in a manner similar to the standard half-bridge circuit.

Mode 6;

When while the switching element Q1 is turned on during the operation under Mode 5 above, the direction of flow of the inductor current IL reverses to a negative direction, it flows through the switching element Q1.

The above described Modes 1 to 6 are repeated. Thus, with this system, since a part of the current of the resonant circuit is used as the high frequency current source CS and alternate charge and discharge of the charge capacitor Cin2 is carried out through the AC power source AC and the smoothing capacitor Ce, this system can be considered one kind of CSCP as is the case with the Prior Art 2. In such case, since the period during which it becomes the input current or the charging current of the smoothing capacitor Ce is only a period during which under the standard half-bridge circuit operation the flywheel current flowing through the switching element Q1 and the stray diode of the switching element Q2 conducts, a relatively large resonant current as compared with that in the Prior Art 2, for example, the resonant current twice as large as that in the Prior Art 2, is needed to secure a sufficient input current.

In the fourth embodiment of the present invention, the circuit in which VSCP utilizing a high frequency voltage oscillation within the circuit is further added to the CSCP circuit shown in FIG. 27 will be described. It is to be noted that similar effects can be obtained even if CSCP described in connection with the Prior Art 2 is added to CSCP shown in FIG. 27. Some circuit examples of the power source device based on the above discussed ideal will now be described.

4-2. Circuit Structures:

4-2-1. Circuit Example 4a

Figure 29:
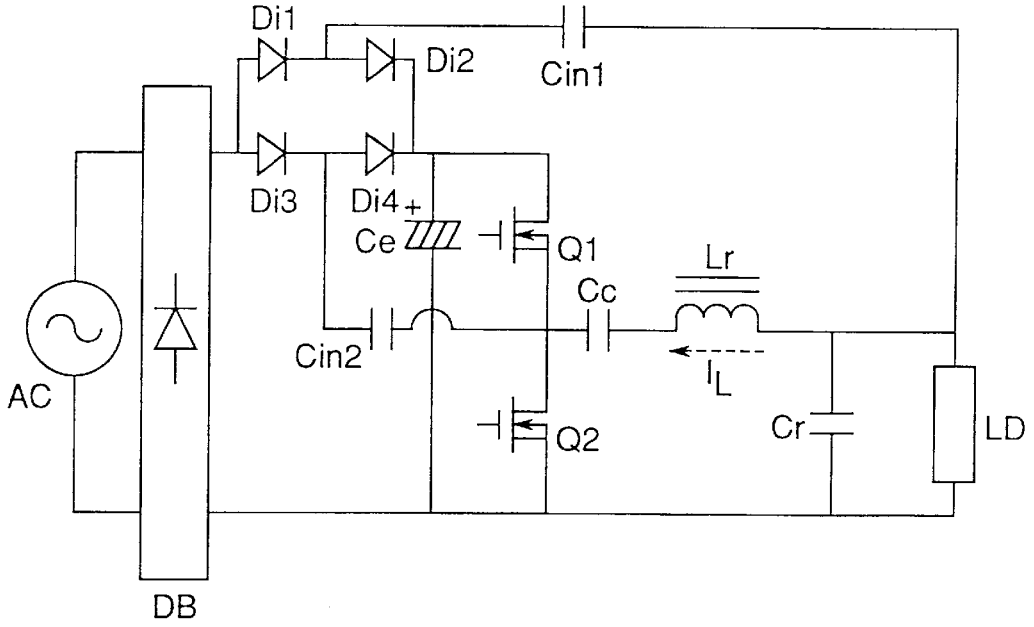
FIG. 29 is a circuit diagram showing the power source device according to a circuit example 4a of the present invention.

An electric circuit diagram of the power source device according to a first Circuit Example 4a is shown in FIG. 29. The circuit shown in FIG. 29 is substantially similar to the circuit shown in FIG. 27, except that a VSCP comprised of a circuit of diodes Di1 and Di2 connected parallel to a series circuit of diodes Di3 and Di4 and a charge capacitor Cin1 connected at one end with a junction between the diodes Di1 and Di2 and at the other end with a junction between the resonant inductor Lr and the resonant capacitor Cr are added to the circuit of FIG. 27.

Figure 30:
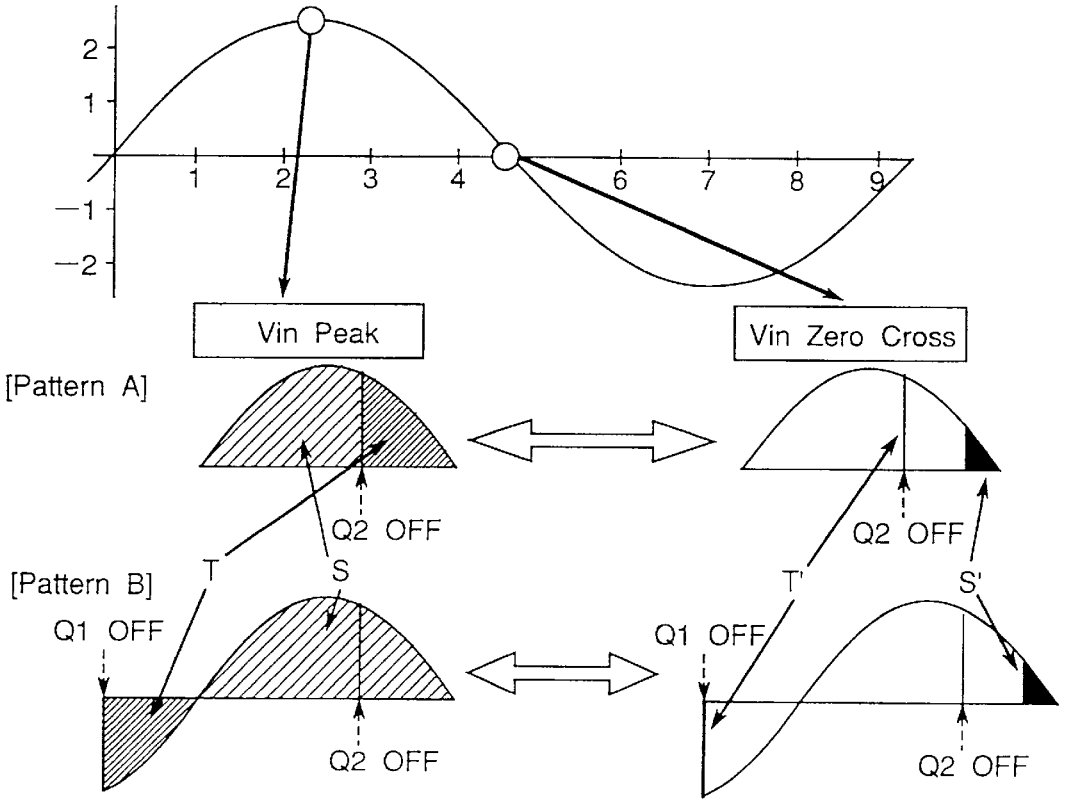
FIG. 30 is a diagram showing a relationship between the input current and the resonant current in the power source device according to any one of circuit examples 4a to 4h of the present invention.

In this circuit system, an inductor current IL participate in the input current as shown by "Pattern B" in FIG. 30. In FIG. 30, periods specified by T and T' represent a period during which the input current is captured in the circuit of FIG. 27, whereas periods specified by S and S' represent a period during which the input current is captured by VSCP or CSCP added according to the Circuit Example 4a of the present invention. Accordingly, the input current which attains a maximum value in the vicinity of a peak of the input voltage Vin can be drawn during a period larger than a half cycle of the high frequency inductor current.

Hereinafter, the operation that takes place at that time will be described for each mode:

Mode 1;

After the switching element Q1 has been turned off and during the dead-off time of the switching elements Q1 and Q2, the inductor current IL flows in a negative direction (It is to be noted that the direction of flow shown by the arrow in FIG. 29 is referred to as a positive direction.) while charging the charge capacitor Cin2 and, at the same time, flows into the load, the resonant capacitor Cr and the charge capacitor Cin1. The current flowing into the charge capacitor Cin1 causes the charge capacitor Cin1 to discharge and at the same time charges the smoothing capacitor.

Mode 2;

When the charge capacitor Cin2 is charged and subsequently attains a value equal to the absolute value of the input voltage, the stray diode of the switching element Q2 is turned on and the inductor current IL flows in the negative direction. During this time, the switching element Q2 is turned on. Also, as is the case with Mode 1 the inductor current IL flows into the load LD, the resonant capacitor Cr and the charge capacitor Cin1.

Mode 3;

When the resonant inductor current IL decreases and reverses to flow in the positive direction, the inductor current IL flows through the switching element Q2 and returns to the resonant inductor Lr only through the load LD and the resonant capacitor Cr. This condition is maintained until the voltage across the resonant capacitor Cr decreases and the potential at a high voltage side of the charge capacitor Cin1 (that is, the potential at a junction between the charge capacitor Cin1 and the rectifier diodes Di1 and Di2) attains a value equal to the absolute value of the input voltage.

Mode 4;

After the potential at the high voltage side of the charge capacitor Cin1 (that is, the potential at the junction between the charge capacitor Cin1 and the rectifier diodes Di1 and Di2) has attained a value equal to the absolute value of the input voltage, the inductor current IL flows in part through a path leading to the load LD and the resonant capacitor Cr through the switching element Q2 and in part through a path leading to the charge capacitor Cin1 from the input AC power source AC through the rectifier element DB to charge the charge capacitor Cin1.

Mode 5;

When the switching element Q2 is turned off, the inductor current IL flows so as to charge the smoothing capacitor Ce while causing the charge capacitor Cin2 to discharge. During this period the current flowing into the resonant inductor Lr flows from the load LD, the resonant capacitor Cr and the charge capacitor Cin1 as is the case with Mode 4.

Mode 6;

When the voltage across the charge capacitor Cin2 becomes zero, the stray diode of the switching element Q1 is turned on and the inductor current IL flows through this stray diode to charge the smoothing capacitor. During this time, the switching element Q1 is turned on.

Mode 7;

When the inductor current IL is reversed to flow in the negative direction, the inductor current IL flows from the smoothing capacitor Ce to a parallel circuit of the resonant capacitor Cr and the load LD through the switching element Q1 and the resonant inductor Lr. This condition is maintained until the voltage across the resonant capacitor Cr increases and the potential at the high voltage side of the charge capacitor Cin1 (that is, the potential at the junction between the charge capacitor Cin1 and the rectifier diodes Di1 and Di2) attains a value equal to the voltage across the smoothing capacitor Ce.

Mode 8;

When the potential at the high voltage side of the charge capacitor Cin1 (that is, the potential at the junction between the charge capacitor Cin1 and the rectifier diodes Di1 and Di2) attains a value equal to the voltage across the smoothing capacitor Ce, the inductor current IL flows in part through a path leading to the load LD and the resonant capacitor Cr and in part through a path leading to the smoothing capacitor Ce to charge the latter while causing the charge capacitor Cin1 to discharge. This condition is maintained until the switching element Q1 is turned off.

During the period in which the input voltage Vin from the AC power source AC is sufficiently low, there may occur a switching of the modes such a manner that Mode 5 takes place before Mode 4 and, subsequently, Mode 4 takes place during Mode 6, but as the input voltage Vin decreases, Modes 2, 3, 6 and 7 expand and Modes 1, 4, 5 and 8 contract. Since the input current flows during Modes 1, 4, 5 and 8, the input current decreases in proportion to the input voltage and the input power factor can be improved.

Since as compared with the circuit of FIG. 27 a conducting period of the input current during one cycle of the inductor current IL increases drastically, not only can increase of the inductor current be suppressed, but downscaling of an input filter section and both downscaling and suppression of the breakdown strength of the various circuit component parts can be attained, making it possible to provide the inexpensive power source device. Also, by combining the resonant circuits for the various modes, the capacitance of the resonant capacitor Cr can be minimized to thereby reduce the low frequency ripple appearing in the output.

4-2-2. Circuit Example 4b

Figure 31:
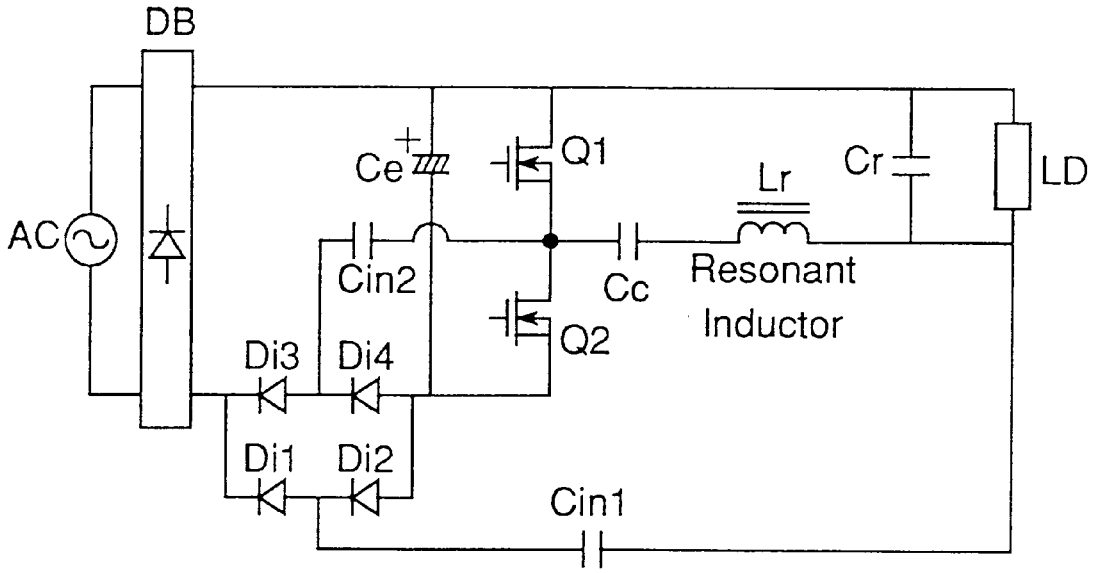
FIGS. 31 to 37 are circuit diagrams showing the power source device according to the circuit examples 4b to 4h, respectively, of the present invention.

A circuit diagram of the power source device according to a second Circuit Example 4b is shown in FIG. 31. The circuit shown in FIG. 31 is substantially similar to that shown in FIG. 29, except that a circuit structure including the component parts other than the switching element Q1 and Q2 and the smoothing capacitor Ce, disposed on a high voltage side of the smoothing capacitor Ce in the circuit of FIG. 29, is symmetrically disposed on a ground side of the smoothing capacitor Ce with respect to a junction between the switching elements Q1 and Q2.

4-2-3. Circuit Example 4c

Figure 32:
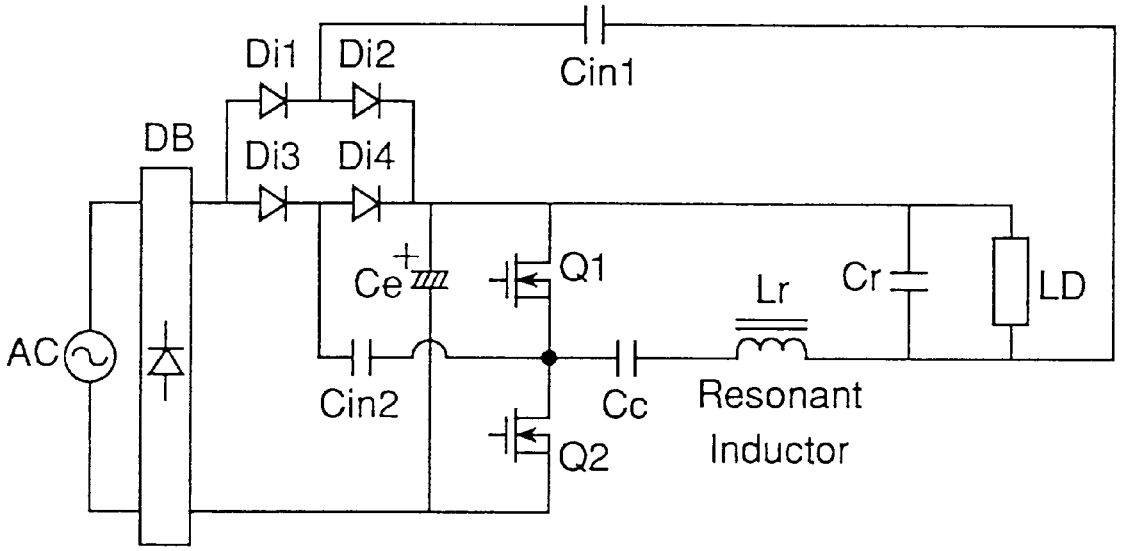

A circuit diagram of the power source device according to a third Circuit Example 4c is shown in FIG. 32. The circuit shown in FIG. 32 is substantially similar to that shown in FIG. 29, except that the resonant capacitor Cr and the load LD, which have been connected on the ground side (the low voltage side) in the circuit shown in FIG. 29, are connected on a high voltage side of the smoothing capacitor Ce.

4-2-4. Circuit Example 4d

Figure 33:
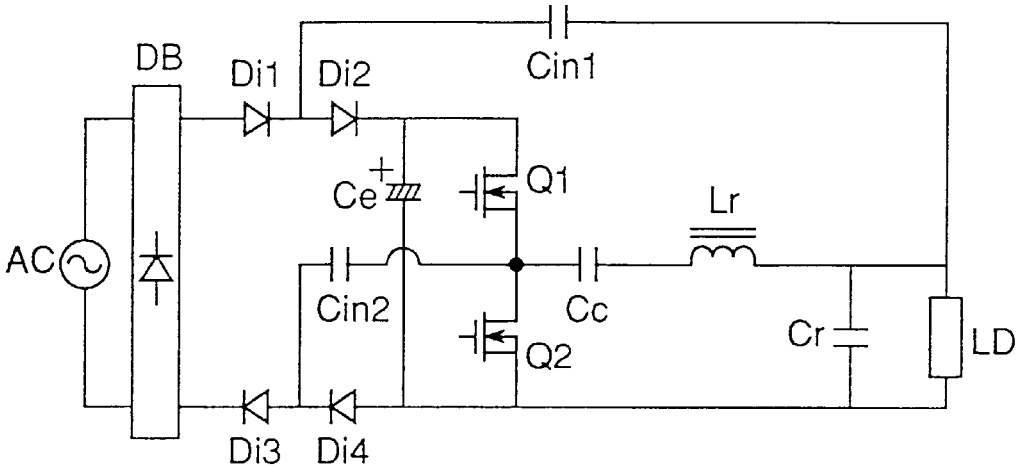

A circuit diagram of the power source device according to a fourth Circuit Example 4d is shown in FIG. 33. The circuit shown in FIG. 33 is substantially similar to that shown in FIG. 29, except that the diodes Di3 and Di4 and the charge capacitor Cin2 are connected in respective manners different from those in the circuit of FIG. 29.

Where the circuit is constructed as shown in FIG. 33, a portion of the single cycle of the inductor current IL undergoing a high frequency oscillation, which participates in the input current, is such as shown by "Pattern A" in FIG. 30.

In other words, the input current can be captured in such a manner that when the absolute value of the power source voltage Vin becomes small, the input current flows through the charge capacitor Cin2 immediately after the switching element Q2 has been turned off, and when the voltage of the resonant capacitor Cr subsequently becomes low, the input current flows through the charge capacitor Cin1. In this way, since a phase difference is created in the input current so captured by the effect of the charge and discharge of the charge capacitors Cin1 and Cin2, the input current can be captured efficiently.

4-2-5. Circuit Example 4e

Figure 34:
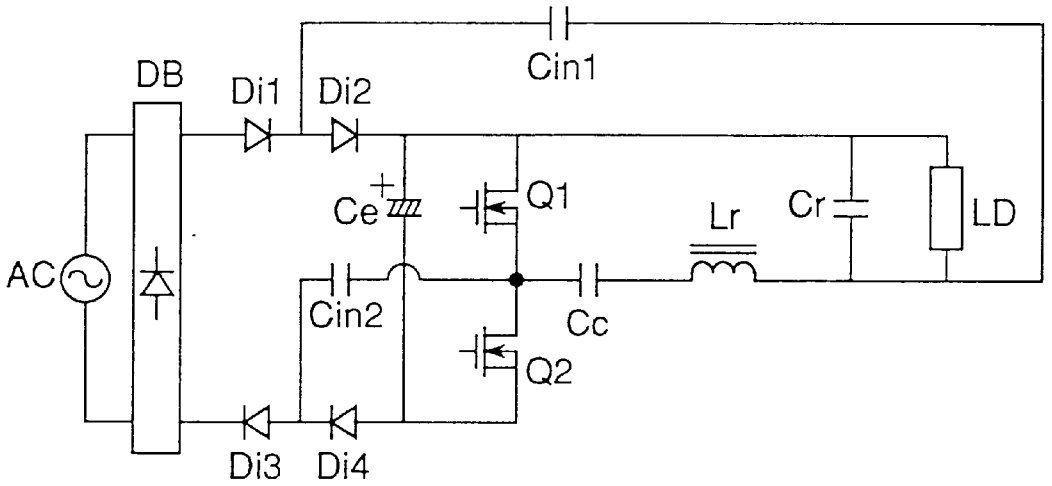

A circuit diagram of the power source device according to a fifth Circuit Example 4e is shown in FIG. 34. The circuit shown in FIG. 34 is substantially similar to that shown in FIG. 33, except that the resonant capacitor Cr and the load LD, both connected with the ground side (the low voltage side) of the smoothing capacitor Ce in the circuit of FIG. 33, are connected with the high voltage side of the smoothing capacitor Ce.

4-2-6. Circuit Example 4f

Figure 35:
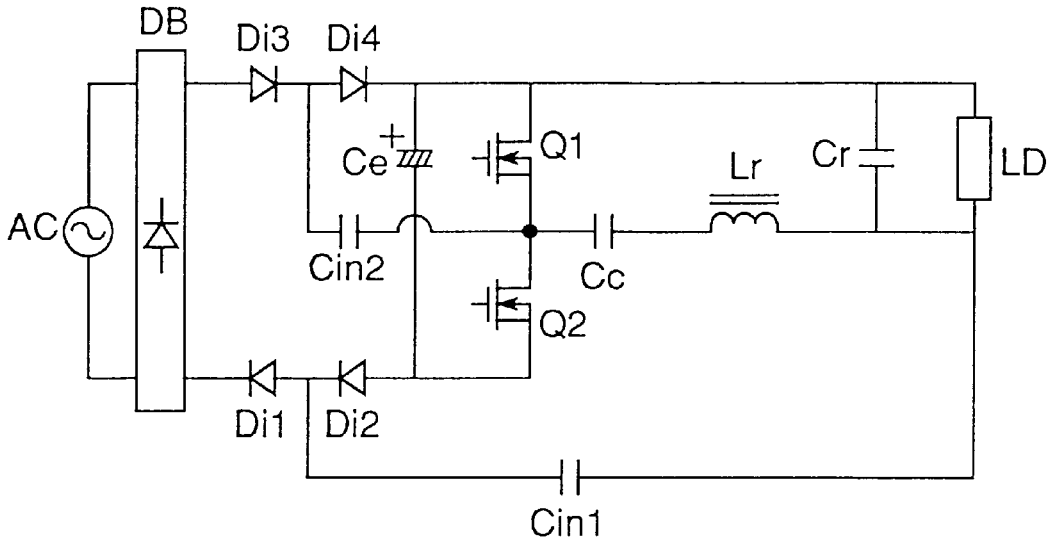

A circuit diagram of the power source device according to a sixth Circuit Example 4f is shown in FIG. 35. The circuit shown in FIG. 35 is a modification of the circuit shown in FIG. 33 and can function in a manner substantially similar to, and brings about effects similar to, those brought about the circuit of FIG. 33.

4-2-7. Circuit Example 4g

Figure 36:
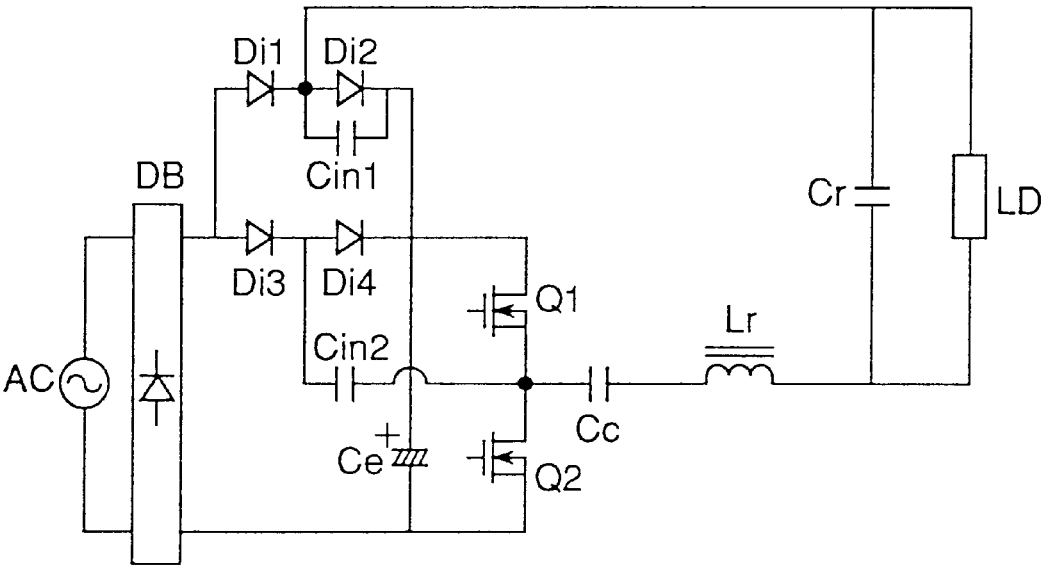

A circuit diagram of the power source device according to a seventh Circuit Example 4g is shown in FIG. 36, which is substantially similar to the circuit according to the Prior Art 2 discussed hereinbefore, except that CSCP including the diodes Di3 and Di4 and the charge capacitor Cin2 shown in FIG. 27 is added in the circuit of FIG. 36. In the case of the circuit according to the Circuit Example 4g, the inductor current IL such as shown by "Pattern B" in FIG. 30 participates in the input current. Accordingly, the input current which attains a maximum value in the vicinity of a peak of the input voltage Vin can be drawn during a period larger than a half cycle of the high frequency inductor current. Hereinafter the operation of the circuit according to the Circuit Example 4g will be described for each mode.

Mode 1;

After the switching element Q1 has been turned off and during the dead-off time of the switching elements Q1 and Q2, the inductor current IL flows in a negative direction (It is to be noted that the direction of flow from the resonant capacitor Cr towards the resonant inductor Lr in FIG. 36 is referred to as a positive direction.) while charging the charge capacitor Cin2 and, at the same time, flows into the load LD and the resonant capacitor Cr. The current flowing into the load LD and the resonant capacitor Cr flows through the rectifier diode Di2, connected parallel to the charge capacitor Cin1 to charge the smoothing capacitor Ce and also to charge the charge capacitor Cin2 through the AC power source AC.

Mode 2;

When the charge capacitor Cin2 is charged and subsequently attains a value equal to the absolute value of the input voltage, the stray diode of the switching element Q2 is turned on and the inductor current IL flows in the negative direction. During this time, the switching element Q2 is turned on. Also, as is the case with Mode 1 the inductor current IL flows into the load LD, the resonant capacitor Cr and the rectifier diode Di2, connected parallel to the charge capacitor Cin1, to thereby charge the smoothing capacitor and then returns to the resonant inductor Lr through the stray diode of the switching element Q2.

Mode 3;

When the inductor current IL decreases and reverses to flow in the positive direction, the inductor current IL flows through the switching element Q2 and returns to the resonant inductor Lr through the load LD, the resonant capacitor Cr and the charge capacitor Cin1. This condition is maintained until the voltage across the charge capacitor Cin1 increases and the potential at a low voltage side of the charge capacitor Cin1 (that is, the potential at a junction between the charge capacitor Cin1, the resonant capacitor Cr and the load LD) attains a value equal to the absolute value of the input voltage Vin.

Mode 4;

After the potential at the low voltage side of the charge capacitor Cin1 (that is, the potential at the junction between the charge capacitor Cin1, the resonant capacitor Cr and the load LD) has attained a value equal to the absolute value of the input voltage, the input current is drawn from the AC power source AC and the inductor current IL flows through the rectifier element DB and a parallel circuit of the load LD and the resonant capacitor Cr and then flow into the AC power source AC through the switching element Q2 and then through the rectifier element DB.

Mode 5;

When the switching element Q2 is turned off, the inductor current IL charges the smoothing capacitor while causing the charge capacitor Cin2 to discharge and then return to the resonant inductor Lr from a high voltage (positive) output end of the rectifier element DB as an input current through the rectifier element DB and the AC power source AC by way of the rectifier diode Di1 and the parallel circuit of the load LD and the resonant capacitor Cr.

Mode 6;

When the voltage across the charge capacitor Cin2 becomes zero, the stray diode of the switching element Q1 is turned on and the inductor current IL, which has flowed as an input current from the AC power source AC from the high voltage side of the rectifier element DB by way of the rectifier diode Di1 and the parallel circuit of the load LD and the resonant capacitor Cr, flows so as to cause the smoothing capacitor Ce to be charged through the stray diode of the switching element Q1. During this time, the switching element Q1 is turned on.

Mode 7;

When the inductor current IL is reversed to flow in the negative direction, the inductor current IL flows to the resonant capacitor Cr and the load LD through the switching element Q1 and the resonant inductor Lr. The inductor current IL so flowing causes the charge capacitor Cin1 to discharge and then returns to the switching element Q1 and the resonant inductor Lr. This condition is maintained until the voltage on the charge capacitor Cin1 is completely discharged.

Mode 8;

When the voltage on the charge capacitor Cin1 is completely discharged, the inductor current IL, after having flowed through the load LD and the resonant capacitor Cr, returns to the inductor Lr through the rectifier diode Di2, connected parallel to the charge capacitor Cin1, and the switching element Q1.

During the period in which the input voltage Vin is sufficiently low, there may occur a switching of the modes such a manner that Mode 5 takes place before Mode 4 and, subsequently, Mode 4 takes place during Mode 6, but as the input voltage Vin decreases, Modes 2, 3, 6 and 7 expand and Modes 1, 4, 5 and 8 contract. Since the input current flows during Modes 1, 4, 5 and 8, the input current decreases in proportion to the input voltage and the input power factor can be improved.

Since the period of conduction of the input current can thus be prolonged as is the case with the circuit operation according to the Circuit Example 4a and as compared with that in the power source device disclosed in the U.S. Pat. No. 5,488,269 or the Prior Art 2 discussed hereinbefore, not only can increase of the inductor current be suppressed, but downscaling of an input filter section and both downscaling and suppression of the breakdown strength of the various circuit component parts can be attained, making it possible to provide the inexpensive power source device. Also, by combining the resonant circuits for the various modes, the capacitance of the resonant capacitor Cr can be minimized to thereby reduce the low frequency ripple appearing in the output.

4-2-8. Circuit Example 4h

Figure 37:
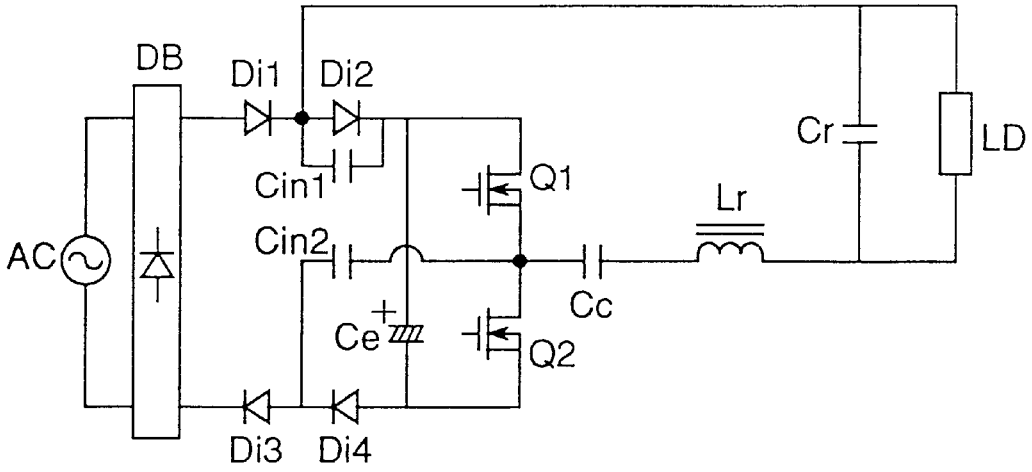

A circuit diagram of the power source device according to a eighth Circuit Example 4h is shown in FIG. 37. The circuit shown therein is substantially similar to the circuit of FIG. 36, except that CSCP including the diodes Di3 and Di4 and the charge capacitor Cin2 shown in FIG. 36 is connected with a low voltage side of the rectifier element DB. In the case of the circuit of FIG. 37, a portion of the high frequency resonant current IL which participates in the input current is represented by "Pattern A" in FIG. 30. Even in this case, since the phase difference occurs in the input current drawn by alternate charge and discharge of the charge capacitors CinI and Cin2, the input current can be drawn efficiently.

4-3. Effects

The power source device according to any one of the Circuit Examples of the fourth preferred embodiment of the present invention is such that the power source device having the CSCP function disclosed in the U.S. Pat. No. 5,488,269 is modified to have VSCP which utilizes the high frequency voltage oscillation in the circuit, or to have another CSCP which utilizes the high frequency current oscillation in the circuit, in combination with the conventional CSCP, so that the period during which the input current Iin can be pumped up from the AC power source AC during each switching cycle can be prolonged. Accordingly, the breakdown strength of the various component parts such as the switching element, the inductor and the capacitors can be reduced, making it possible to provide the inexpensive and compact power source device having the PFC function.

5. Fifth Embodiment 5-1. Summary

Figure 38:
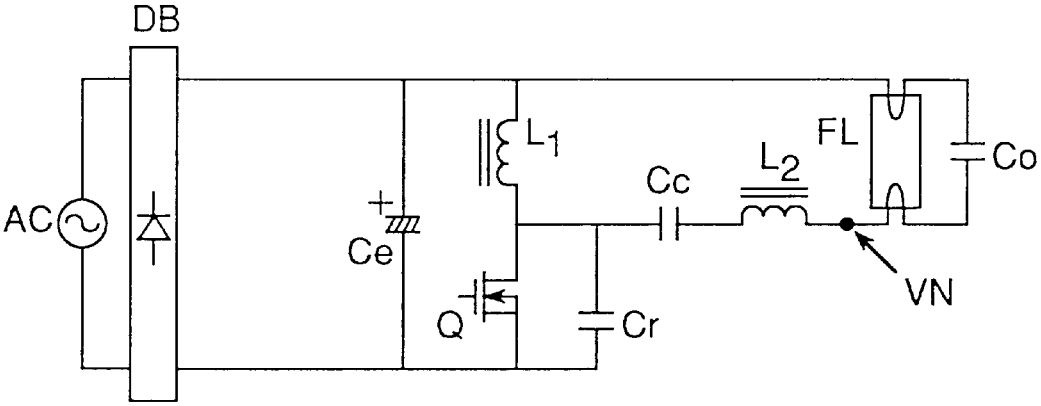
FIG. 38 is a circuit diagram showing one example of a one-transistor type voltage resonant inverter.

An example of a single-transistor, voltage oscillating inverter is shown in FIG. 38. In this single-transistor, voltage oscillating inverter, an output from the AC power source AC is full-wave rectified by the rectifier element DB and is subsequently smoothed by the smoothing capacitor Ce to provide a DC current. Accordingly, a high frequency voltage is generated across an inductor L1 by the operation of the inductor L1 and the resonant capacitor Cr. This is resonated with the use of a series connected resonant circuit including a capacitor Cc and an inductor L2 to provide a fluorescent tube FL, which is a load, with a high frequency power. A capacitor Co is inserted for the purpose of preheating electrodes of the fluorescent tube FL. Such a single-transistor inverter is well known and is available in numerous types.

Even in this circuit, a junction VN between the inductor L2 and the fluorescent tube FL can be considered a high frequency voltage source VS when viewed from the smoothing capacitor Ce or the AC power source AC, and a current flow path including the capacitor Cc, the inductor L2 and the fluorescent tube FL can be considered a high frequency current source CS since the high frequency current flows therethrough.

Accordingly, by utilizing the voltage and current sources VS and CS, VSCP and CSCP can be constructed as hereinbefore described, respectively. Circuit examples of the single-transistor, voltage oscillating inverter to which the basic idea of the first embodiment of the present invention is applied will now be described.

5-2. Circuit Structures 5-2-1. Circuit Example 5a

Figure 39:
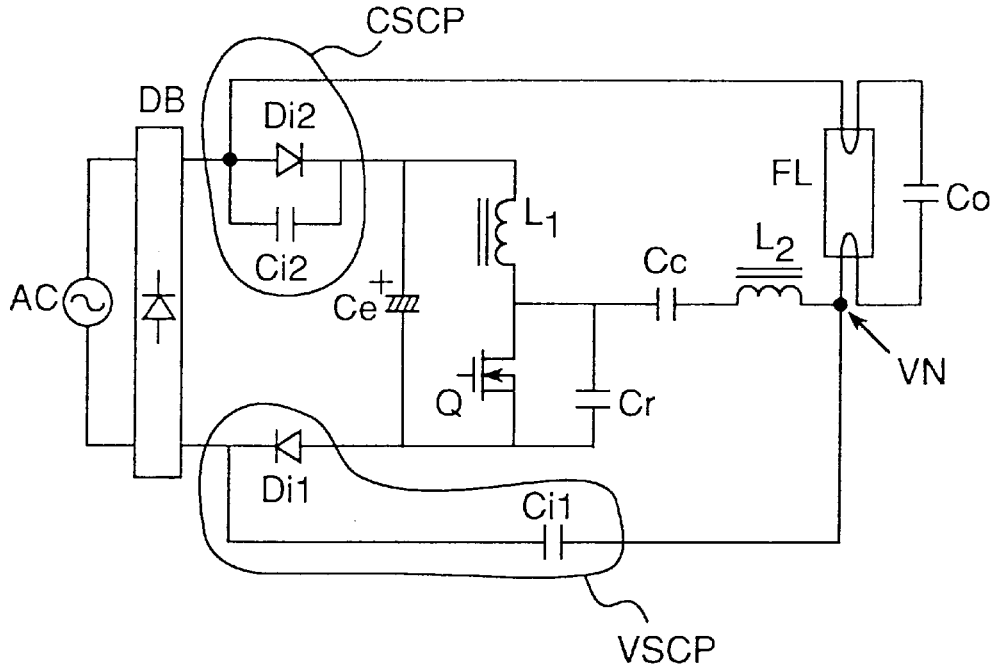
FIGS. 39 and 40 are circuit diagram showing the power source device according to respective circuit examples 5a and 5b of the present invention.

A circuit diagram of the power source device according to this circuit example is shown in FIG. 39. The circuit shown in FIG. 39 is substantially similar to that shown in FIG. 38, except that in the circuit of FIG. 38 CSCP including a parallel circuit of a diode Di2 and a charge capacitor Ci2 and VSCP including a diode Di1 and a charge capacitor Ci1 are added. In this circuit, a current loop of a resonant current Ires flowing through the fluorescent tube FL is used as a current source CS; CSCP is constituted by the diode Di2 and the charge capacitor Ci2; the junction (node) VN between the inductor L2 and the fluorescent tube FL is used as a voltage source VS; and VSCP is constituted by the charge capacitor Ci1 and the diode Di1.

Since even the circuit of FIG. 39 makes use of both of the voltage and current sources VS and CS within the same resonant circuit, the phase difference occurs and the period during which VSCP and CSCP capture the input current fin from the AC power source AC through the rectifier element DB can expand. Accordingly, the breakdown strength of the various component parts used therein can be reduced and PFC can be accomplished.

5-2-2. Circuit Example 5b

Figure 40:
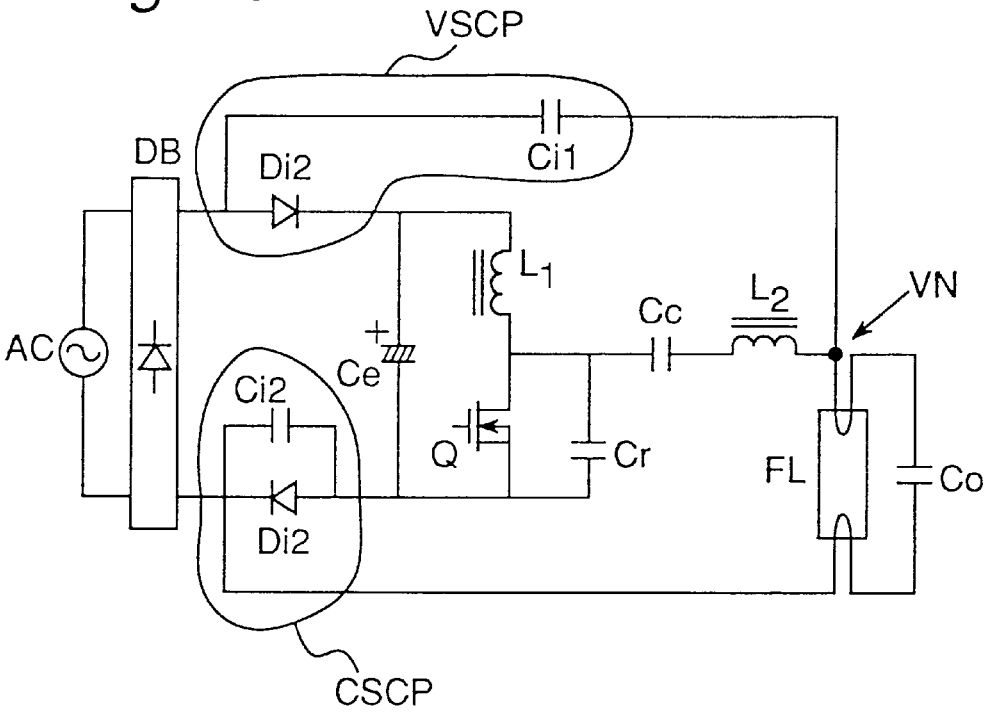

A circuit diagram of the power source device according to this circuit example is shown in FIG. 40. The circuit shown in FIG. 40 is substantially similar to that shown in FIG. 39, except that VSCP and CSCP are connected with opposite polarities of the rectifier element DB in a manner reverse to that shown in FIG. 39.

5-3. Effects

By providing the single-transistor inverter with CSCP and VSCP, the period during which the input current can be pumped up from the AC power source AC during each switching cycle can be expanded, the breakdown strength of the various component parts such as the switching element, the inductor and the capacitors can be reduced, making it possible to provide the inexpensive and compact power source device having the PFC function.

6. Sixth Embodiment 6-1. Summary

The power source device according to a sixth embodiment of the present invention is so designed and so configured that, while appropriate high frequency voltage and current oscillations generated in the circuit as a result of a high speed switching are taken as voltage and current sources VS and CS, respectively, a minimum number of component parts are added to accomplish VSCP and CSCP simultaneously. Accordingly, even in this power source device, by the utilization of the phase difference between VS and CS, the period during which the input current tin can be captured from the AC power source AC through the rectifier element DB is expanded to make it possible to reduce the breakdown strength of the various component parts used therein. Accordingly, a circuit system which provides the basis therefor is not limited.

Figure 41:
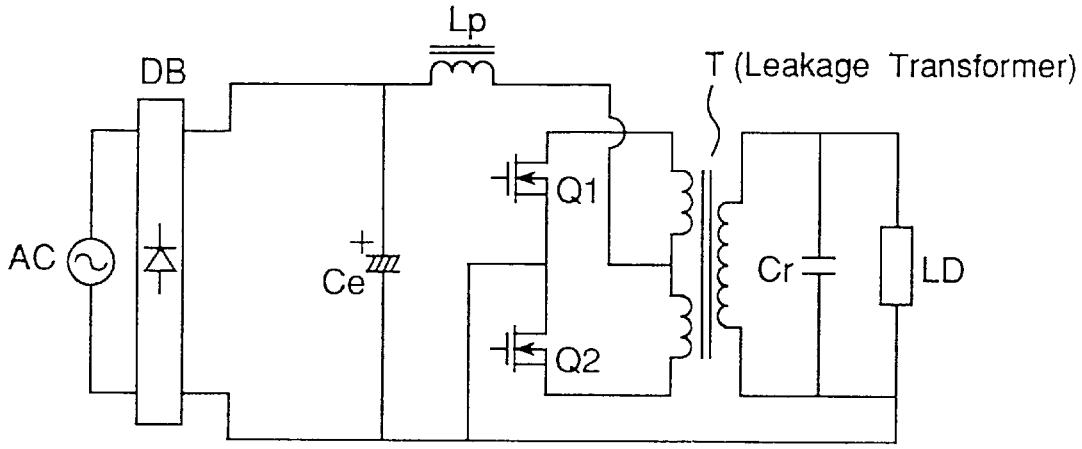
FIG. 41 is a circuit diagram showing one example of an L push-pull type inverter.
Figure 45:
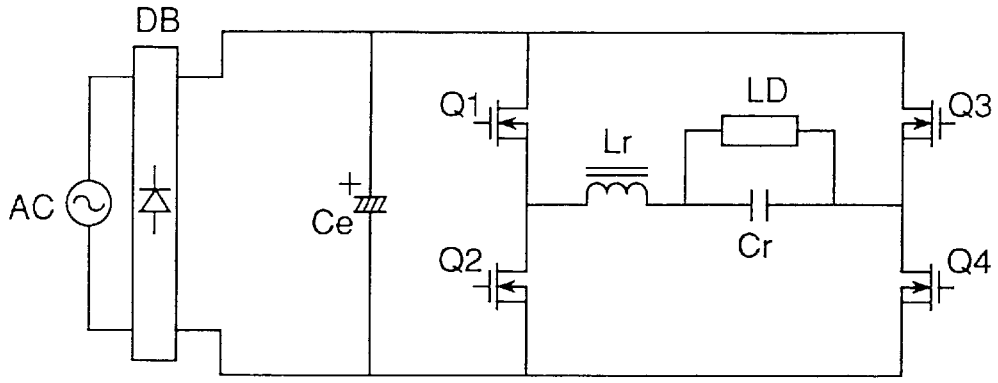
FIG. 45 is a circuit diagram showing one example of a full bridge type inverter.

By way of example, even in an inverter of an L push-pull type as shown in FIG. 41 or a full bridge type as shown in FIG. 45, addition of the above described VSCP and CSCP makes it possible to provide the inexpensive and compact power source device having the PFC function. Some of circuit examples of the power source device according to the sixth embodiment of the present invention will now be described.

6-2. Circuit Structures 6-2-1. Circuit Example 6a

Figure 42:
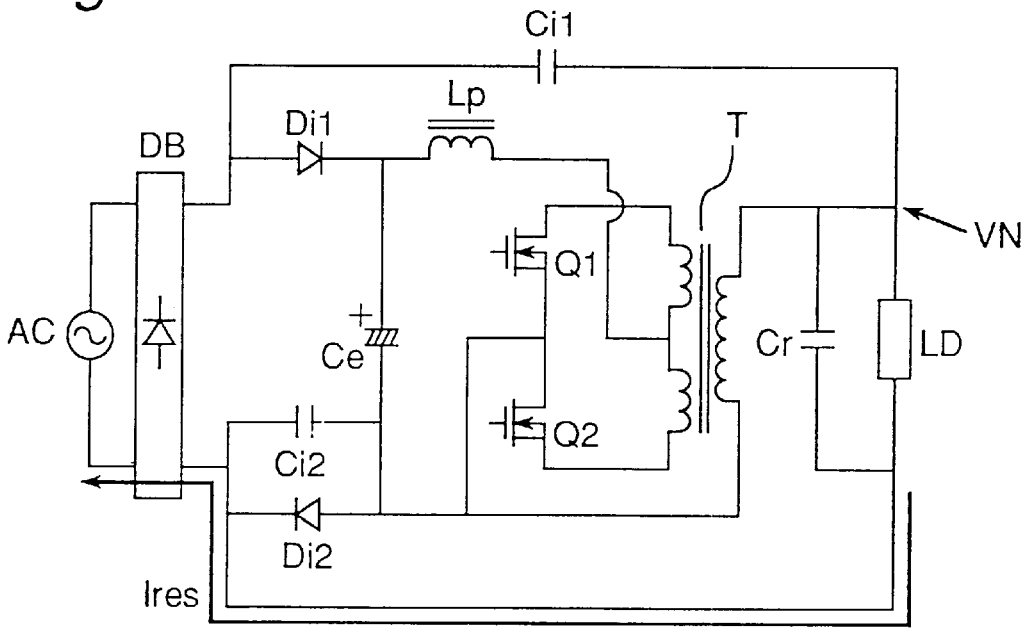
FIGS. 42 to 44 are circuit diagrams showing the power source device according respective circuit examples 6a to 6c of the present invention.

A circuit diagram according to this example is shown in FIG. 42. The circuit shown in FIG. 42 corresponds to the inverter of the L push-pull type to which the concept of the present invention is applied, and performs the VSCP and CSCP functions by the utilization of the high frequency voltage and current oscillations generated in the inverter of the L push-pull type. In the practice of this circuit example, such a circuit as shown in FIG. 41 is used as the inverter circuit of the L push-pull type. In other words, in accordance with this example, the circuit shown in FIG. 41 is added with a diode Di1 connected between the high voltage output end of the rectifier element DB and one end of the smoothing capacitor, and a charge capacitor Ci1 connected at one end with a junction between the diode Di1 and the rectifier element DB and at the other end with a high voltage side of the resonant capacitor Cr, and also with a diode Di2 connected between the low voltage output end of the rectifier element DB and the other end of the smoothing capacitor and a charge capacitor Ci2 connected parallel to the diode Di12.

The current source CS is represented by a current loop including an output transformer T and a parallel circuit of the resonant capacitor Cr and the load LD and the diode Di12 and the charge capacitor Ci2 altogether constitute CSCP. The node VN is used as the voltage source VS since the high frequency voltage oscillation takes place at such node, and the diode Di1 and the charge capacitor Ci1 altogether constitute VSCP. Since the resonant capacitor Cr is connected with a secondary side of the output transformer T, there is a phase difference between VSCP and CSCP and, therefore, effects similar to those described hereinabove can be obtained.

6-2-2. Circuit Example 6b

Figure 43:
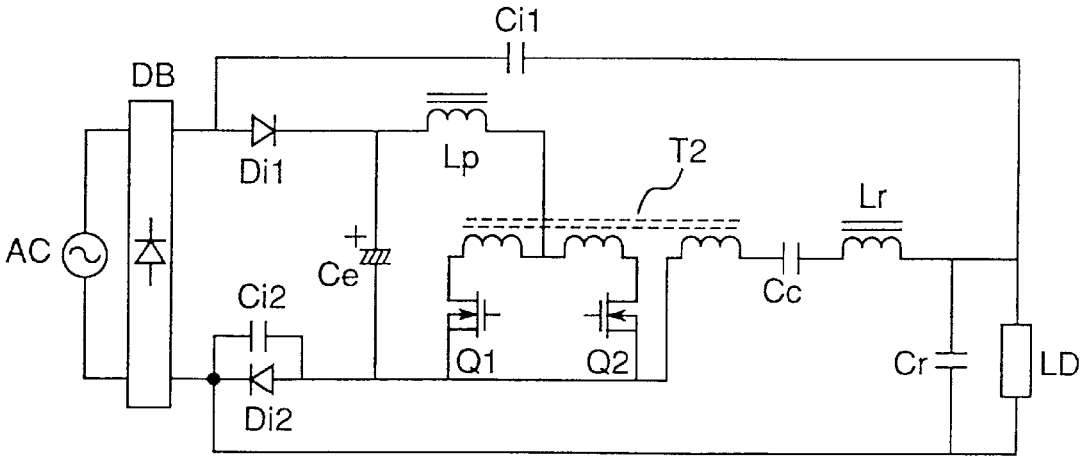

Another application to the inverter of the L push-pull type is shown in FIG. 43. According to this example, the resonant circuit on the secondary side of the output transformer in the inverter circuit shown in FIG. 42 is modified. Even in this example, VSCP including the charge capacitor Ci1 and the diode Di1 and CSCP including the charge capacitor Ci2 and the diode Di2 function in respective manners similar to those employed in the Circuit Example b and can therefore bring about similar effects.

6-2-3. Circuit Example 6c

Figure 44:
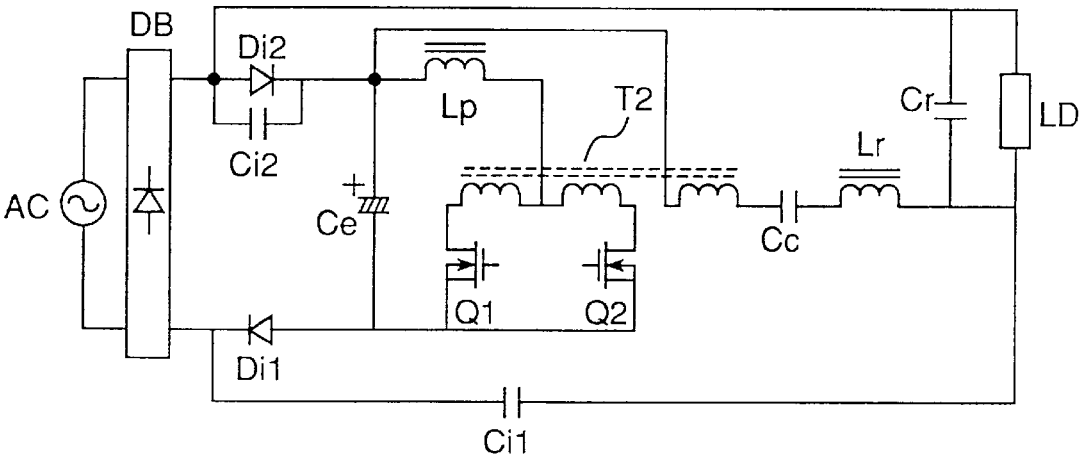

A further application to the inverter of the L push-pull type is also shown in FIG. 44. According to this example, the polarities of the rectifier elements to which VSCP and CSCP are connected are reversed to those in the Circuit Example 6b.

6-2-4. Circuit Example 6d

Figure 46:
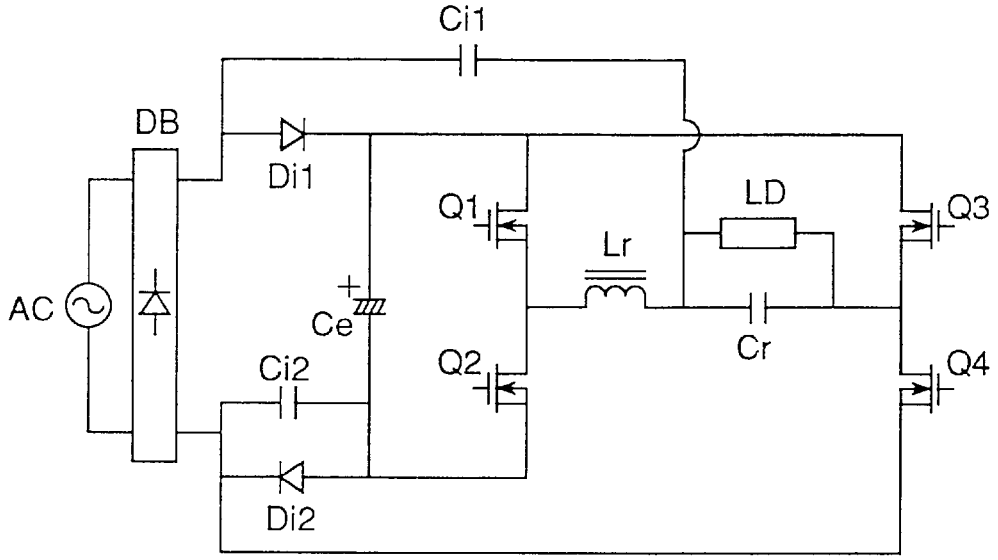
FIGS. 46 to 48 are circuit diagrams showing the power source device according to respective circuit examples 6d to 6f of the present invention.

A circuit diagram of the power source device according to this example is shown in FIG. 46. In the practice of this circuit example, the circuit shown in FIG. 45 is added with a charge capacitor Ci1 and a diode Di1, both forming VSCP, and a charge capacitor Ci2 and a diode Di2 both forming CSCP, as shown in FIG. 46. In this circuit example, the VSCP and CSCP functions are performed by the utilization of the voltage oscillation at the junction between the resonant inductor Lr and the resonant capacitor Cr and the current flowing through a switching element Q4, respectively. Although the CSCP function is carried out by the current flowing in a part of the resonant circuit comprised of the resonant inductor Lr and the resonant capacitor Cr, the efficiency with which the input current can be captured from the AC power source AC can be increased by the combination of it with VSCP.

6-2-5. Circuit Example 6e

Figure 47:
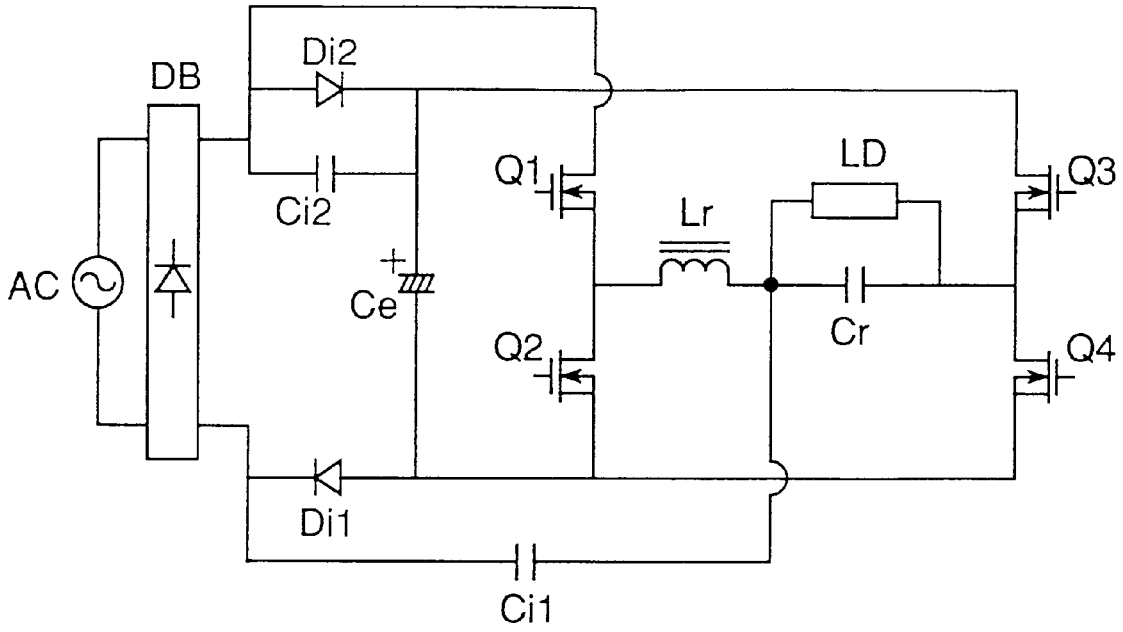

A circuit diagram of the power source device according to this example is shown in FIG. 47. The circuit shown therein is substantially similar to that shown in FIG. 46, except that the polarities of the rectifier element DB to which VSCP and CSCP are connected respectively are reversed to those shown in FIG. 46 and also except that connection is made to accomplish the CSCP function by the utilization of the current flowing through the switching element Q1. Thus, of the plural voltage and current sources VS and CS found in the inverter of the full bridge type, the use is possible by selecting appropriate voltage and current sources VS and CS.

6-2-6. Circuit Example 6f

Figure 48:
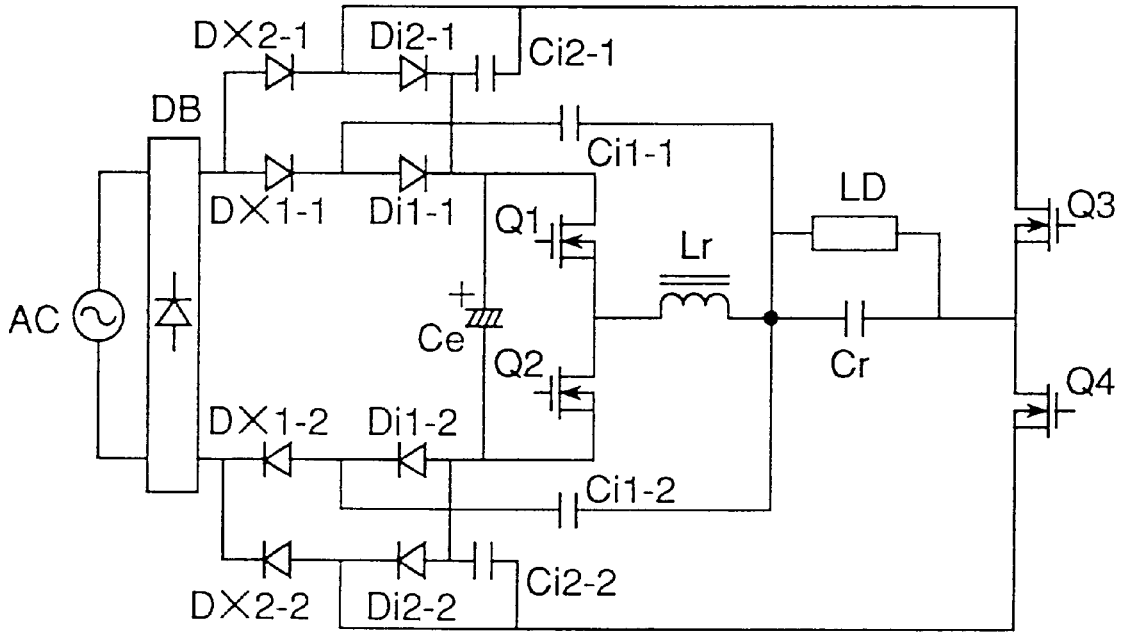

A circuit diagram of the power source device according to this example is shown in FIG. 48. The circuit shown therein is such that VSCP and CSCP are disposed so as to assume a symmetrical relation with each other on high and low voltage sides of the rectifier element DB, respectively. Although in any one of the Circuit Examples 6d and 6f, a portion of the resonant current has been utilized to perform the CSCP function, addition of VSCP and CSCP to both of positive and negative ends of the rectifier element DB such as in this Circuit Example warrants the symmetry of the circuit, if completely symmetrical as viewed from the smoothing capacitor Ce such as in the circuit of the full bridge type, and also brings about a favorable effect.

6-3. Effects

With the power source device according to this sixth embodiment of the present invention, regardless of the type of the inverter circuit, the period during which the input current can be pumped up from the AC power source AC during each switching cycle can be expanded, the breakdown strength of the various component parts such as the switching element, the inductor and the capacitors can be reduced, making it possible to provide the inexpensive and compact power source device having the PFC function.

7. Seventh Embodiment 7-1. Summary

Figure 49:
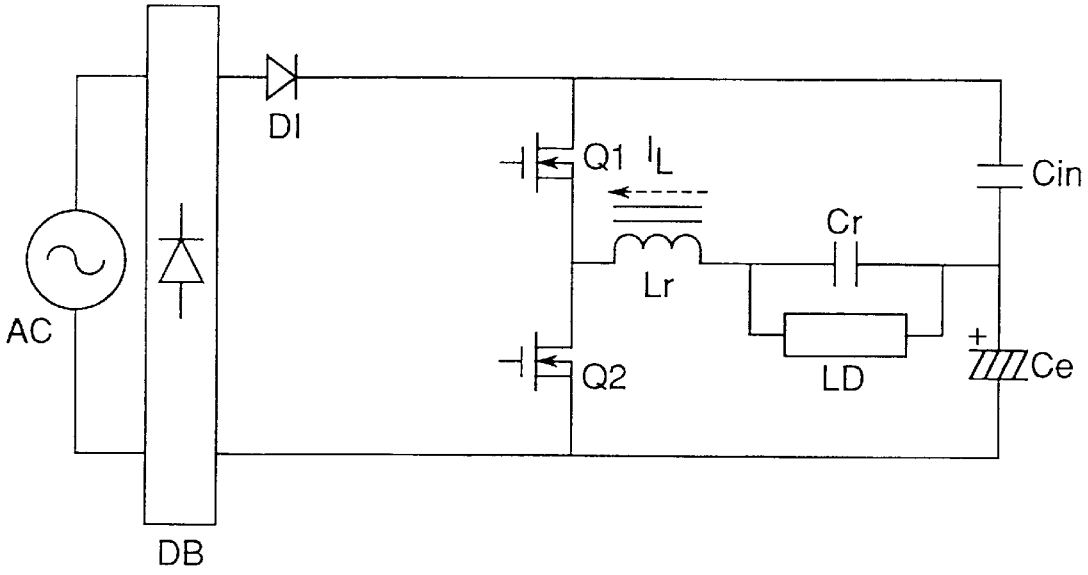
FIG. 49 is a circuit diagram showing the power source device of the CSCP system disclosed in the Japanese Laid-open Patent Publication No. 2-75200.

A modified version of the CSCP circuit described in connection with the Prior Art 2 is disclosed in the Japanese Laid-open Patent Publication No. 2-75200 and shown in FIG. 49. Referring to FIG. 49, the power source device comprises an AC power source AC, a rectifier element DB, a rectifier diode D1, switching elements Q1 and Q2, a charge capacitor Cin, a smoothing capacitor Ce, a resonant inductor Lr, a resonant capacitor Cr and a load LD. The rectifier element DB receives an output from the AC power source AC; the rectifier diode D1 and the switching elements Q1 and Q2 are connected between output ends of the rectifier element DB; a series circuit of the charge and smoothing capacitors Cin and Ce is connected parallel to a series circuit of the switching elements Q1 and Q2; a resonant circuit including the resonant inductor Lr and the resonant capacitor Cr is connected between a junction of the switching element Q1 with the switching element Q2 and a junction of the charge capacitor Cin with the smoothing capacitor Ce; and the load LD is connected parallel to the resonant capacitor Cr.

Figure 50:
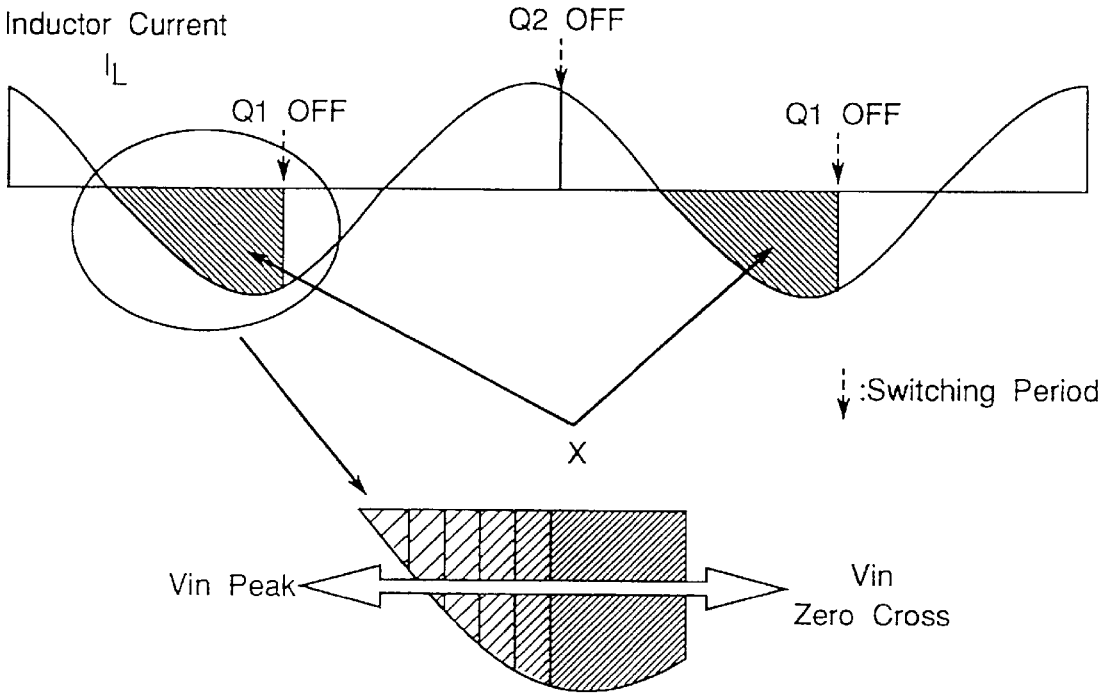
FIG. 50 is a diagram showing a relation between the input current and the resonant current in the power source device shown in FIG. 49.

In the case of this circuit system, when the high voltage side of the charge capacitor Cin attains a value equal to the absolute value of the input voltage, the inductor current IL flows from the AC power source AC directly to a load resonating circuit LD through the switching element Q1 and a portion of the inductor current IL oriented in a negative direction (It is to be noted that the direction shown by the arrow in FIG. 49 represents a positive direction.) as shown in FIG. 50 becomes an input current (as shown by an hatched area X in FIG. 50).

According to this system, a portion of the current of the resonant circuit is used as a high frequency current source and the potential difference brought about by the alternate charge and discharge of the charge capacitor Cin is utilized to make it possible to use the inductor current IL as the input current. Accordingly, the circuit discussed above can be considered as one of the CSCP systems as is the case with the Prior Art 2. In such case, the period during which the input current and the current to be charged on the smoothing capacitor Ce are available is represented by the period during which during the operation of the standard half bridge circuit the switching element Q1 conducts in the positive direction and, therefore, in order to secure the sufficient input current, a relatively high inductor current as compared with that in the Prior Art 2 is needed.

7-2. Circuit Structures 7-2-1. Circuit Example 7a

Figure 51:
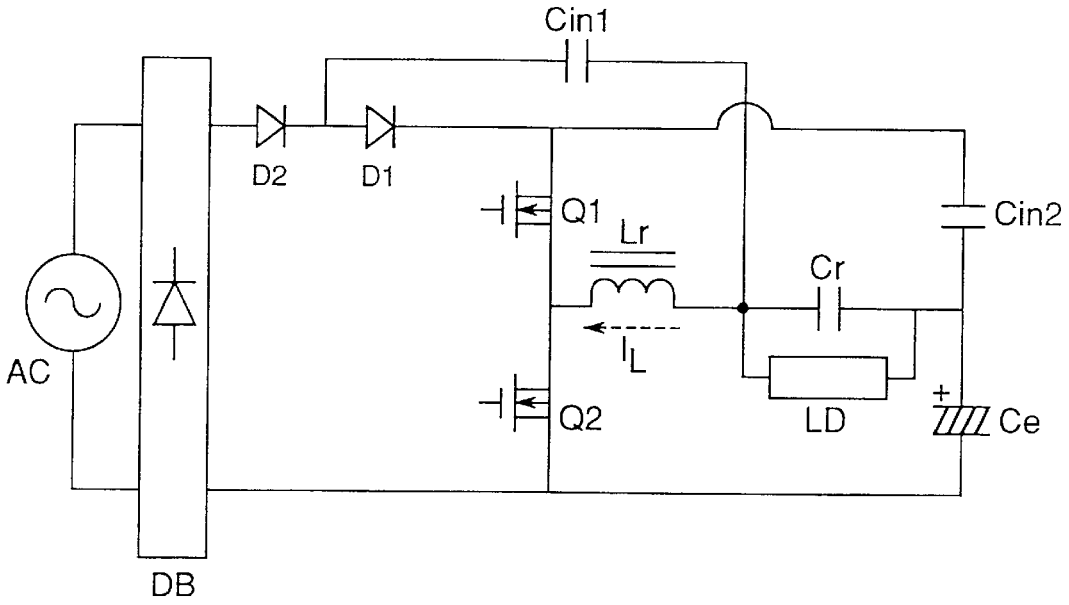
FIGS. 51 to 59 are circuit diagram showing the power source device according to circuit examples 7a to 7h, respectively, of the present invention.

A circuit diagram according to this circuit example is shown in FIG. 51. This circuit shown in FIG. 51 is substantially similar to that shown in FIG. 49, except that a diode D2 is inserted in a forward going fashion between the rectifier element DB and the diode D1 and that a charge capacitor Cin1 is added between a junction of the diode D1 with the diode D2 and a junction of the resonant inductor with the resonant capacitor. (It is to be noted that for the sake of brevity, reference character used to denote the charge capacitor Cin used in the circuit of FIG. 49 is changed to Cin2 in the circuit of FIG. 51.) Also, in FIG. 52, an upper portion of the drawing illustrates a change of the input voltage Vin in the circuit of FIG. 51 and a lower portion of the drawing is explanatory of the period during which the input current is captured from the AC power source AC when the input voltage is of a peak value or zero. In this FIG. 52, regions S and S' represent respective periods during which the input current is captured by CSCP and VSCP added to the circuit of FIG. 49 in accordance with the Circuit Example 7a, and regions T and T' represent the period during which the input current is captured by CSCP used in the circuit of FIG. 49.

Figure 52:
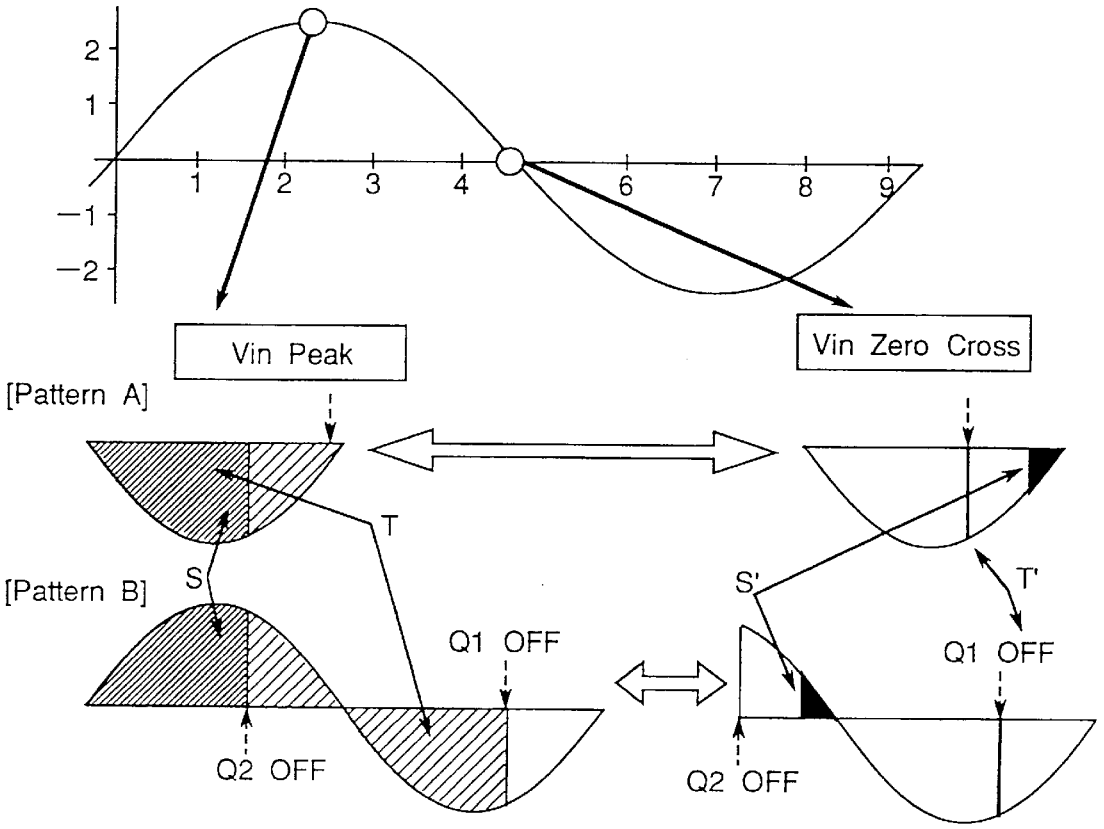

In the case of the circuit shown in FIG. 51, the inductor current IL participates in the input current as shown by "Pattern B" in FIG. 52. Accordingly, the input current which attains a maximum value in the vicinity of a peak (Vin Peak Area) of the input voltage Vin can be drawn during a period larger than a half cycle of the high frequency inductor current. Hereinafter the operation of the circuit according to this circuit example will be described for each mode.

Mode 1;

After the switching element Q1 has been turned off, the inductor current IL flows in the negative direction through the smoothing capacitor Ce by way of the resonant capacitor Cr and the load LD and then returns to the resonant inductor Lr through a stray diode of the switching element Q2. This inductor current IL also flows from the inductor Lr to the stray diode of the switching element Q2 through the charge capacitor Cin1, then diode D1, the charge capacitor Cin2 and the smoothing capacitor Ce.

Mode 2;

When the inductor current IL becomes zero and reverses so as to flow in the positive direction, the smoothing capacitor Ce serves as a power source and the inductor current IL flows through the resonant capacitor Cr and the load LD, then the resonant inductor Lr and finally the switching element Q2. Because of this current, the potential charged on the resonant capacitor Cr is discharged, accompanied by reduction of the potential at a junction between the resonant capacitor Cr and the charge capacitor Cin1, and this condition is maintained until the potential at the junction between the charge capacitor Cin1 and the diodes D1 and D2 attains a value equal to the absolute value of the input voltage.

Mode 3;

When the potential at the junction between the charge capacitor Cin1 and the diodes D1 and D2 attains the value equal to the absolute value of the input voltage, the diode D2 conducts and the input current is drawn from the AC power source AC through the resonant inductor Lr and then through the switching element Q2 while charging the charge capacitor Cin1 through the diode D2, and subsequently combined together with the inductor current IL referred to in under Mode 2.

Mode 4;

When the switching element Q2 is turned off, the inductor current IL charges the charge capacitor Cin2 through the stray diode of the switching element Q1 and, at the same time, returns to the resonant inductor Lr through the resonant capacitor Cr and the load LD. Also, the input current is drawn through the resonant inductor Lr, then the stray diode of the switching element Q1 by way of the charge capacitor Cin2 and the smoothing capacitor Ce and is subsequently combined together with the previously discussed inductor current IL.

Mode 5;

When the inductor current IL becomes zero and reverses so as to flow in the negative direction, the charge capacitor Cin2 is used as a power source and it flows through the switching element Q1, then the resonant inductor Lr, and finally the resonant capacitor Cr and the load LD. In this way, the charge capacitor Cin2 is discharged and this condition is maintained until the high voltage side potential of the charge capacitor Cin2 attains a value equal to the absolute value of the input voltage. During this mode, the resonant capacitor Cr is charged, and when the potential at the junction between the charge capacitor Cin1 and the diodes D1 and D2 attains a value equal to the composite voltage across the smoothing capacitor Ce and the charge capacitor Cin2, the diode D1 conducts to allow the current to flow from the power source, represented by the charge capacitor Cin1, to the resonant inductor Lr through the diode D1 and the switching element Q1 to thereby cause the resonant inductor Lr to accumulate energies. Unless the diode D1 conducts during this mode, the actual operation takes place during the subsequent mode, that is, Mode 6.

Mode 6;

When the high voltage side potential of the charge capacitor Cin attains a value equal to the absolute value of the input voltage, the rectifier diodes D1 and D2 conduct to allow the input current to be drawn from the AC power source AC through the rectifier element DB, the diodes D2 and D1, the switching element Q1, the resonant inductor Lr, the resonant capacitor Cr and the load Ld and finally the smoothing capacitor Ce to thereby charge the smoothing capacitor Ce. During this time, the current flows from the power source, represented by the charge capacitor Cin1, to the resonant inductor Lr through the diode D1 and the switching element q1 to cause the resonant inductor Lr to accumulate energies.

In general, as the input voltage decreases, each of Mode 3,Mode 4, (Mode 5) and Mode 6 contracts and, since the input current flows during this mode, the input current decreases in correspondence with decrease of the input voltage and, therefore, the input power factor can be improved to a higher value.

Since as compared with the circuit shown in FIG. 49 the period of conduction of the input current during one cycle of the inductor current IL drastically increases, not only can increase of the inductor current be suppressed, but downscaling of an input filter section and both downscaling and suppression of the breakdown strength of the various circuit component parts can be attained, making it possible to provide the inexpensive power source device. Also, by combining the resonant circuits for the various modes, the capacitance of the resonant capacitor Cr can be minimized to thereby reduce the low frequency ripple appearing in the output.

7-2-2. Circuit Example 7b

Figure 53:
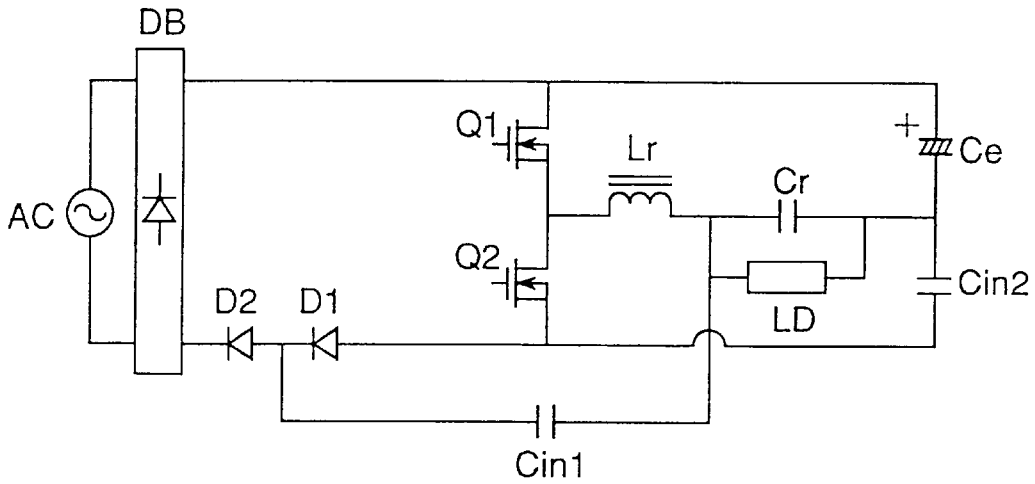

A circuit diagram of the power source device according to this circuit example is shown in FIG. 53. The circuit shown in FIG. 53 is substantially similar to the circuit of FIG. 51, except that the circuit construction other than the switching elements Q1 and Q2 and the smoothing capacitor, disposed on a high voltage side of the smoothing capacitor Ce in the circuit of FIG. 51, is symmetrically disposed on a ground side of the smoothing capacitor Ce with respect to a junction between the switching elements Q1 and Q2.

7-2-3. Circuit Example 7c

Figure 54:
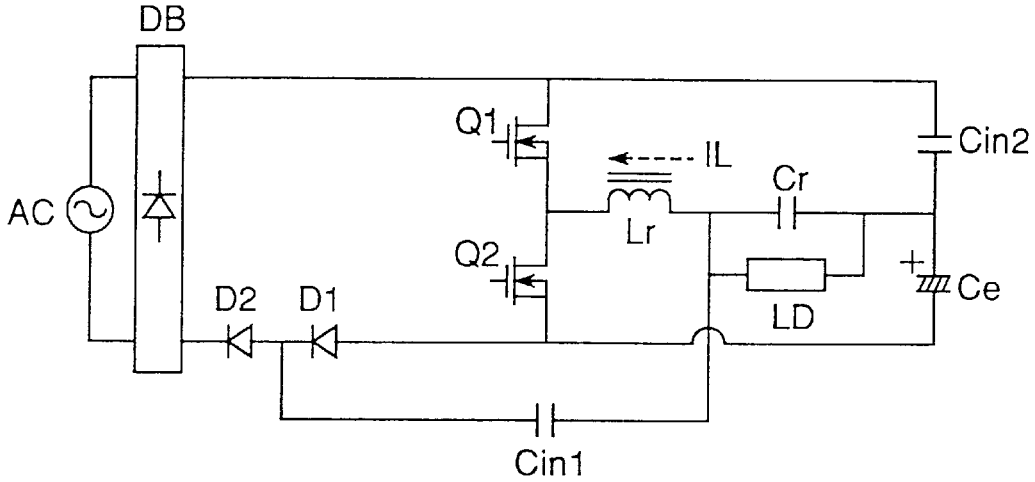

A circuit diagram of the power source device according to this circuit example is shown in FIG. 54, which is substantially similar to the circuit of FIG. 53, except that the smoothing capacitor Ce and the charge capacitor Cin2 are reversed in position relative to each other. In the circuit of FIG. 54, a portion of the inductor current IL which participates in the input current during one cycle is such as shown by "Pattern A" in FIG. 52. Hereinafter, the operation of the circuit of FIG. 54 will be described for each mode.

Mode 1;

After the switching element Q1 has been turned off, the inductor current IL flows in the negative direction through the smoothing capacitor Ce by way of the resonant capacitor Cr and the load LD and then returns to the resonant inductor Lr through a stray diode of the switching element Q2. This inductor current IL also flow to the AC power source AC through the diode D2 while charging the charge capacitor Cin1 and then flow from the high voltage output end of the rectifier element to the smoothing capacitor Ce through the charge capacitor Cin2, finally returning to the resonant inductor IL through the stray diode of the switching element Q2 while charging the smoothing capacitor Ce, to thereby draw the input current. Accordingly, the inductor current IL is a composite current of them. During this mode the switching element Q2 is turned on.

Mode 2;

When the inductor current IL becomes zero and reverses so as to flow in the positive direction, the smoothing capacitor Ce serves as a power source and the inductor current IL flows through the resonant capacitor Cr and the load LD, then the resonant inductor Lr and finally the switching element Q2. At the same time, during this mode, a current flows from the charge capacitor Cin1, serving as a power source, through the resonant inductor Lr, then the switching element Q2 and finally the diode D1 to cause the resonant inductor Lr to accumulate energies.

Mode 3;

When the switching element Q2 is turned off, the inductor current IL charges the charge capacitor Cin2 through the stray diode of the switching element Q1 and, at the same time, returns to the resonant inductor Lr through the resonant capacitor Cr and the load LD. If the difference between the voltage Vce on the smoothing capacitor Ce and the voltage on the charge capacitor Cin1 is equal to the voltage across the resonant capacitor Cr, the charge capacitor Cin2 is at the same time charged through the stray diode of the switching element Q1 and then flow through the smoothing capacitor Ce, then the diode D1 and finally the charge capacitor Cin1 to cause the charge capacitor Cin1 to discharge.

Mode 4;

When the inductor current IL becomes zero and starts flowing in the negative direction, the charge capacitor Cin serves as a power source and the inductor current IL flows through the switching element Q1, then the resonant inductor Lr and finally the resonant capacitor Cr and the load LD. This condition is maintained until the charge capacitor Cin2 is discharged and the sum of the high voltage side potential of the charge capacitor Cin2 plus the voltage Vce on the smoothing capacitor Ce attains a value equal to the absolute value of the input voltage. During this time, the resonant capacitor Cr is charged by the inductor current IL and, when the sum of the voltage across the charge capacitor Cin2 plus the voltage Vce on the smoothing capacitor Ce attains a value equal to the difference between the absolute value of the input voltage and the voltage on the charge capacitor Cin1, the diode D2 conducts to cause the inductor current IL to charge the charge capacitor Cin1 and also to flow to the AC power source AC through the diode D2, finally returning to the resonant inductor Lr through the switching element Q1 to thereby draw the input current.

Mode 5;

When the sum of the voltage across the charge capacitor Cin2 plus the voltage Vce on the smoothing capacitor Ce attains a value equal to the absolute value of the input voltage, the diode D1 conducts to draw the input current from the AC power source AC through the rectifier element DB, the diode D1, the switching element Q1, the resonant inductor Lr, the resonant capacitor Cr and the load LD, and finally the smoothing capacitor Ce to thereby charge the smoothing capacitor Ce. At the same time, the resonant capacitor Cr is charged by the inductor current IL and, when the sum of the voltage Vce on the smoothing capacitor Ce and the voltage on the resonant capacitor Cr attains a value equal to the difference between the absolute value of the input voltage and the voltage on the charge capacitor Cin1, the diode D2 conducts to cause the inductor current IL to charge the charge capacitor Cin1 and also to flow to the AC power source AC through the diode D2, finally returning to the resonant inductor Lr through the switching element Q1 to thereby draw the input current.

In general, as the input voltage decreases, each of Mode 1, (Mode 4) and Mode 5 contracts and, since the input current flows during this mode, the input current decreases in correspondence with decrease of the input voltage and, therefore, the input power factor can be improved to a higher value. Accordingly, the circuit according to this circuit example can bring about effects similar to those brought about by the circuit of FIG. 51.

7-2-4. Circuit Example 7d

Figure 55:
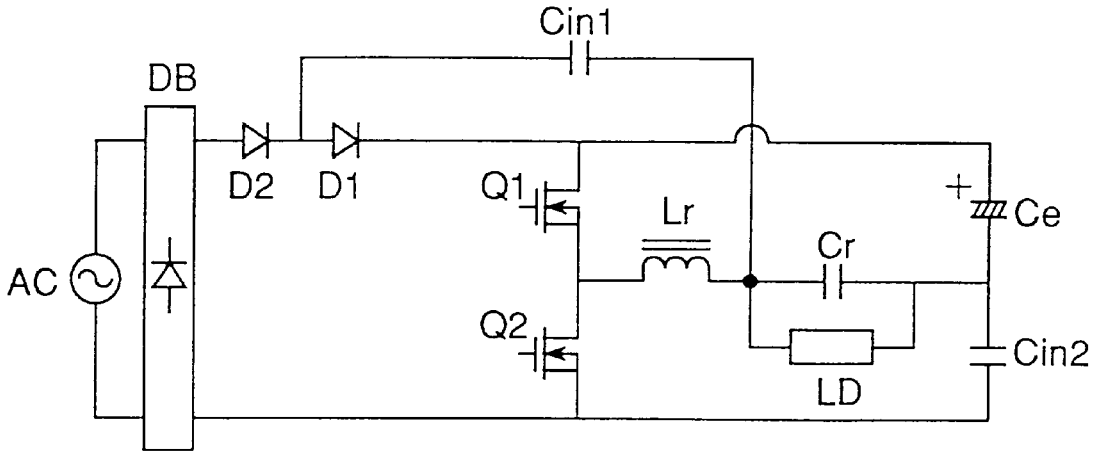

A circuit diagram of the power source device according to this circuit example is shown in FIG. 55, which is substantially similar to the circuit of FIG. 54, except that the circuit construction other than the switching elements Q1 and Q2 and the smoothing capacitor, disposed on a high voltage side of the smoothing capacitor Ce in the circuit of FIG. 54, is symmetrically disposed on a low voltage (ground) side of the smoothing capacitor Ce with respect to a junction between the switching elements Q1 and Q2.

7-2-5. Circuit Example 7e

Figure 56:
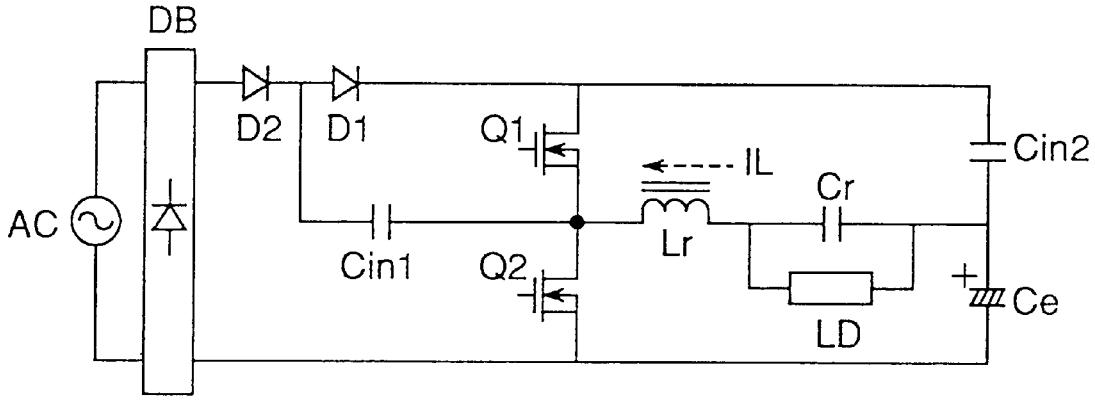

A circuit diagram of the power source device according to this circuit example is shown in FIG. 56. The circuit shown therein substantially corresponds to the circuit of FIG. 49 to which the concept of CSCP employed in the circuit of FIG. 27 is applied. More specifically, the circuit shown in FIG. 56 is substantially similar to that of FIG. 55 except that a junction between the charge capacitor Cin1 and the resonant inductor Lr and the resonant capacitor Cr is connected with a junction between the switching elements Q1 and Q2. This circuit is effective to expand the period of conduction of the input current and, at the same time, to suppress increase the inductor current, to thereby draw the input current with high efficiency. Hereinafter, the operation of the circuit of FIG. 56 will be described for each mode.

Mode 1;

After the switching element Q1 has been turned off, the inductor current IL flowing in the negative direction flows through the smoothing capacitor Ce while charging the latter and then flow in a direction required to charge the smoothing capacitor Ce from the resonant capacitor Cr and the load LD by way of the resonant inductor Lr, thereby drawing the input current. This mode is maintained until the voltage across the charge capacitor Cin1 attains a value equal to the absolute value of the input voltage.

Mode 2;

When the voltage across the charge capacitor Cin1 attains a value equal to the absolute value of the input voltage, the inductor current IL flowing in the negative direction flows through the smoothing capacitor Ce through the resonant capacitor Cr and the load LD and then returns to the resonant inductor Lr through the stray diode of the switching element Q2. During this mode, the switching element Q2 is turned on.

Mode 3;

When the inductor current IL becomes zero and starts flowing in the positive direction, the smoothing capacitor Ce serves as the power source and the inductor current IL flows through the resonant capacitor Cr and the load LD, then the resonant inductor Lr and finally the switching element Q2.

Mode 4;

When the switching element Q2 is turned off, the inductor current IL flowing in the positive direction charges the charge capacitor Cin1 and, at the same time, charges the charge capacitor Cin2 through the diode D1, and then return to the resonant inductor Lr through the resonant capacitor Cr and the load LD.

Mode 5;

When the voltage across the charge capacitor Cin1 becomes zero, the stray diode of the switching element Q1 is turned on to cause the inductor current IL flows through the stray diode of the switching element Q1 to the charge capacitor Cin2 to charge the latter and then returns to the resonant inductor Lr through the resonant capacitor Cr and the load LD. During this period the switching element Q1 is turned on.

Mode 6;

When the inductor current IL becomes zero and starts flowing in the negative direction, the charge capacitor Cin2 serves as the power source and the current flows through the switching element Q1, the resonant inductor Lr, and the resonant capacitor Cr and the load LD. This condition is maintained until the charge capacitor Cin2 is discharged and the high voltage side potential of the charge capacitor Cin2 subsequently attains a value equal to the absolute value of the input voltage.

Mode 7;

When the high voltage side potential of the charge capacitor Cin2 attains a value equal to the absolute value of the input voltage, the diode D1 conducts and the input current is drawn from the AC power source AC to the smoothing capacitor Ce through the rectifier element DB, the diode D1, the switching element Q1, the resonant inductor Lr and the resonant capacitor Cr and the load Ld, to thereby charge the smoothing capacitor Ce.

In general, as the input voltage decreases, each of Mode 1, Mode 4 and Mode 7 contracts and, since the input current flows during each of Modes 1 and 7, the input current decreases in correspondence with decrease of the input voltage and, therefore, the input power factor can be improved to a higher value. Accordingly, the circuit according to this circuit example can bring about effects similar to those brought about by the circuit of FIG. 51.

7-2-6. Circuit Example 7f

Figure 57:
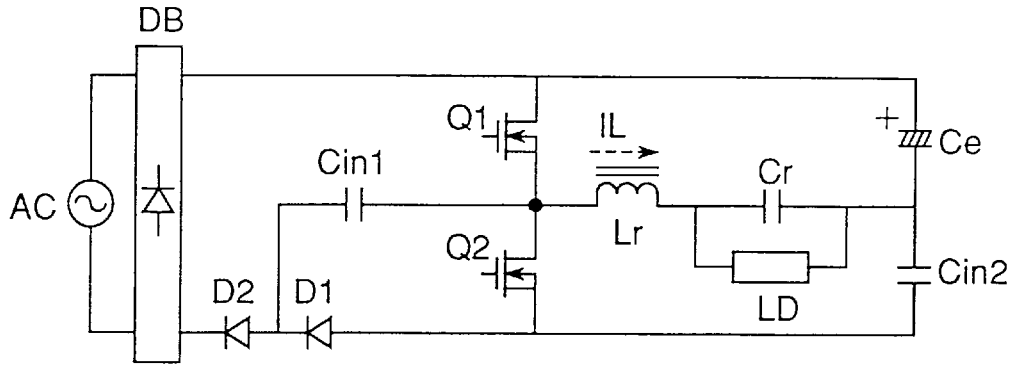

A circuit diagram of the power source device according to this circuit example is shown in FIG. 57, which is substantially similar to the circuit of FIG. 56 except that the circuit construction other than the switching elements Q1 and Q2 and the smoothing capacitor, disposed on a high voltage side of the smoothing capacitor Ce in the circuit of FIG. 56, is symmetrically disposed on a low voltage (ground) side of the smoothing capacitor Ce with respect to a junction between the switching elements Q1 and Q2.

7-2-7. Circuit Example 7g

Figure 58:
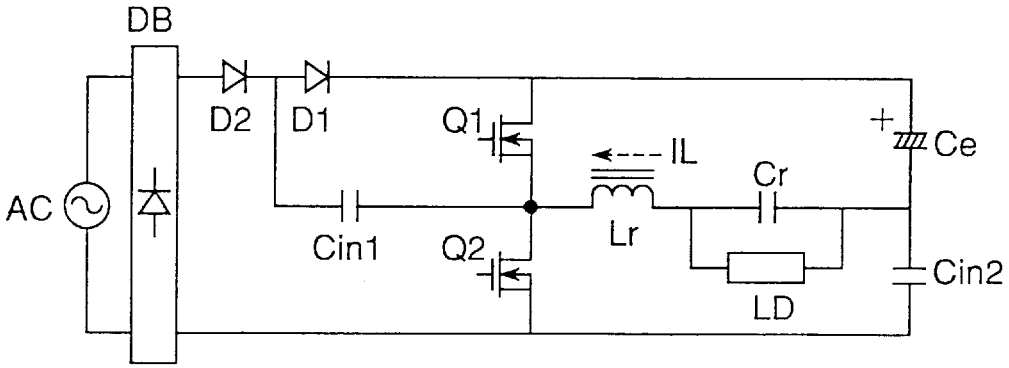

A circuit diagram of the power source device according to this circuit example is shown in FIG. 58, which is substantially similar to that shown in FIG. 56, except that the smoothing capacitor Ce and the charge capacitor Cin2 are reversed in position relative to each other. The operation of the circuit of FIG. 58 will now be described for each mode.

Mode 1;

After the switching element Q1 has been turned off, the inductor current IL flowing in the negative direction flows from the AC power source AC through the diode D2 to the charge capacitor Cin1 to charge the latter and then flows in a direction required to charge the charge capacitor Cin2 from the resonant capacitor Cr and the load LD by way of the resonant inductor Lr, to thereby draw the input current. This mode is maintained until the voltage across the charge capacitor Cin1 attains a value equal to the absolute value of the input voltage.

Mode 2;

When the voltage across the charge capacitor Cin1 attains a value equal to the absolute value of the input voltage, the inductor current IL flowing in the negative direction flows through the resonant capacitor Cr and the load LD to the charge capacitor Cin2 to charge the latter and then returns to the resonant inductor Lr through the stray diode of the switching element Q2. During this mode, the switching element Q2 is turned on.

Mode 3;

When the inductor current IL becomes zero and starts flowing in the positive direction, the charge capacitor Cin2 serves as the power source and the inductor current IL flows through the resonant capacitor Cr and the load LD, then the resonant inductor Lr and finally the switching element Q2. Since at this time a cathode side of the diode D2 is of a potential equal to the absolute value of the input voltage, this mode is maintained until the charge capacitor Cin2 is discharged and the voltage Vcin2 on the charge capacitor Cin2 is consequently reduced and the sum of the voltage Vcin2 and the voltage Vce on the smoothing capacitor Ce attains a value equal to the absolute value of the input voltage.

Mode 4;

When the sum of the voltages Vcin2 and Vce attains a value equal to the absolute value of the input voltage, the diode D1 conducts and the input current is drawn from the AC power source AC through the diode D2, then the diode D1, the smoothing capacitor Ce, the resonant capacitor Cr and the load LD, the inductor and finally the switching element Q2.

Mode 5;

When the switching element Q2 is turned off, the inductor current IL flowing in the positive direction charges the charge capacitor Cin1 and, at the same time, charges the smoothing capacitor Ce through the diode D1, and finally return to the resonant inductor Lr through the resonant capacitor Cr and the load LD.

Mode 6;

When the voltage across the charge capacitor Cin1 becomes zero, the stray diode of the switching element Q1 conducts and the inductor current IL returns to the resonant inductor Lr through the resonant capacitor Cr and the load LD while charging the smoothing capacitor Ce through the stray diode of the switching element Q1. During this period, the switching element Q1 is turned on.

Mode 7;

When the inductor current IL becomes zero and starts flowing in the negative direction, the smoothing capacitor Ce serves as the power source and the current flows to the resonant capacitor Cr and the load LD through the switching element Q1 and then the resonant inductor Lr.

In general, as the input voltage decreases, each of Mode 1, Mode 4 and Mode 5 contracts and, since the input current flows during each of Modes 1 and 4, the input current decreases in correspondence with decrease of the input voltage and, therefore, the input power factor can be improved to a higher value. Accordingly, the circuit according to this circuit example can bring about effects similar to those brought about by the circuit of FIG. 51.

7-2-8. Circuit Example 7h

Figure 59:
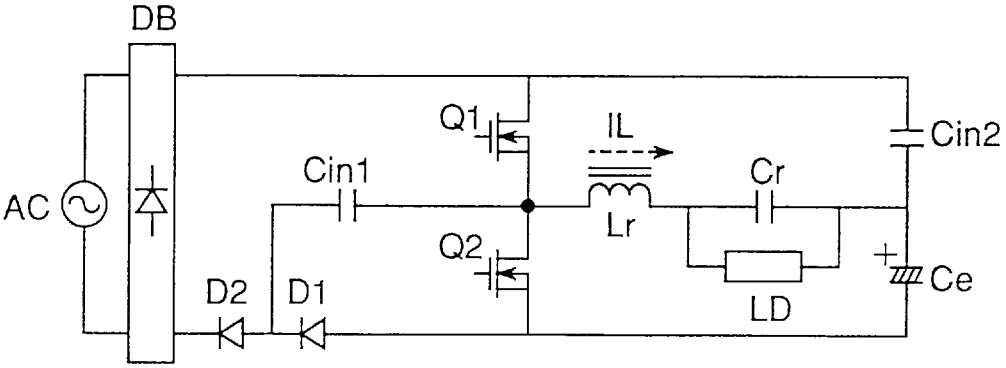

A circuit diagram of the power source according to this circuit example is shown in FIG. 59. The circuit shown therein is substantially similar to that of FIG. 58, except that the circuit construction other than the switching elements Q1 and Q2 and the smoothing capacitor, disposed on a high voltage side of the smoothing capacitor Ce in the circuit of FIG. 58, is symmetrically disposed on a low voltage (ground) side of the smoothing capacitor Ce with respect to a junction between the switching elements Q1 and Q2.

7-3. Effects:

The power source device according to any one of the circuit examples of the seventh embodiment of the present invention is such that VSCP described in connection with the Prior Art 1 and CSCP disclosed in the U.S. Pat. No. 5,488,269 are combined and used in a circuit based on the circuit disclosed in the Japanese Laid-open Patent Publication No. 2-75200. Accordingly, with this power source device, the period during which the input current can be pumped up from the AC power source AC during each switching cycle can be expanded, the breakdown strength of the various component parts such as the switching element, the inductor and the capacitors can be reduced, making it possible to provide the inexpensive and compact power source device having the PFC function.

8. Eighth Embodiment 8-1. Summary A

A eighth embodiment of the present invention provides a basic circuit of the power source device which has been designed so as to minimize a switching loss as compared with the CPPFC circuit system discussed in connection with any one of the Prior Arts 1 and 2.

Figure 60:
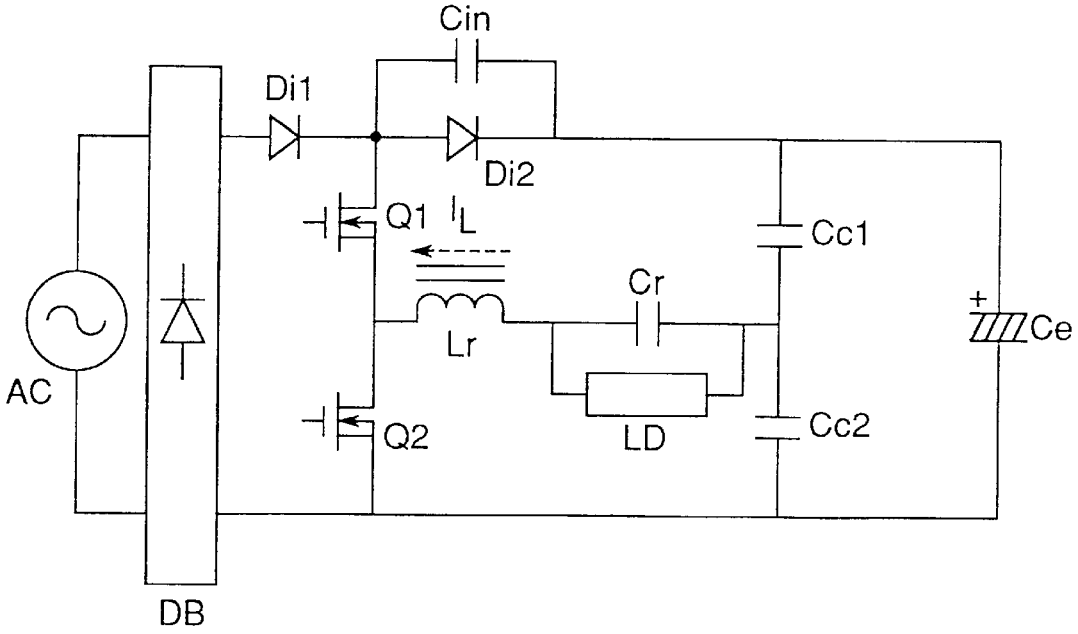
FIG. 60 is a circuit diagram showing the power source device of the CSCP system according to an eighth preferred embodiment of the present invention in which a switching loss is improved.

The basic circuit is shown in FIG. 60. Referring to FIG. 60, the power source device comprises a rectifier element DB for rectifying an output from an AC power source AC, diodes Di1 and Di2, a resonant circuit including a resonant inductor Lr and a resonant capacitor Cr, series-connected capacitors Cc1 and Cc2, and a smoothing capacitor Ce. Between high and low voltage output ends of the rectifier element DB, the diode Di1, a parallel circuit of the diode Di2 and the capacitor Cin, and the series connected capacitors Cc1 and Cc2 are connected in a forward going fashion. The smoothing capacitor Ce is connected parallel to a series circuit of the diodes Di1 and Di2; the series connected switching elements Q1 and Q2 are connected between a junction of the diode Di1 with the diode Di2 and the low voltage output end of the rectifier element DB with the switching element Q1 positioned on a high voltage side; and the resonant circuit including the resonant inductor Lr and the resonant capacitor Cr is connected between a junction of the switching elements Q1 and Q2 and a junction of the capacitors Cc1 and Cc2 with the resonant inductor Lr positioned adjacent the switching elements Q1 and Q2. A load LD is connected parallel to the resonant capacitor Cr.

Figure 61:
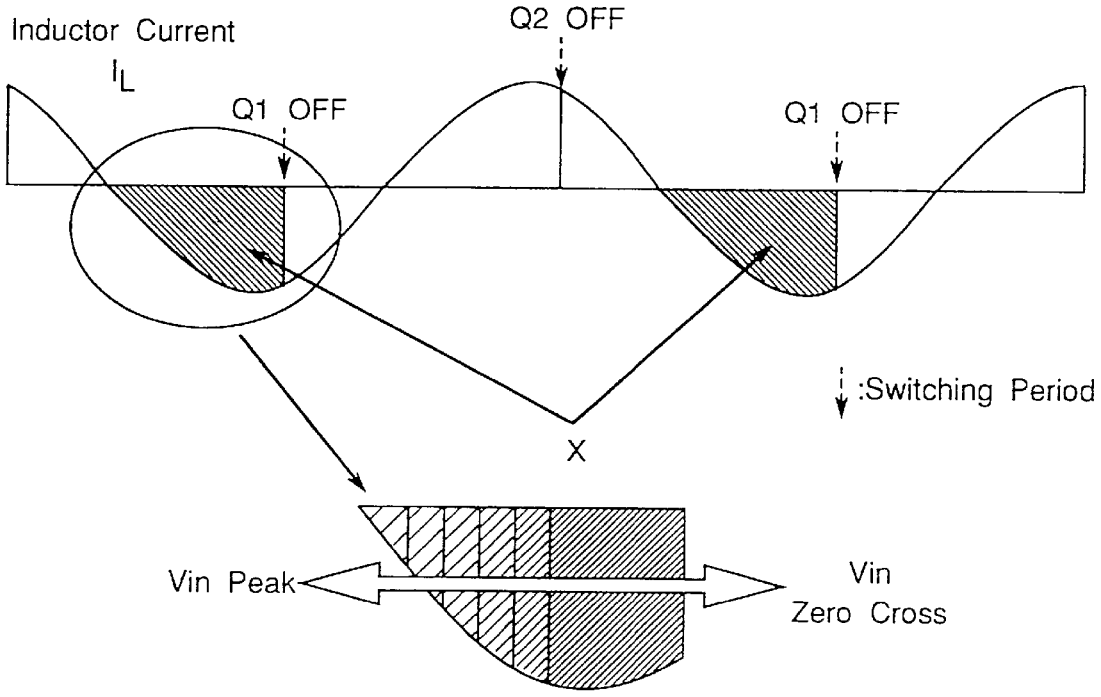
FIG. 61 is a diagram showing a relation between the input current and the resonant current in the power source device shown in FIG. 60.

FIG. 61 illustrates the manner in which in the circuit of FIG. 60 the input current is captured from the AC power source AC. Hereinafter, the operation of the circuit will be described. (It is to be noted that FIGS. 62A to 62F illustrate respective paths of flow of the current during associated modes.)

Figure 62A:
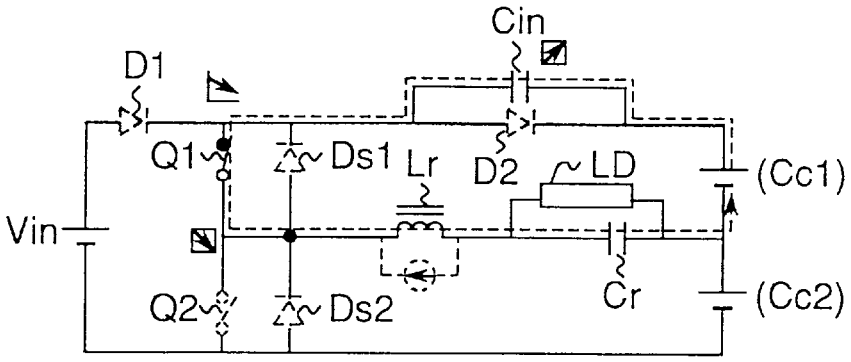
FIGS. 62A to 62F are diagrams showing respective paths of flow of the current during associated modes of operation of the power source device shown in FIG. 60.

Mode 1;

When the switching element Q1 is turned on, a DC voltage Vcc1 of the capacitor Cc1 serves as a power source and the inductor current IL flows therefrom to the resonant capacitor Cr and the load LD through the switching element Q1 and the resonant inductor Lr while charging the charge capacitor Cin, as shown in FIG. 62A.

Figure 62B:
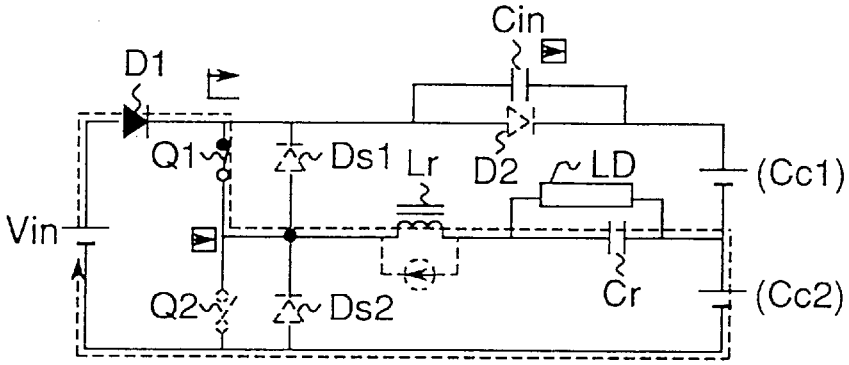

Mode 2;

When the charge capacitor Cin is charged and the potential at the junction between the charge capacitor Cin and the switching element Q1 attains a value equal to the absolute value of the input voltage, the diode Di1 conducts and the inductor current IL flows from the AC power source AC through the diode Di1 and the switching element Q1 and then to the capacitor Cc2 through the resonant capacitor Cr and the load LD, to thereby draw the input current, as shown in FIG. 62B.

Figure 62C:
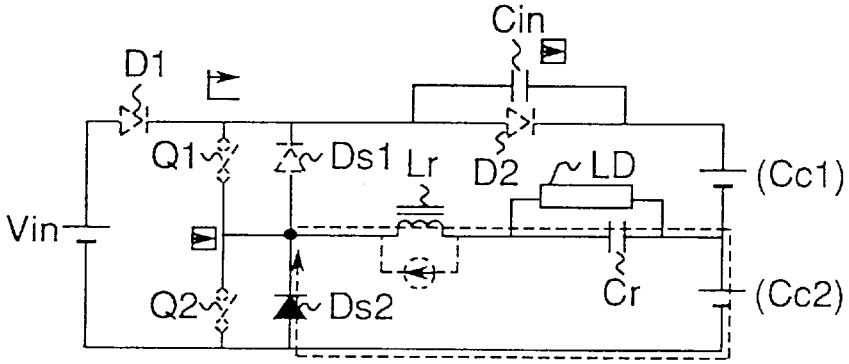

Mode 3;

After the switching element Q1 is turned off, the stray diode of the switching element Q2 conducts and the inductor current IL flows from the resonant inductor Lr back to the resonant inductor Lr through the resonant capacitor Cr and the load LD, the capacitor Cc2 and the stray diode of the switching element Q2, as shown in FIG. 62C.

Figure 62D:
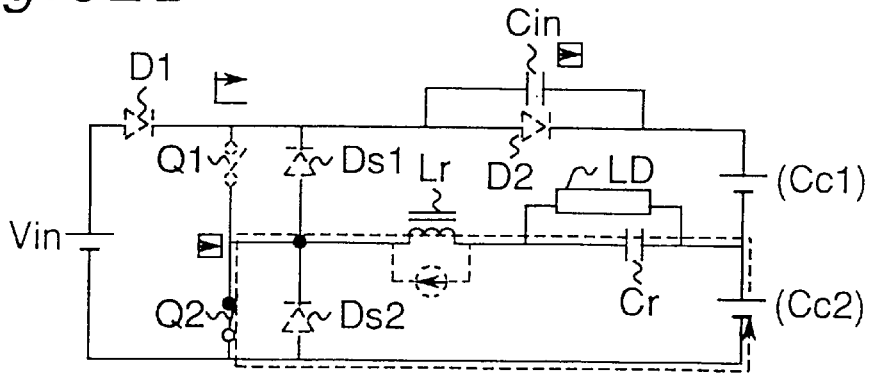

Mode 4;

When the inductor current IL becomes zero and starts flowing in the positive direction as shown by the arrow in FIG. 60, the capacitor Cc2 serves as the power source and the inductor current IL flows through the resonant capacitor Cr and the load LD, then the resonant inductor Lr and finally the switching element q2 as shown in FIG. 62D.

Figure 62E:
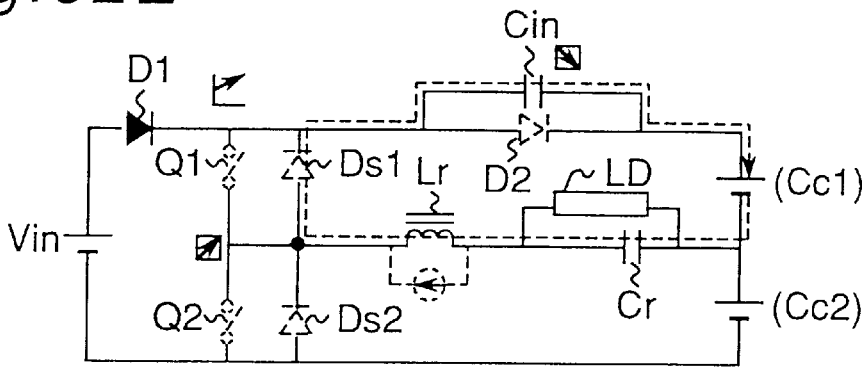

Mode 5;

When the switching element Q2 is turned off, the inductor current IL flows from the resonant inductor Lr back to the resonant inductor Lr through the capacitor Cc1 and the resonant capacitor Cr and the load LD while causing the charge capacitor Cin to discharge through the stray diode of the switching element Q1, as shown in FIG. 62E.

Figure 62F:
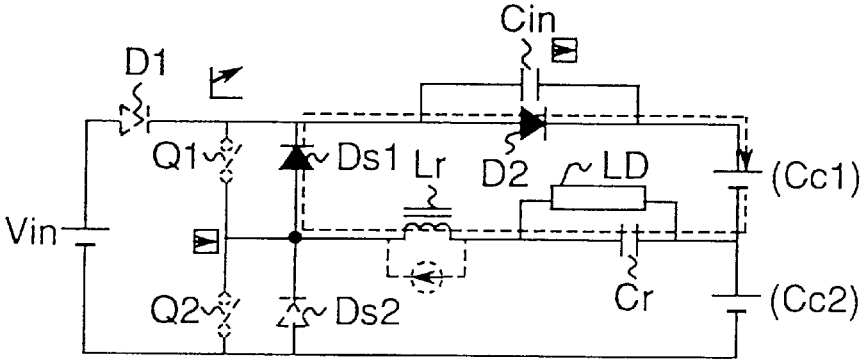

Mode 6;

When the charge capacitor Cin1 is completely discharged to a zero volt, the diode Di2 connected parallel thereto conducts and the inductor current IL returns to the resonant inductor Lr through the stray diode of the switching element Q1, the diode Di2, the capacitor Cc1 and the resonant capacitor Cr and the load LD as shown in FIG. 62F.

The circuit shown in FIG. 60 is effective to improve the power factor with a simplified structure and also to improve a waveform deformation of the input current by allowing the resonant inductor current to be drawn from the AC power source AC during Mode 2. Thus, the circuit of FIG. 60 can bring about effects similar to those accomplished by the circuit according to any one of the Prior Arts 1 and 2, the U.S. Pat. No. 5,488,269 and the Japanese Laid-open Patent Publication No. 2-75200.

According to the circuit shown in FIG. 60, the charge capacitor Cin retains the voltage charged thereon during any one of Modes 2, 3 and 4 and only a voltage equal to the absolute value of the power source voltage is applied to the switching element Q1 or Q2 and accordingly the voltage applied to the switching element Q1 or Q2 during the switching is equal to the absolute value of the input voltage. This improves a switching loss during the switching element being turned off. Such effects can be brought about by the circuit according to any one of circuit examples which will be described hereinafter.

8-2. Circuit Structures A 8-2-1. Circuit Example 8a

Figure 63:
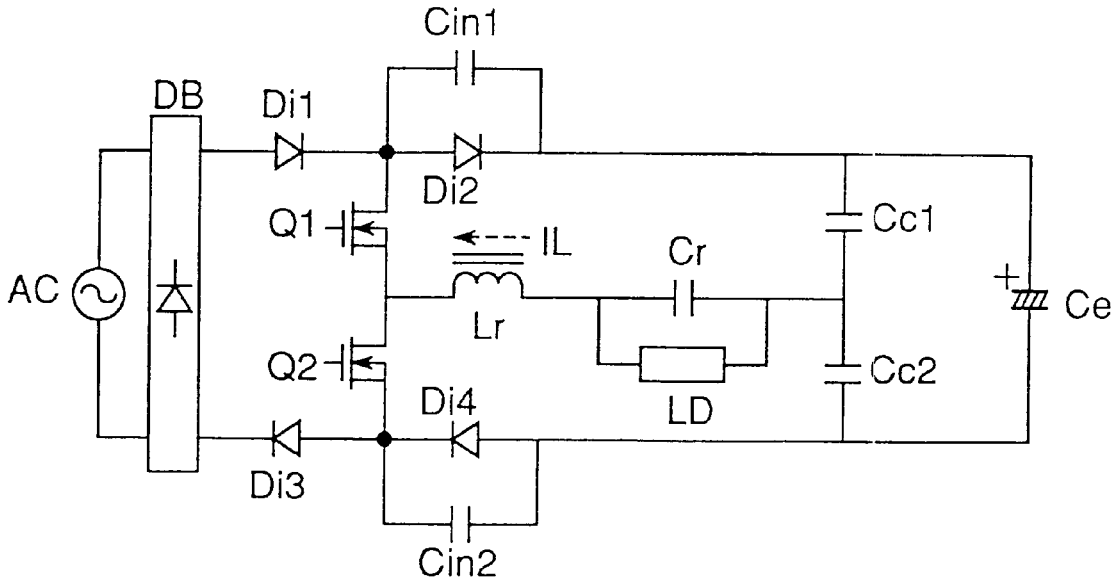
FIGS. 63 and 64 are circuit diagrams showing the power source device according to respective circuit examples 8a and 8b of the present invention.

A circuit diagram of the power source device according to this circuit example is shown in FIG. 63. This circuit is substantially similar to the circuit of FIG. 60, except that a diode Di3 is inserted between the low voltage output end of the rectifier element Db and one end of the switching element Q2 adjacent a non-switching element Q1; a diode Di4 is connected between a low voltage side of the switching element Q2 and a low voltage junction of the capacitor Cc2 and the smoothing capacitor Ce; and a charge capacitor Cin2 is employed and connected parallel to the diode Di4. The operation of the circuit of FIG. 63 will now be described in detail.

Mode 1;

When the switching element Q1 is turned on, the DC voltage Vcc1 of the capacitor Cc1 serves as a power source and the inductor current IL flows therefrom to the resonant capacitor Cr and the load LD through the switching element Q1 and the resonant inductor Lr while charging the charge capacitor Cin. Since the voltage Vcin2 on the charge capacitor Cin2 is, due to the previous operation, equal to the difference between the voltage Vce on the smoothing capacitor and the absolute value of the input voltage Vin and since the difference between the voltage Vce on the smoothing capacitor Ce and the sum of the voltage Vcin1 on the charge capacitor Cin1 plus the voltage Vcin2 on the charge capacitor Cin2 is equal to the absolute value of the input voltage Vin, the diode Di1 conducts to allow the inductor current IL to flow from the AC power source AC to the switching element Q1 through the diode Di1 and then to flow to the diode Di3 through the resonant capacitor Cr and the load Ld, then the capacitor Cc2 and finally the charge capacitor Cin2 to thereby draw the input current. Charging of the charge capacitor Cin1 with the inductor current IL and discharge of the charge capacitor Cin2 result in maintenance of the voltage (Vcin1+Vcin2) at a predetermined value.

Mode 2;

When the charge capacitor Cin2 is completely discharged and the diode Di4 connected parallel thereto consequently conducts, the inductor current IL flows from the AC power source AC to the diode Di3 through the diode Di1, then the switching element Q1, the resonant inductor Lr, the load LD and the resonant capacitor Cr, the capacitor Cc2 and finally the diode Di4 while the voltage Vcin1 on the charge capacitor Cin1 is maintained at a value equal to the difference between the voltage Ce less the absolute value of the voltage Vin, to thereby draw the input current.

Mode 3;

After the switching element Q1 is turned off, the stray diode of the switching element Q2 conducts and the inductor current IL flows from the resonant inductor Lr back to the resonant inductor Lr through the resonant capacitor Cr and the load LD, the capacitor Cc2, the diode Di4 and the stray diode of the switching element Q2, as shown in FIG. 62C.

Mode 4;

When the inductor current IL becomes zero and starts flowing in the positive direction as shown by the arrow in FIG. 60, the capacitor Cc2 serves as the power source and the inductor current IL flows from the resonant inductor Lr through the switching element Q2, the charge capacitor Cin2 (charging), the resonant capacitor Cr and the load LD and the diode Di3, the AC power source AC, the diode Di1, the charge capacitor Cin1 (discharge), the capacitor Cc1 and the resonant capacitor Cr and the load LD, so that the voltage (Vcin1+Vcin2) can be maintained at the predetermined value as a result of discharge of the charge capacitor Cin1 and charge of the charge capacitor Cin2.

Mode 5;

When the charge capacitor Cin1 is completely discharged and the diode Di2 connected parallel thereto consequently conducts, the inductor current IL flows from the AC power source AC to the diode Di3 through the diode Di1, the diode Di2, the capacitor Cc1, the load LD and the resonant capacitor Cr, the resonant inductor Lr and the switching element Q2 while the voltage Vcin2 is maintained at a value equal to the difference between the voltage Vce less the absolute value of the input voltage Vin, to thereby draw the input current.

Mode 6;

When the switching element Q2 is turned off, the inductor current IL flows therefrom back to the resonant inductor Lr through the stray diode of the switching element Q1, the diode Di2, the capacitor Cc1 and the resonant capacitor Cr and the load Ld.

According to the circuit shown in FIG. 63, the inductor current is drawn from the input power source during any one of Modes 1, 2, 4 and 5 and accordingly, the input current can be drawn over a period longer than that accomplished by the circuit of FIG. 60 to thereby attain a high power factor with a minimized inductor current. Moreover, only a voltage equal to the absolute value of the power source voltage is applied to the switching element Q1 or Q2 during any of Modes 1 to 6 and, accordingly, the voltage applied to the switching element during switching is equal to the absolute value of the input voltage at all times. Because of this, the switching loss which occurs during the switching element being turned off can be improved so that the switching element and radiator component parts can be manufactured compact in size and inexpensive in cost.

8-2-2. Circuit Example 8b

Figure 64:
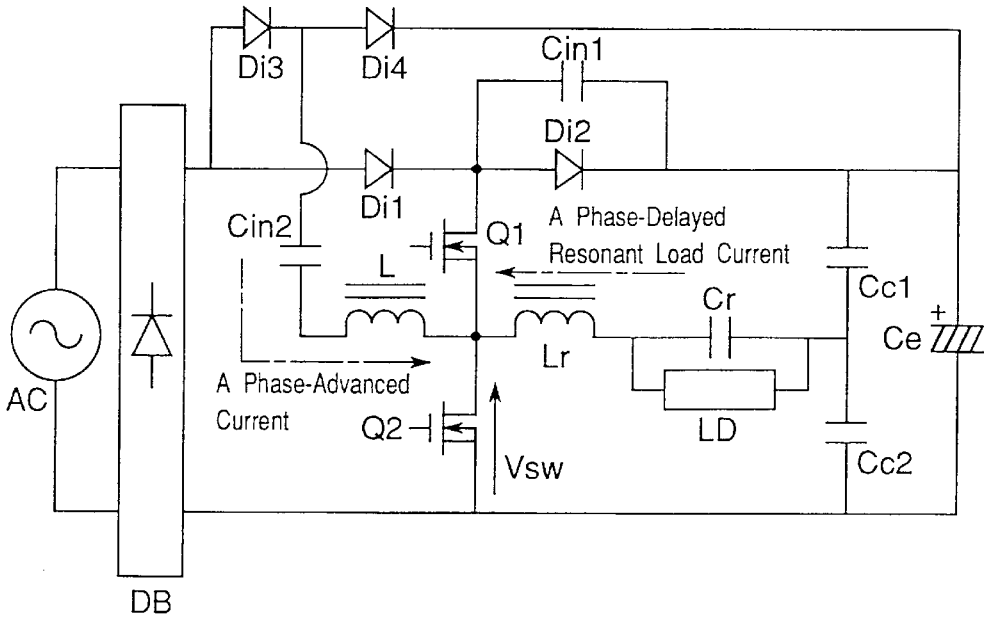
Figure 65:
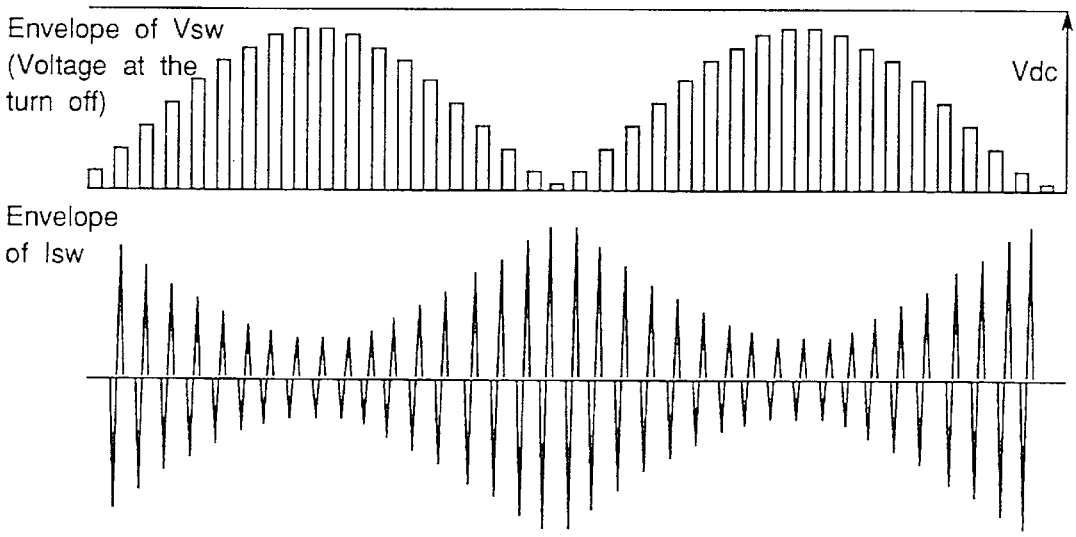
FIG. 65 is a schematic diagram showing an envelope of an applied voltage of a switching element and a switching current in the power source device according to the circuit example 8b.

A circuit diagram of the power source device according to this circuit example is shown in FIG. 64. The circuit of FIG. 64 is substantially similar to that of FIG. 60 and, however, in accordance with this circuit example, diodes Di3 and Di4, a charge capacitor Cin2 and an inductor L are added to the circuit of FIG. 60. Specifically, the diode Di3 is connected at its anode with the high voltage output end of the rectifier element DB; the diode Di4 is connected at its anode with a cathode of the diode Di3 and at its cathode with a high voltage side of the smoothing capacitor Ce; the smoothing capacitor Cin2 has one end connected with a junction between the diodes Di3 and Di4; and the inductor L has one end connected with the other end of the charge capacitor Cin2 and the other end with a junction between the switching elements Q1 and Q2. If using the circuit according to this circuit example as a basis a technology to reduce the switching current by adding a phase-delayed resonant load current and a phase-advanced current to the switching voltage, such as disclosed in the U.S. Pat. No. 5,541,829 is employed, the switching elements and the radiator component parts can be manufactured compact in size and inexpensive. The voltage and current of the switching elements appearing in the circuit of FIG. 64 are such as shown in FIG. 65.

8-2-3. Circuit Example 8c

Figure 66:
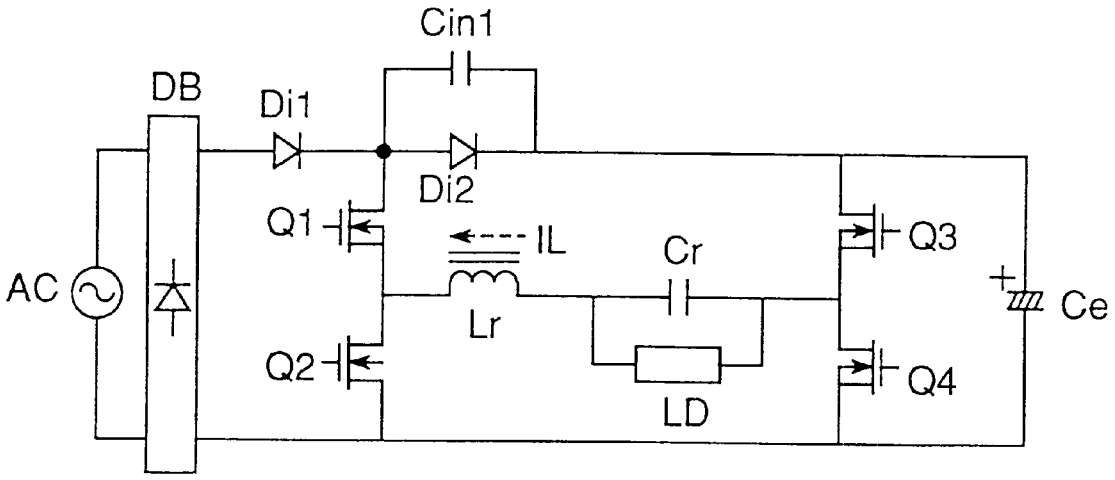
FIG. 66 is a circuit diagram showing a first example of application of the CSCP system of FIG. 60 to the full bridge inverter circuit.
Figure 67:
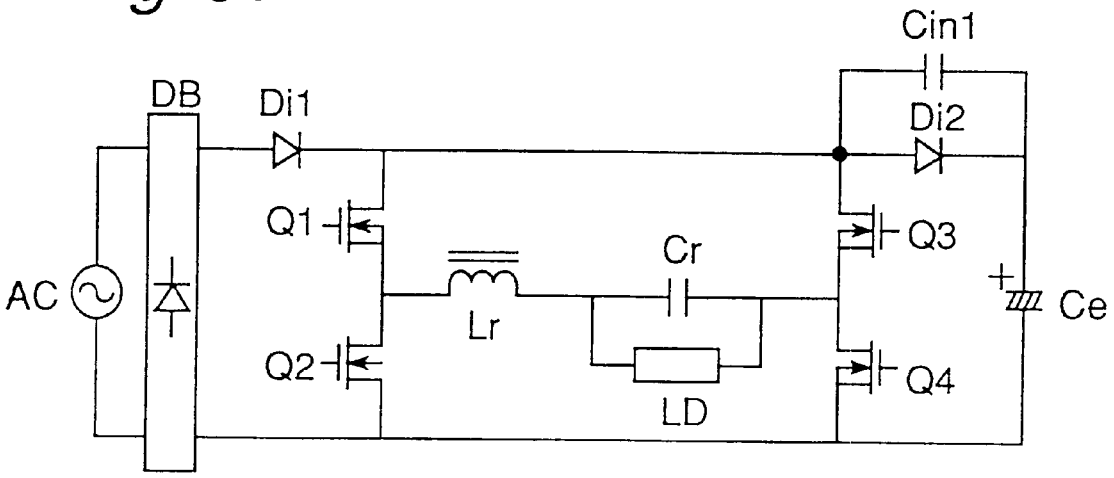
FIG. 67 is a circuit diagram showing a second example of application of the CSCP system of FIG. 60 to the full bridge inverter circuit.

Before the description of the power source device according to this circuit example will be described, different circuits both effective to bring about effects similar to those brought about by the circuit of FIG. 60 is shown in FIGS. 66 and 67, respectively. The circuit shown in FIG. 66 is substantially similar to the circuit of FIG. 60, except that a series circuit of the capacitors Cc1 and Cc2 shown in FIG. 60 is replaced with switching elements Q3 and Q4. On the other hand, the circuit shown in FIG. 67 is substantially similar to the circuit of FIG. 60, except that not only is the series circuit of the capacitors Cc1 and Cc2 replaced by a series circuit of the switching elements Q3 and Q4, but CSCP comprised of a parallel circuit of the capacitor Cin and the diode Di2 is connected between the switching element Q3 and the smoothing capacitor. Each of those circuits of FIGS. 66 and 67 corresponds to the circuit of FIG. 60 to which is applied a full bridge inverter circuit capable of switching at a high speed between a mode, in which the switching elements Q1 and Q4 are turned off and switching elements Q2 and Q3 are turned off, and a mode in which the switching elements Q1 and Q4 are turned on and the switching elements Q2 and Q3 are turned on, so that a high frequency voltage of a rectangular waveform can be applied to a load resonant circuit. Even any of those circuits of FIGS. 66 and 67 is effective to suppress emission of heat resulting from the switching loss occurring in the switching elements (that is, the switching elements Q1 and Q2 in the case of FIG. 66 or the switching elements Q1, Q2, Q3 and Q4 in the case of FIG. 67) as is the case with the circuit of FIG. 60.

Figure 68A:
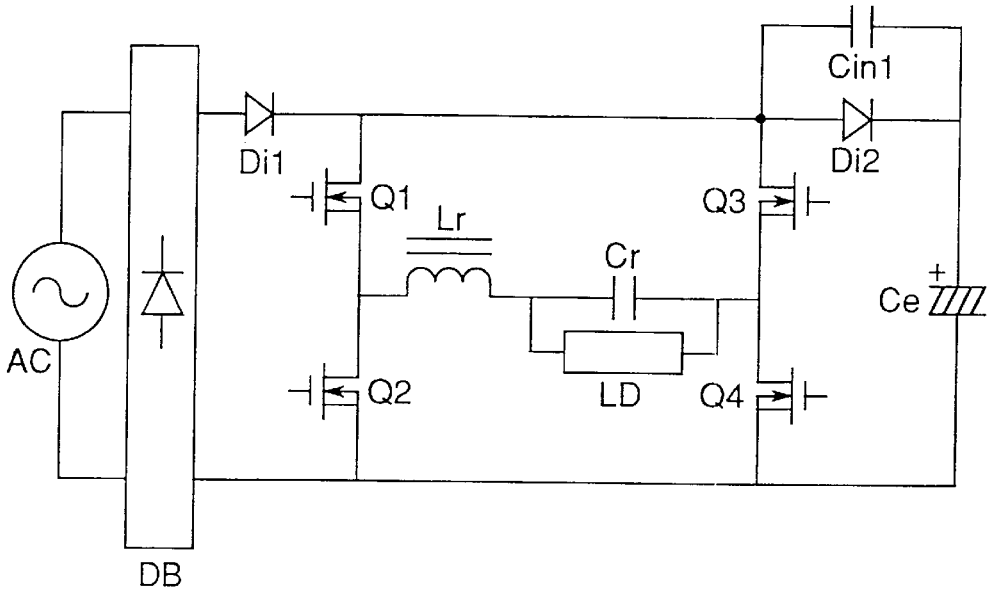
FIG. 68A is a circuit diagram showing a first example of the circuit in which the CSCP system of FIG. 60 is used to obtain a low frequency alternating current output.
Figure 68B:
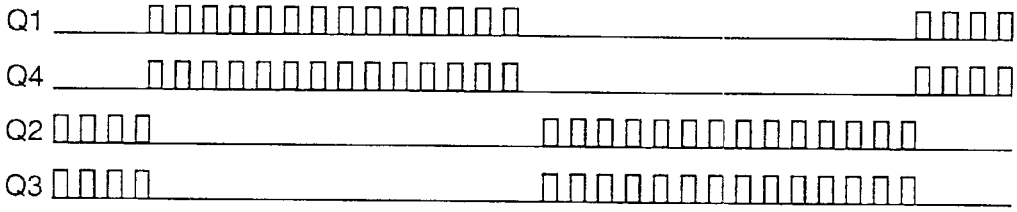
FIG. 68B is a diagram showing a timing of operation of switching elements used in the circuit of FIG. 68A.

A diagram of the circuit which provides the basis of the circuit example 8c is shown in FIG. 68A. The circuit of FIG. 68A is substantially similar to the circuit of FIG. 67, except that in place of the resonant capacitor Cr shown in FIG. 67 is replaced by a capacitor Cc. The capacitor Cc has a capacitance Cc considerably higher than the capacitance Cr of the resonant capacitor Cr, that is, Cc>>Cr, and the resonant frequency with the resonant inductor Lr is sufficiently lower than the switching frequency. Accordingly, an approximate DC voltage is generated across the capacitor Cc. The circuit of FIG. 68A has a mode, Mode A, in which the switching elements Q1 and Q4 are repeatedly turned on and off and the switching elements Q2 and Q3 remain turned off, and another mode, Mode B, in which the switching elements Q2 and Q3 are repeatedly turned on and off and the switching elements Q1 and Q4 remain turned off. FIG. 68B illustrates the timing of the switching elements Q1 to Q4 being turned on and off alternately. Hereinafter, the operation of the circuit of FIG. 68A for each mode will be described.

<Mode A>

A1: When the switching elements Q1 and Q4 are turned on, the smoothing capacitor Ce serves as a power source and the inductor current IL flows therefrom to the switching element Q4 through the switching element Q1, the resonant inductor Lr and the capacitor Cc while charging the charge capacitor Cin1.

A2; When the charge capacitor Cin is charged and the potential at the junction between the charge capacitor Cin and the switching element Q1 attains a value equal to the absolute value of the input voltage, the diode Di1 conducts and the inductor current IL consequently flow from the AC power source through the diode Di1 and the switching element Q1 and then flow into the switching element Q4 through the diode Di1, to thereby draw the input current.

A3; After the switching elements Q1 and Q4 are turned off, the respective stray diodes of the switching elements Q2 and Q3 conduct and inductor current IL consequently flows from the resonant inductor Lr back to the resonant inductor Lr through the capacitor Cc, the stray diode of the switching element q3, the charge capacitor Cin (discharge), the smoothing capacitor Ce and the stray diode of the switching element Q2.

A4; When the charge capacitor Cin is completely discharged, the diode Di2 connected parallel thereto conducts and the inductor current IL flows from the resonant inductor Lr back to the resonant inductor Lr through the capacitor Cc, the stray diode of the switching element Q3, the diode Di2, the smoothing capacitor Ce and the stray diode of the switching element Q2. When this current becomes zero, A1 is resumed.

<Mode B>

B1: When the switching elements Q2 and Q3 are turned on, the smoothing capacitor Ce serves as the power source and the inductor current IL flows therefrom to the switching element Q2 through the switching element Q3, the capacitor Cc and the resonant inductor Lr while charging the charge capacitor Cin.

B2; When as a result of charging of the charge capacitor Cin the potential at the junction between the charge capacitor Cin and the switching element Q3 attains a value equal to the absolute value of the input voltage, the diode Di1 conducts and the inductor current IL flows from the AC power source AC through the diode Di1 and the switching element Q3 and then flow into the switching element Q2 through the capacitor Cc and the resonant inductor Lr to thereby draw the input current.

B3; After the switching elements Q2 and Q3 are turned off, the stray diode of each of the switching elements Q1 and Q4 is turned on and the inductor current IL flows from the resonant inductor Lr back to the resonant inductor Lr through the stray diode of the switching element Q1, the charge capacitor Cin (discharge), the smoothing capacitor Ce, the stray diode of the switching element Q4 and the capacitor Cc.

B4; When the charge capacitor Cin is completely discharged, the diode Di2 connected parallel thereto conducts and the inductor current IL flows from the resonant inductor Lr back to the resonant inductor Lr through the stray diode of the switching element Q1, the diode Di2, the smoothing capacitor Ce, the stray diode of the switching element Q4 and the capacitor Cc. When this current becomes zero, Mode B1 is resumed.

By alternately repeating Modes A and B at a low frequency, a low frequency AC output voltage can be generated across the capacitor Cc.

Figure 69A:
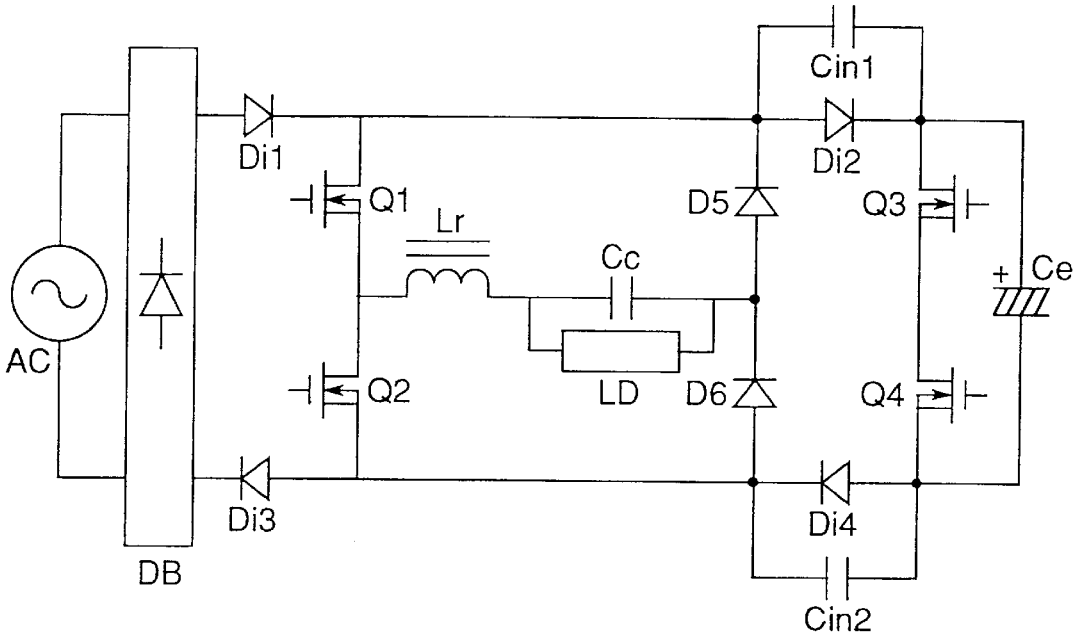
FIG. 69A is a circuit diagram showing the power source device according to a circuit example 8c of the present invention.
Figure 69B:
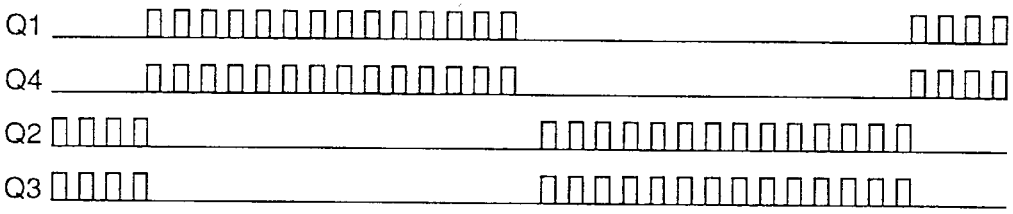
FIG. 69B is a diagram showing a timing of operation of switching elements used in the circuit of FIG. 69A.

A circuit diagram of the power source device according to the Circuit Example 8c is shown in FIG. 69A. The timing of the switching elements Q1 to Q4 being alternately switched on and off is shown in FIG. 69B. The circuit shown therein employs two sets of CSCP to which the previously discussed concept is applied. In other words, referring to FIG. 69A, it employs CSCP including a parallel circuit having the diode Di2 and the charge capacitor Cin1, and CSCP including a parallel circuit having the diode Di4 and the charge capacitor Cin2. The diodes D5 and D6 are employed for the purpose of avoiding interference between CSCPs. Even with this circuit, not only can the switching loss be reduced, but also any possible waveform deformation of the input current can be improved by obtaining the AC output voltage of a low frequency as is the case with the circuit shown in FIG. 68A.

8-2-4. Circuit Example 8d

Figure 70A:
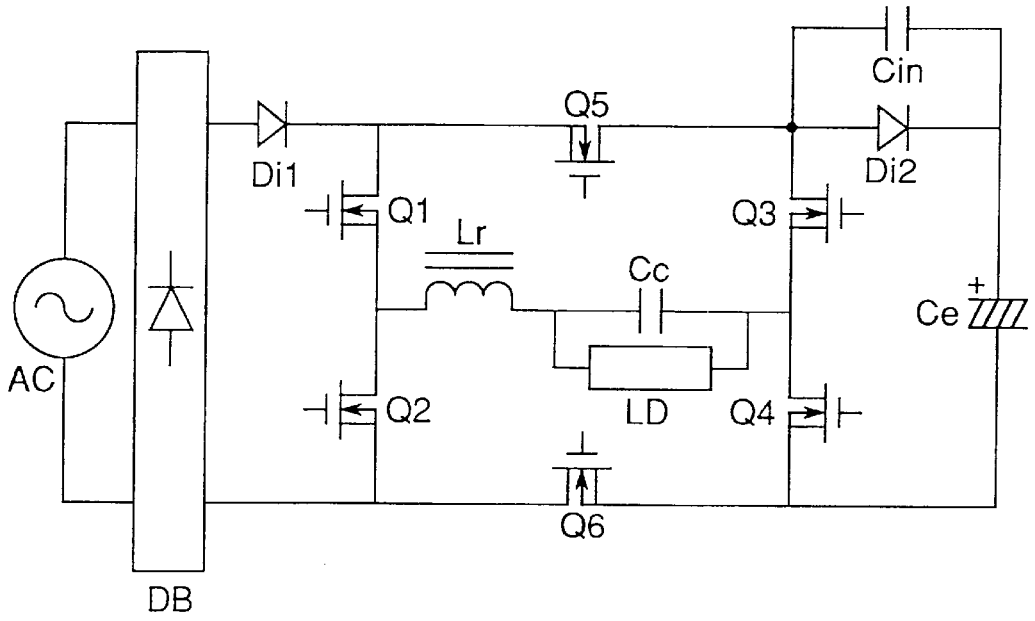
FIG. 70A is a circuit diagram showing a second example of the circuit in which the CSCP system of FIG. 60 is used to obtain a low frequency alternating current output.
Figure 70B:
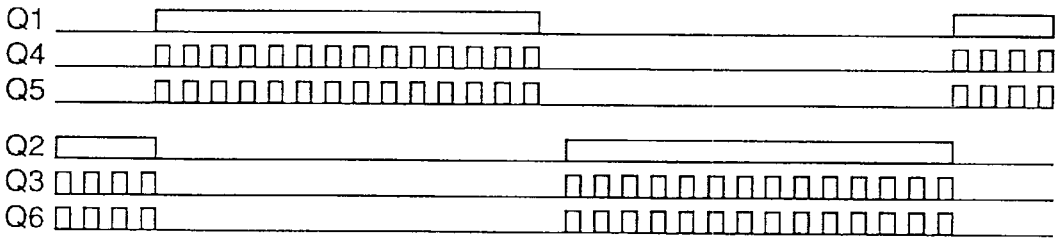
FIG. 70B is a diagram showing a timing of operation of switching elements used in the circuit of FIG. 70A.

A conceptual circuit different from the Circuit Example 8c is shown in FIG. 70A. The circuit shown in FIG. 70A is substantially similar to the circuit of FIG. 68A, but differs therefrom in that switching elements Q5 and Q6 are added to the circuit of FIG. 68A.

This circuit has two modes: Mode A in which the switching element Q1 is turned on at all times, the switching elements Q4 and Q5 are repeatedly turned on and off alternately, and the switching elements Q2, Q3 and Q6 are turned off at all times, and Mode B in which the switching element Q2 is turned on at all times, the switching elements Q3 and Q6 are repeatedly turned on and off alternately and the switching elements Q1, Q4 and Q5 are turned off at all times. FIG. 68B illustrates the timing at which the switching elements Q1 to Q6 are selectively turned on and off. Hereinafter, the operation of the circuit for each mode will be described in detail.

<Mode A>

A1: When the switching elements Q4 and Q5 are turned on, the smoothing capacitor Ce serves as the power source and the inductor current IL flows therefrom to the switching element Q4 through the switching element Q5, the switching element Q1, the resonant inductor Lr and the capacitor Cc while charging the charge capacitor Cin.

A2; When as a result of charging of the charge capacitor Cin the potential at the junction between the charge capacitor Cin and the switching element Q1 (the switching element Q5 being shortcircuitted) attains a value equal to the absolute value of the input voltage, the diode Di1 conducts and the inductor current flows from the AC power source AC through the diode Di1 and the switching element Q1 and then flows into the stray diode of the switching element Q6 from the resonant inductor Lr through the capacitor Cc and the switching element Q4, to thereby draw the input current.

A3; After the switching elements Q4 and Q5 are turned off, the stray diode of each of the switching elements Q3 and Q6 is turned on and the inductor current IL flows from the resonant inductor Lr back to the resonant inductor Lr through the capacitor Cc, the stray diode of the switching element Q3, the charge capacitor Cin (discharge), the smoothing capacitor Ce, the stray diode of the switching element Q6, the rectifier element DB, the AC power source AC, the rectifier element DB, the diode Di1 and the switching element Q1, to thereby draw the input current.

A4; When the charge capacitor is completely discharged, the diode Di2 connected parallel thereto conducts and the inductor current IL flows from the resonant inductor Lr back to the resonant inductor Lr through the capacitor Cc, the stray diode of the switching element Q3, the diode Di2, the smoothing capacitor Ce, the stray diode of the switching element Q6, the rectifier element DB, the AC power source AC, the rectifier element DB, the diode Di1 and the switching element Q1, to thereby draw the input current. When this current becomes zero, Mode A1 is resumed.

<Mode B>

B1: When the switching elements Q3 and Q6 are turned on, the smoothing capacitor Ce serves as the power source and the inductor current IL flows therefrom to the switching element Q6 through the switching element Q3, the capacitor Cc, the resonant inductor Lr, the switching element Q2 and the switching element Q6 while charging the charge capacitor Cin.

B2; When as a result of charging of the charge capacitor Cin the potential at the junction between the charge capacitor Cin and the switching element Q3 attains a value equal to the absolute value of the input voltage, the diode Di1 conducts and the inductor current IL flows from the AC power source AC through the diode Di1, the stray diode of the switching element Q5 and the switching element Q3 and then flow into the switching element Q2 through the capacitor Cc, the resonant inductor Lr and the switching element Q2 to thereby draw the input current.

B3; After the switching elements Q3 and Q6 are turned off, the stray diode of each of the switching elements Q4 and Q5 is turned on and the inductor current IL flows from the resonant inductor Lr back to the resonant inductor Lr through the switching element Q2, the rectifier element DB, the AC power source AC, the rectifier element DB, the diode Di1, the stray diode of the switching element Q5, the charge capacitor Cin (discharge), the smoothing capacitor Ce, the stray diode of the switching element Q4 and the capacitor Cc.

B4; When the charge capacitor Cin is completely discharged, the diode Di2 connected parallel thereto conducts and the inductor current IL flows from the resonant inductor Lr back to the resonant inductor Lr through the switching element Q2, the rectifier element DB, the AC power source AC, the rectifier element DB, the diode Di1, the stray diode of the switching element Q5, the diode Di2, the smoothing capacitor Ce, the stray diode of the switching element Q4 and the capacitor Cc. When this current becomes zero, Mode B1 is resumed.

By alternately repeating Modes A and B at a low frequency, a low frequency AC output voltage can be generated across the capacitor Cc.

Figure 71A:
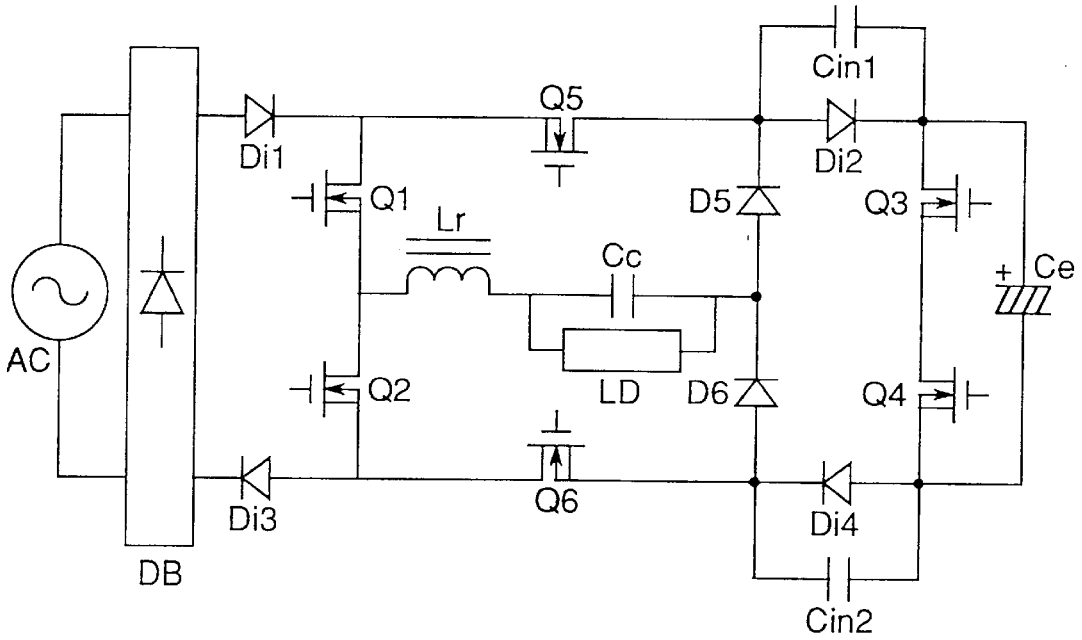
FIG. 71A is a circuit diagram showing the power source device according to a circuit example 8d of the present invention.
Figure 71B:
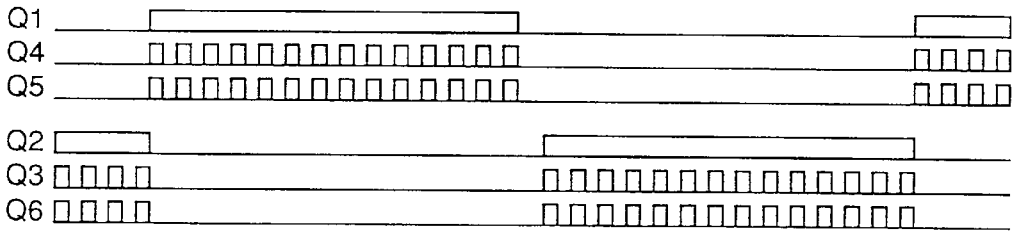
FIG. 71B is a diagram showing a timing of operation of switching elements used in the circuit of FIG. 71A.

A circuit diagram of the power source device according to the Circuit Example 8d is shown in FIG. 71A. The timing of the switching elements Q1 to Q4 being alternately switched on and off is shown in FIG. 71B. The circuit shown therein employs two sets of CSCP to which the previously discussed concept is applied. In other words, referring to FIG. 70A, it employs CSCP including a parallel circuit having the diode Di2 and the charge capacitor Cin1, and CSCP including a parallel circuit having the diode Di4 and the charge capacitor Cin2. The diodes D5 and D6 are employed for the purpose of avoiding interference between CSCPs. Even with this circuit, not only can the switching loss be reduced, but also any possible waveform deformation of the input current can be improved by obtaining the AC output voltage of a low frequency as is the case with the circuit shown in FIG. 68A.

8-3. Summary B

Hereinafter, description will be made of how an effective PFC means can be realized by adding VSCP, which utilizes the high frequency voltage oscillation in the circuit, to the basic circuit including CSCP as shown in FIG. 60.

8-4. Circuit Structures B 8-4-1. Circuit Example 8e

Figure 72:
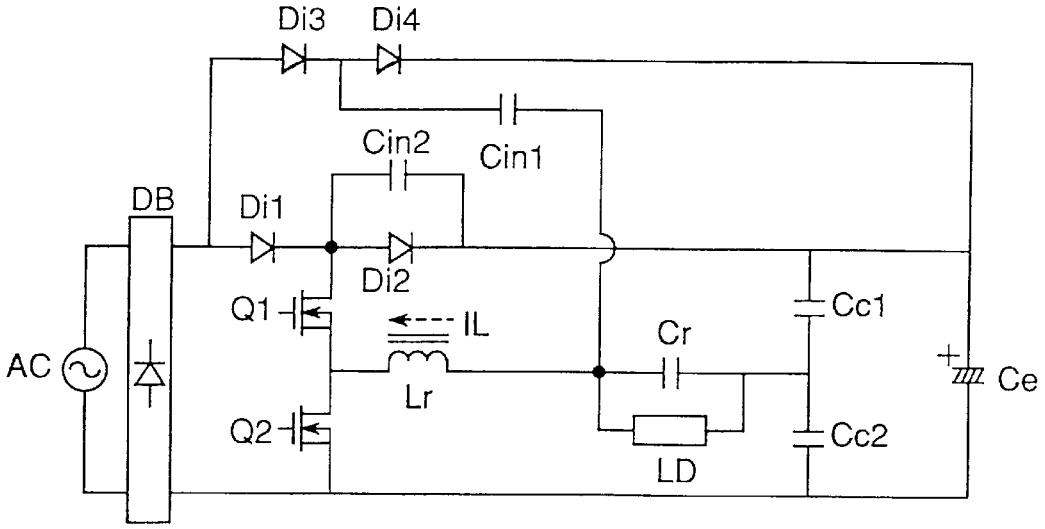
FIGS. 72 to 76 are circuit diagrams showing the power source device according to respective circuit examples 8e to 8i of the present invention.

A circuit diagram of the power source device according to this circuit example is shown in FIG. 72. This circuit is substantially similar to the circuit shown in FIG. 60, except that VSCP (including the diodes Di3 and Di4 and the charge capacitor Cin1) described in connection with the Prior Art 1 is added to the circuit of FIG. 60. In other words, the circuit of FIG. 72 corresponds the circuit of FIG. 60 in which the diodes Di3 and Di4 are connected in series with each other and between the high voltage output end of the rectifier element DB and a high voltage side of the smoothing capacitor Ce and a junction between the diodes Di3 and Di4 is connected with a junction between the resonant inductor Lr and the resonant capacitor Cr through the capacitor Cin. The circuit of FIG. 72 is so designed that the period during which the input current flows can be expanded to reduce the resonant current, thereby making it possible to accomplish downscaling of component parts and devices and also to provide the inexpensive power source device. Hereinafter, the operation thereof will be described.

Mode 1;

When the inductor current IL starts flowing in the negative direction and the switching element Q1 is turned on, the DC voltage Vcc1 of the capacitor Cc1 serves as a power source and the inductor current IL flows therefrom to the resonant capacitor Cr and the load LD through the switching element Q1 and the resonant inductor Lr while charging the charge capacitor Cin. When during this mode the potential at the high voltage side of the charge capacitor Cin1 attains a value equal to the voltage across the smoothing capacitor Ce, the diode Di4 conducts and the inductor current flows from the charge capacitor Cin1 to the resonant inductor Lr through the diode Di4, the charge capacitor Cin2 and the switching element Q1, causing the charge capacitor Cin1 to discharge.

Mode 2;

When the charge capacitor Cin2 is charged to an extent that the potential at the junction between the charge capacitor Cin2 and the switching element Q1 attains a value equal to the absolute value of the input voltage, the diode Di1 conducts and the inductor current IL flows from the AC power source AC to the switching element Q1 through the diode Di1 and then flows into the resonant capacitor Cr and the load Ld and then into the capacitor Cc2 to thereby draw the input current. Similarly, when during this mode the potential at the high voltage side of the charge capacitor Cin1 attains a value equal to the voltage across the smoothing capacitor Ce, the diode Di4 conducts and the inductor current IL flows from the charge capacitor Cin1 to the resonant inductor Lr through the diode Di4, the smoothing capacitor, the AC power source AC, the diode Di1 and the switching element Q1, causing the charge capacitor Cin1 to discharge so that the input current can be drawn.

Mode 3;

After the switching element Q1 is turned off, the stray diode of the switching element Q2 conducts and the inductor current IL flows from the resonant inductor Lr back to the resonant inductor Lr through the resonant capacitor Cr and the load LD, the capacitor Cc2, and the stray diode of the switching element Q2. Also, the inductor current IL flows through the diode Di4, the smoothing capacitor Ce and the stray diode of the switching element Q2 while causing the charge capacitor Cin1 to discharge.

Mode 4;

When the inductor current IL becomes zero and starts flowing in the positive direction, the capacitor Cc2 serves as the power source and the inductor current IL flows from the resonant capacitor Cr and the load LD to the switching element Q2 through the resonant inductor Lr. During this mode the resonant capacitor Cr is discharged by the inductor current IL with the potential at the high voltage side of the resonant capacitor Cr consequently reduced, and when the potential at the high voltage side of the charge capacitor Cin1 subsequently attains a value equal to the absolute value of the input voltage, the diode Di3 conducts and the current flows from the resonant inductor Lr to the switching element Q2 while charging the charge capacitor Cin1, to thereby draw the input current.

Mode 5;

When the switching element Q2 is turned of, the inductor current IL flows back to the resonant inductor Lr through the capacitor Cc1 and the resonant capacitor Cr and the load LD while causing the charge capacitor Cin2 to discharge through the stray diode of the switching element Q1. Similarly, when during this mode the potential at the high voltage side of the charge capacitor Cin1 attains a value equal to the absolute value of the input voltage, the diode Di3 conducts and the current flows from the resonant inductor Lr to the rectifier element DB through the smoothing capacitor Ce while causing the charge capacitor Cin1 to charge from the AC power source AC through the rectifier element DB and the diode Di3 and, at the same, causing the charge capacitor Cin2 to discharge through the resonant inductor Lr and the stray diode of the switching element Q1, thereby drawing the input current.

Mode 6;

When the potential on the charge capacitor Cin2 is completely discharged with the voltage consequently zeroed, the diode Di2 connected parallel thereto conducts and the current flows back to the resonant inductor Lr through the stray diode of the switching element Q1, the diode Di2, the capacitor Cc1 and the resonant capacitor Cr and the load LD. Similarly, when during this mode the potential at the high voltage side of the charge capacitor Cin1 attains a value equal to the absolute value of the input voltage, the diode Di3 conducts and the current flows from the resonant inductor Lr to the rectifier element DB through the stray diode of the switching element Q1, the diode Di2 and the smoothing capacitor Ce while causing the charge capacitor Cin1 to be charged by the AC power source AC through the rectifier element DB and the diode Di3, thereby drawing the input current.

Due to the effect brought about by the circuit of FIG. 60, not only can the input current be drawn during Mode 2, but the input current can further be drawn by charging of the charge capacitor Cin1 during any one of Modes 4, 5 and 6.

8-4-2. Circuit Example 8f

Figure 73:
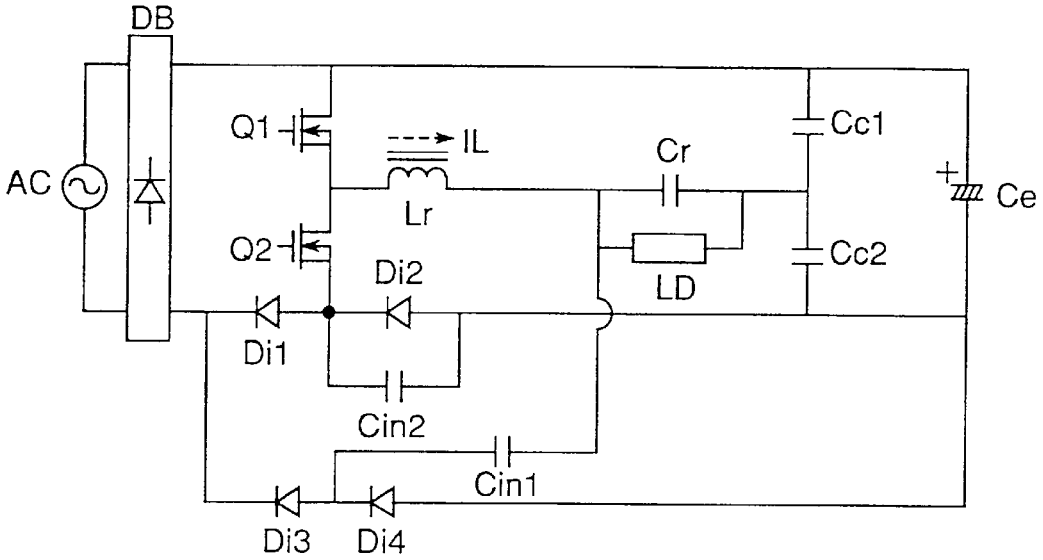

A circuit diagram of the power source device according to this circuit example is shown in FIG. 73, which is substantially similar to the circuit of FIG. 72 except that the circuit construction other than the switching elements Q1 and Q2 and the smoothing capacitor Ce, disposed on a high voltage side of the smoothing capacitor Ce in the circuit of FIG. 72, is symmetrically disposed on a low voltage (ground) side of the smoothing capacitor Ce with respect to a junction between the switching elements Q1 and Q2.

8-4-3. Circuit Example 8g

Figure 74:
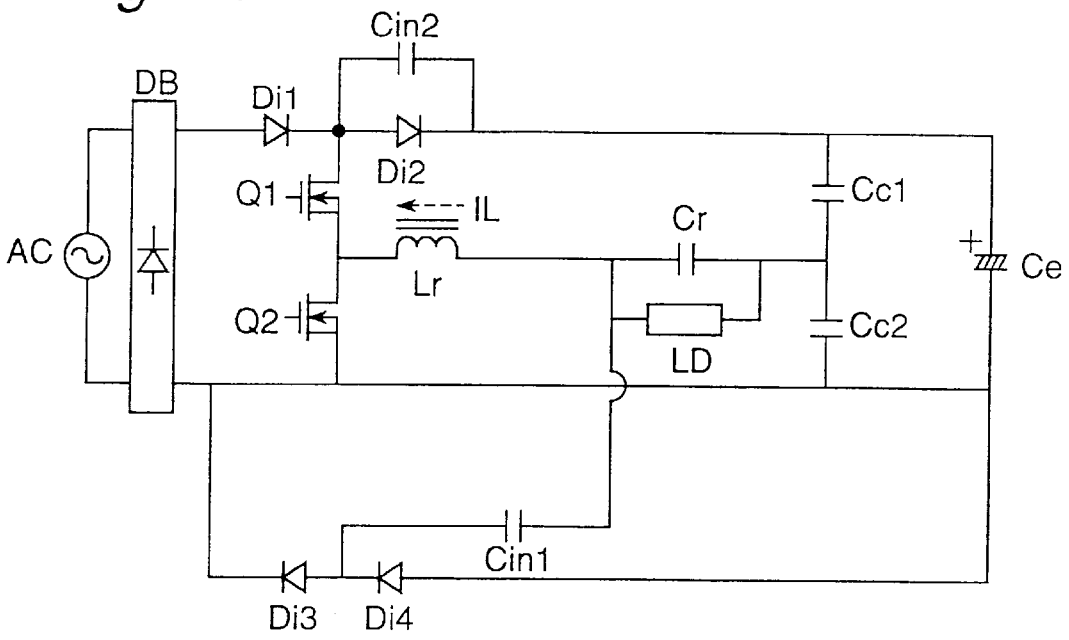

A circuit diagram of the power source device according to this circuit example is shown in FIG. 74. The circuit of FIG. 74 corresponds to the basic circuit of FIG. 60 combined with VSCP discussed in connection with the Prior Art 1. In other words, in accordance with this circuit example, the basic circuit of FIG. 6 is modified to have the diodes Di3 and Di4 connected in series with each other and between the high voltage output end of the rectifier element DB and a high voltage side of the smoothing capacitor Ce and, also, the capacitor Cin connected at one end with a junction between the diodes Di3 and Di4 and at the opposite end a junction between the resonant inductor Lr and the resonant capacitor Cr. The operation of the circuit of FIG. 74 will now be described.

Mode 1;

When the inductor current IL starts flowing in the negative direction and the switching element Q1 is turned on, the DC voltage Vcc1 of the capacitor Cc1 serves as a power source and the inductor current IL flows therefrom to the resonant capacitor Cr and the load LD through the switching element Q1 and the resonant inductor Lr while charging the charge capacitor Cin2. When during this mode the resonant capacitor Cr is charged accompanied by increase of the voltage on the resonant capacitor Cr and the potential at the junction between the charge capacitor Cin1 and the diodes Di3 and Di4 attains a ground potential, the diode Di3 conducts and the current flows from the AC power source AC to the resonant inductor Lr through the rectifier element DB, the diode Di1 and the switching element Q1, causing the charge capacitor Cin1 to discharge to thereby draw the input current.

Mode 2;

When the charge capacitor Cin2 is charged to an extent that the potential at the junction between the charge capacitor Cin2 and the switching element Q1 attains a value equal to the absolute value of the input voltage, the diode Di1 conducts and the inductor current IL flows from the AC power source AC to the switching element Q1 through the diode Di1 and then flows into the capacitor Cc2 through the resonant capacitor Cr and the load Ld to thereby draw the input current. Similarly, when during this mode the potential at the junction between the charge capacitor Cin1 and the diodes Di3 and Di4 attains the ground potential, the diode Di3 conducts and the current flows from the AC power source AC to the resonant inductor Lr through the rectifier element DB, the diode Di1 and the switching element Q1, causing the charge capacitor Cin1 to discharge to thereby draw the input current.

Mode 3;

After the switching element Q1 is turned off, the stray diode of the switching element Q2 conducts and the inductor current IL flows from the resonant inductor Lr back to the resonant inductor Lr through the resonant capacitor Cr and the load LD, the capacitor Cc2 and the stray diode of the switching element Q2. Also, the inductor current IL flows from the diode Di3 to the resonant inductor Lr through the AC power source AC, the rectifier element DB, the diode DI1, the charge capacitor Cin2, the smoothing capacitor and the stray diode of the switching element Q2 while causing the charge capacitor Cin1 to discharge, to thereby draw the input current.

Mode 4;

When the inductor current IL becomes zero and starts flowing in the positive direction, the capacitor Cc2 serves as the power source and the inductor current IL flows from the resonant capacitor Cr and the load LD to the switching element Q2 through the resonant inductor Lr. When during this mode the resonant capacitor Cr is discharged by the inductor current IL with the potential at the high voltage side of the resonant capacitor Cr consequently reduced to such an extent that the voltage across the charge capacitor Cin1 attains a value equal to the sum of the voltage Vcc2 on the capacitor Cc2 and the voltage Vcr on the resonant capacitor Cr, the diode Di4 conducts so that the charge capacitor Cin1 can serves as a power source and the current can flow from the resonant inductor Lr to the diode Di4 through the switching element Q2 to cause the resonant inductor Lr to accumulate energies.

Mode 5;

When the switching element Q2 is turned of, the inductor current IL flows back to the resonant inductor Lr through the capacitor Cc1 and the resonant capacitor Cr and the load LD while causing the charge capacitor Cin2 to discharge through the stray diode of the switching element Q1. Similarly, when during this mode the voltage across the charge capacitor Cin1 attains a value equal to the sum of the voltage Vcc1 on the capacitor Cc2 and the voltage Vcr on the resonant capacitor Cr, the diode Di4 conducts and the current flows from the charge capacitor Cin1, then serving as a power source, to the diode Di4 through the resonant inductor Lr, the stray diode of the switching element Q1, the charge capacitor Cin2 (discharge) and the smoothing capacitor Ce to cause the resonant inductor Lr to accumulate energies.

Mode 6;

When the potential on the charge capacitor Cin2 is completely discharged with the voltage consequently zeroed, the diode Di2 connected parallel thereto conducts and the current flows back to the resonant inductor Lr through the stray diode of the switching element Q1, the diode Di2, the capacitor Cc1 and the resonant capacitor Cr and the load LD. Similarly, when during this mode the voltage across the charge capacitor Cin1 attains a value equal to the sum of the voltage Vccl on the capacitor Cc2 and the voltage Vcr on the resonant capacitor Cr, the diode Di4 conducts and the current flows from the charge capacitor Cin1, then serving as a power source, to the diode Di4 through the resonant inductor Lr, the stray diode of the switching element Q1, the charge capacitor Cin2 and the smoothing capacitor Ce to cause the resonant inductor Lr to accumulate energies.

Due to the effect brought about by the circuit of FIG. 60, not only can the input current be drawn during Mode 2, but the input current can further be drawn by charging of the charge capacitor Cin1 during any one of Modes 1, 2 and 3.

8-4-4. Circuit Example 8h

Figure 75:
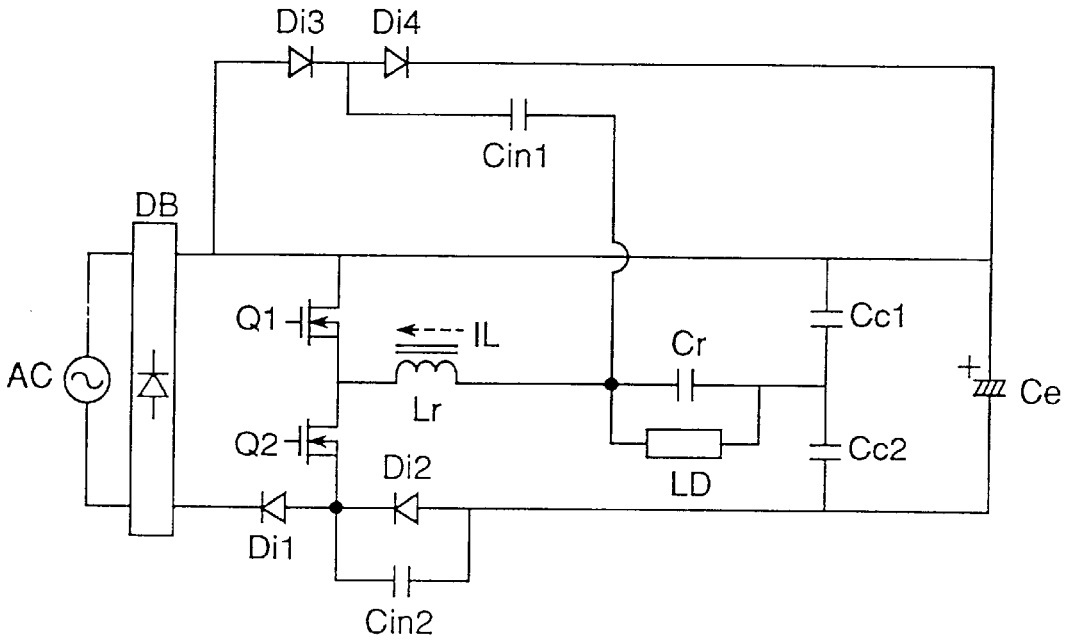

A circuit diagram of the power source device according to this circuit example is shown in FIG. 75, which is substantially similar to the circuit of FIG. 74 except that the circuit construction other than the switching elements Q1 and Q2 and the smoothing capacitor Ce, disposed on a high voltage side of the smoothing capacitor Ce in the circuit of FIG. 74, is symmetrically disposed on a low voltage (ground) side of the smoothing capacitor Ce with respect to a junction between the switching elements Q1 and Q2.

8-4-5. Circuit Example 8i

Figure 76:
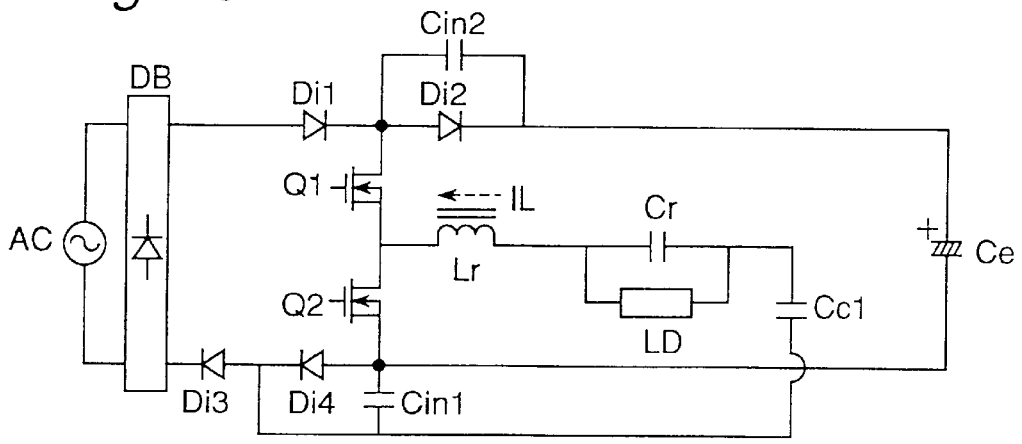

A circuit diagram of the power source device according to this circuit example is shown in FIG. 76. The circuit of FIG. 76 corresponds to the basic circuit of FIG. 60 combined with CSCP discussed in connection with the Prior Art 2. In the circuit of FIG. 60, CSCP discussed in connection with the Prior Art 2 comprises diodes Di3 and Di4 and a charge capacitor Cin1. The operation of the circuit of FIG. 76 will now be described.

Mode 1;

When the inductor current IL starts flowing in the negative direction and the switching element Q1 is turned on, the smoothing capacitor Ce serves as a power source and the inductor current IL flows therefrom to the capacitor Cc1 through the switching element Q1, the resonant inductor Lr and the resonant capacitor Cr and the load LD while charging the charge capacitor Cin1. This inductor current IL returns to the smoothing capacitor Ce while charging the charge capacitor Cin1. This mode is maintained until the sum of the voltage across the charge capacitor Cin1 and the absolute value of the input voltage attains a value equal to the difference between the voltage Vce on the smoothing capacitor Ce and the voltage Vcin2 on the charge capacitor Cin2.

Mode 2;

When the charge capacitors Cin1 and Cin2 are charged and the sum of the voltage across the charge capacitor Cin1 and the absolute value of the input voltage attains a value equal to the difference between the voltages Vce and Vcin2, the diodes Di1 and Di3 conduct and the inductor current IL flows in the negative direction from the AC power source AC to the switching element Q1 through the diode Di1 and then into the capacitor Cc1 through the resonant capacitor Cr and the load Ld, thereby drawing the input current.

Mode 3;

After the switching element Q1 is turned off, the inductor current IL flowing in the negative direction flows from the resonant capacitor Cr and the load Ld to the stray diode of the switching element Q2 through the capacitor Cc1, the diode Di3, the AC power source AC, the diode Di1, the charge capacitor Cin2 (discharge) and the smoothing capacitor Ce, to thereby draw the input current.

Mode 4;

When the inductor current IL becomes zero and starts flowing in the positive direction, the capacitor Cc2 serves as the power source and the inductor current IL flows from the resonant capacitor Cr and the load LD to the switching element Q2 through the resonant inductor Lr while causing the charge capacitor Cin1 to discharge.

Mode 5;

When the charge capacitor Cin1 is completely discharged, the diode Di4 connected parallel thereto conducts and the current flows from the capacitor Cc1 to the diode Di4 through the resonant capacitor Cr and the load LD, the resonant inductor Lr and the switching element Q2.

Mode 6;

When the switching element Q2 is turned off, the inductor current IL returns to the resonant inductor Lr through the smoothing capacitor Ce, the diode Di4, the capacitor Cc1 and the resonant capacitor Cr and the load LD while causing the charge capacitor Cin2 to discharge through the stray diode of the switching element Q1.

Mode 7;

When the potential of the charge capacitor Cin2 is completely discharged with the voltage consequently zeroed, the diode D2 connected parallel thereto conducts and the inductor current IL returns to the resonant inductor Lr through the stray diode of the switching element Q, the diode Di2, the smoothing capacitor Ce, the diode Di4, the capacitor Cc1 and the resonant capacitor Cr and the load LD.

According to the circuit shown in FIG. 76, not only can the input current be drawn by the effect brought about by the circuit of FIG. 60, but also the input current can further be drawn by the effect of CSCP discussed in connection with the Prior Art 2.

Figure 77:
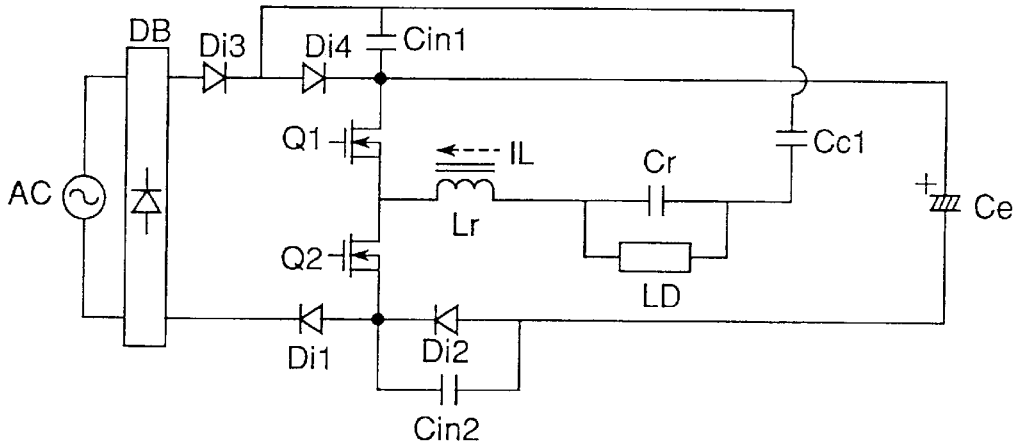
FIG. 77 is a circuit diagram showing the circuit similar to the circuit shown in FIG. 76 in which a circuit construction assumes a symmetrical relation with respect to upper and lower portions thereof.
Figure 78:
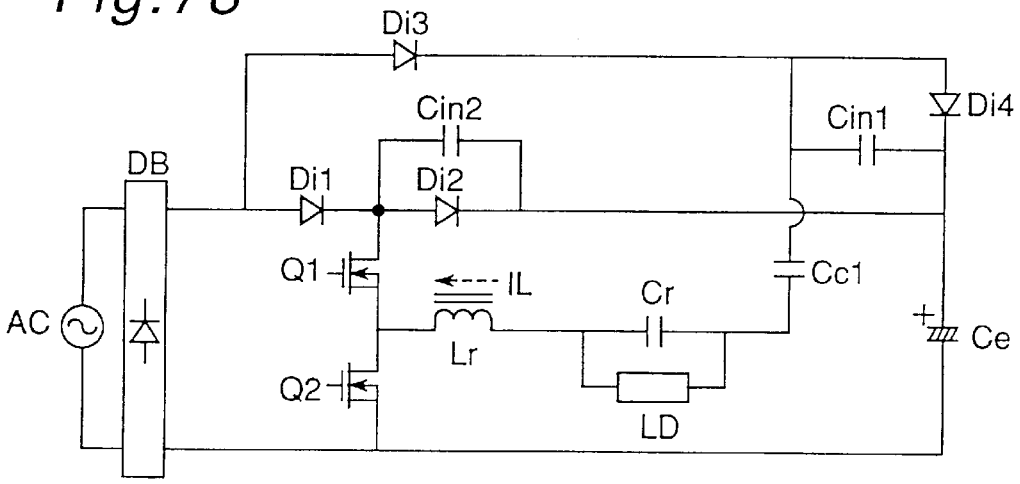
FIG. 78 is a circuit diagram showing the circuit of FIG. 60 combined with the CSCP system according to the Prior Art 2.

Also, even though the circuit construction other than the switching elements Q1 and Q2 and the smoothing capacitor Ce, disposed on a high voltage side of the smoothing capacitor Ce in the circuit of FIG. 76, is symmetrically disposed on a low voltage (ground) side of the smoothing capacitor Ce with respect to a junction between the switching elements Q1 and Q2 as shown in FIG. 77, or even though CSCP including the diodes Di3 and Di4 and the charge capacitor Cin1 is connected to the high voltage (positive pole) of the rectifier element DB as shown in FIG. 78, similar effects can be obtained.

8-4-6. Circuit Example 8j

Figure 79:
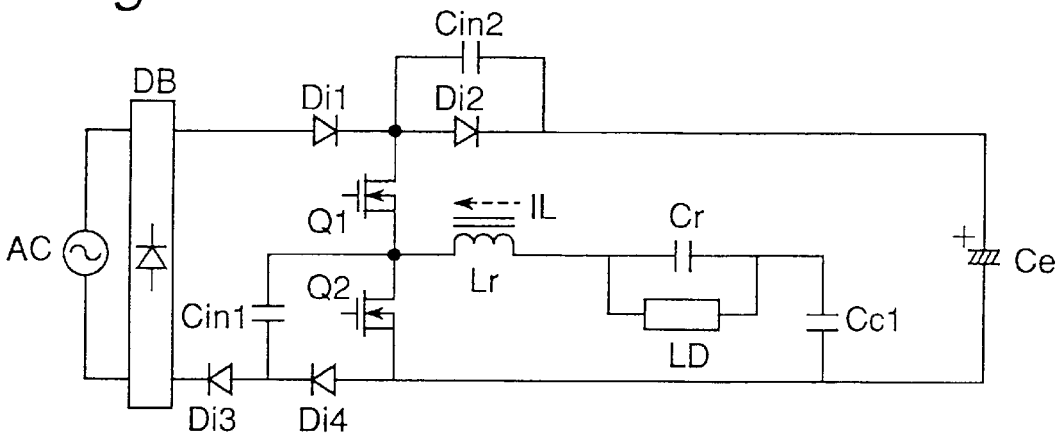
FIG. 79 is a circuit diagram showing the power source device according to a circuit example 8j of the present invention.

A circuit diagram of the power source device according to this circuit example is shown in FIG. 79. The circuit of FIG. 79 corresponds to the basic circuit of FIG. 60 combined with CSCP disclosed in the U.S. Pat. No. 5,488,269. In the circuit of FIG. 79, CSCP disclosed in the U.S. Pat. No. 5,488,269 comprises diodes Di3 and Di4 and a charge capacitor Cin1. The operation of the circuit of FIG. 74 will now be described.

Mode 1;

When the inductor current IL starts flowing in the negative direction and the switching element Q1 is turned on, the smoothing capacitor Ce serves as a power source and the inductor current IL flows therefrom to the capacitor Cc1 through the switching element Q1, the resonant inductor Lr and the resonant capacitor Cr and the load LD while charging the charge capacitor Cin2.

Mode 2;

When the charge capacitor Cin2 is charged and the potential at the junction between the charge capacitor Cin2 and the diode Di1 attains a value equal to the absolute value of the input voltage, the diodes Di1, Di3 and Di4 conduct and the inductor current IL flows in the negative direction from the AC power source AC to the switching element Q1 through the diode Di1 and then into the capacitor Cc1 through the resonant capacitor Cr and the load Ld, thereby drawing the input current.

Mode 3;

After the switching element Q1 is turned off, the inductor current IL flowing in the negative direction flows from the resonant capacitor Cr and the load Ld to the resonant inductor IL through the capacitor Cc1, the diode Di4 and the charge capacitor Cin1 (discharge) and the potential across the switching element Q2 consequently rises slowly.

Mode 4;

When the charge capacitor Cin1 is completely discharged, the inductor current IL flows from the resonant capacitor Cr and the load LD to the resonant inductor Lr through the capacitor Cc1 and the stray diode of the switching element Q2.

Mode 5;

When the inductor current IL becomes zero and starts flowing in the positive direction, the capacitor Cc1 serves as the power source and the inductor current flows from the resonant capacitor Cr and the load LD to the switching element Q2 through the resonant inductor Lr.

Mode 6;

When the switching element Q2 is turned off, the inductor current IL returns to the resonant inductor Lr through the charge capacitor Ci1, the diode Di3, the AC power source AC, the rectifier element DB, the diode Di1, the charge capacitor Ci2 (discharge) and the smoothing capacitor Ce as the input current while causing the charge capacitor Cin1 to discharge and then returns to the resonant inductor Lr through the capacitor Cc1 and the resonant capacitor Cr and the load LD.

Mode 7;

When the charge capacitor Cin1 is charged and the voltage across the charge capacitor Cin1 attains a value equal to the difference between the voltages Vce and Vci2, the inductor current IL causes the charge capacitor Ci2 to discharge through the stray diode of the switching element Q1 and then returns to the resonant inductor Lr through the capacitor Cc1 and the resonant capacitor Cr and the load LD.

Mode 8;

When the potential on the charge capacitor is completely discharged with the voltage consequently zeroed, the diode D2 connected parallel thereto conducts and the inductor current IL returns to the resonant inductor Lr through the stray diode of the switching element Q1, the diode Di2, the smoothing capacitor Ce, the capacitor Cc1 and the resonant capacitor Cr and the load LD.

According to the circuit shown in FIG. 79, the period of conduction of the input current during one cycle of the inductor current IL expands as compared with that exhibited by the circuit shown in FIG. 60. By combining the resonant circuits for the various modes, the capacitance of the resonant capacitor Cr can be minimized to thereby reduce the low frequency ripple appearing in the output.

Figure 80:
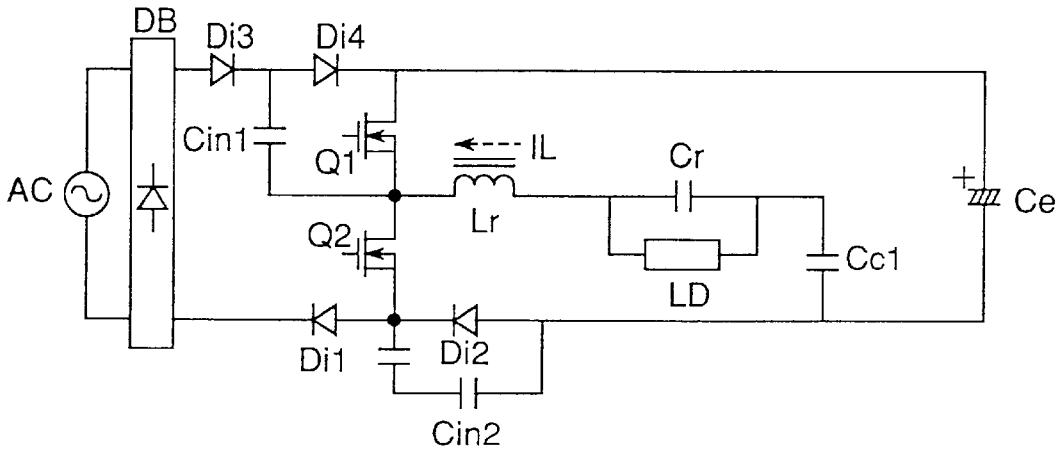
FIG. 80 is a circuit diagram showing the circuit similar to the circuit of FIG. 79 in which a circuit construction assumes a symmetrical relation with respect to upper and lower portions thereof.
Figure 81:
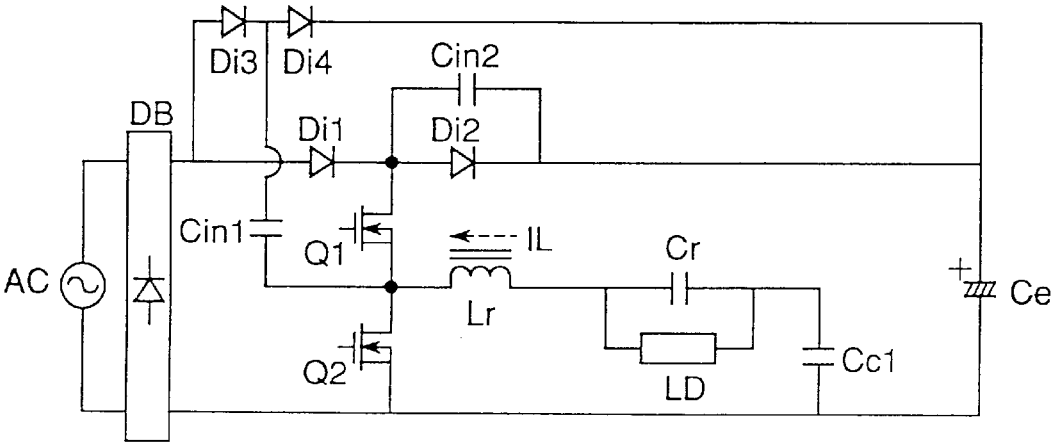
FIG. 81 is a circuit diagram showing the circuit of FIG. 60 combined with the CSCP system disclosed in the U.S. Pat. No. 5,488,269.
Figure 82:
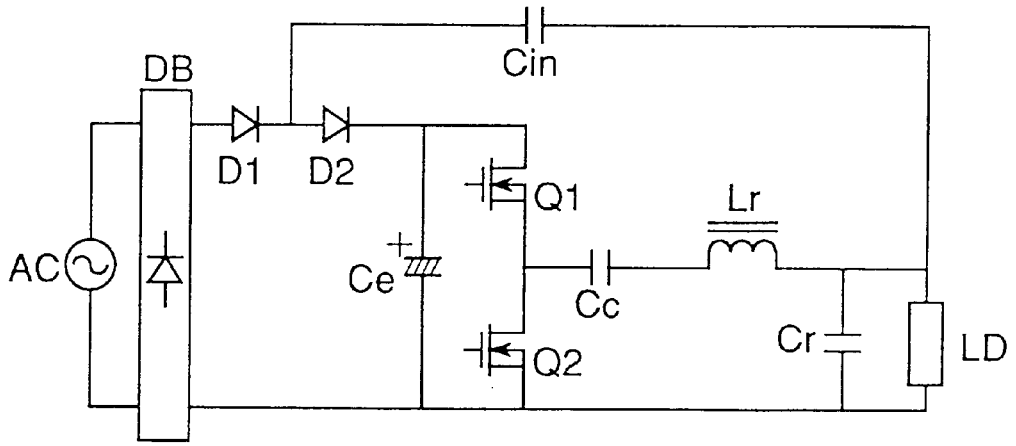
Fig.82 PRIOR ART
FIG. 82 is a circuit diagram showing the power source device according to the Prior Art 1.
Figure 83:
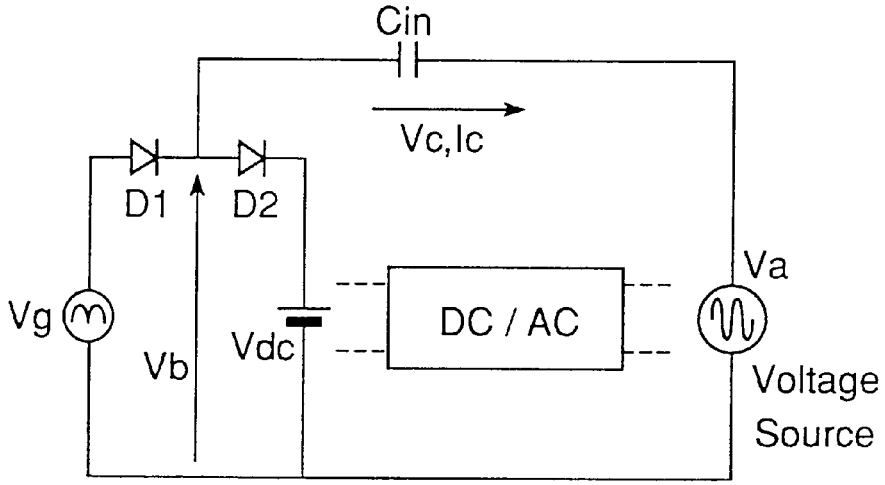
Fig.83 PRIOR ART
FIG. 83 is a circuit diagram showing an equivalent circuit of the power source device according to the Prior Art 1 from which a PFC function section is removed.
Figure 84A:
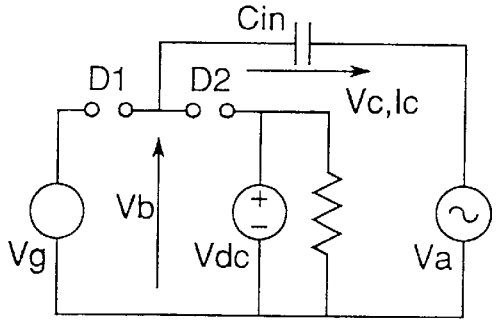
FIGS. 84A to 84D are circuit diagrams showing respective equivalent circuits of the power source device according to the Prior Art 1 for associated modes of operation thereof.
Figure 84B:
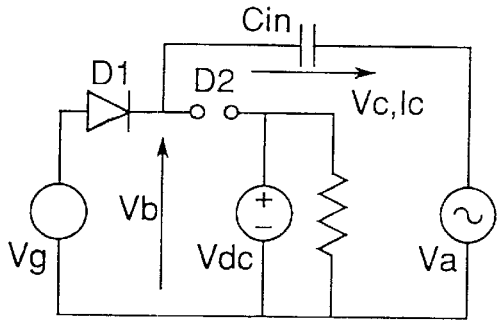
Figure 84C:
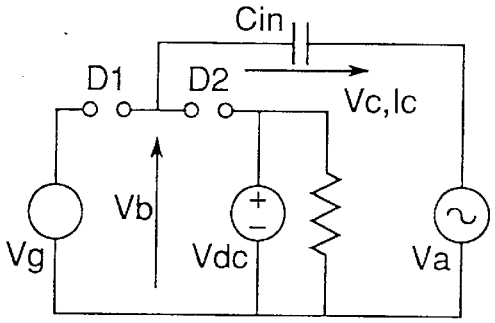
Figure 84D:
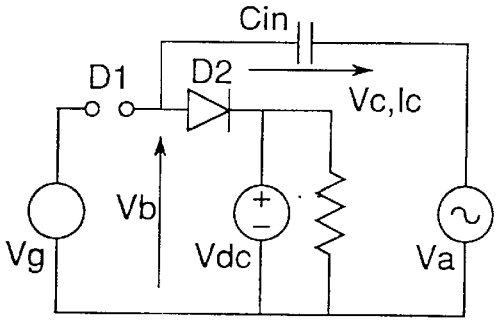
Figure 84E:
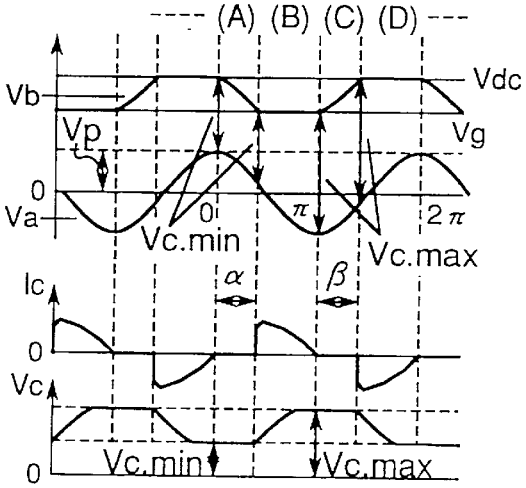
FIG. 84E is a diagram showing voltage and current waveforms in various parts in the power source device according to the Prior Art 1.
Figure 85:
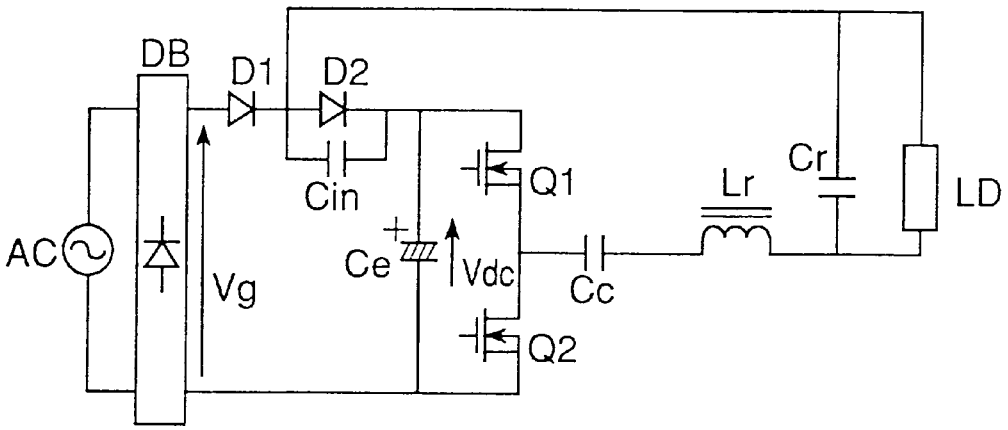
Fig.85 PRIOR ART
FIG. 85 is a circuit diagram showing the power source device according to the Prior Art 2.
Figure 86:
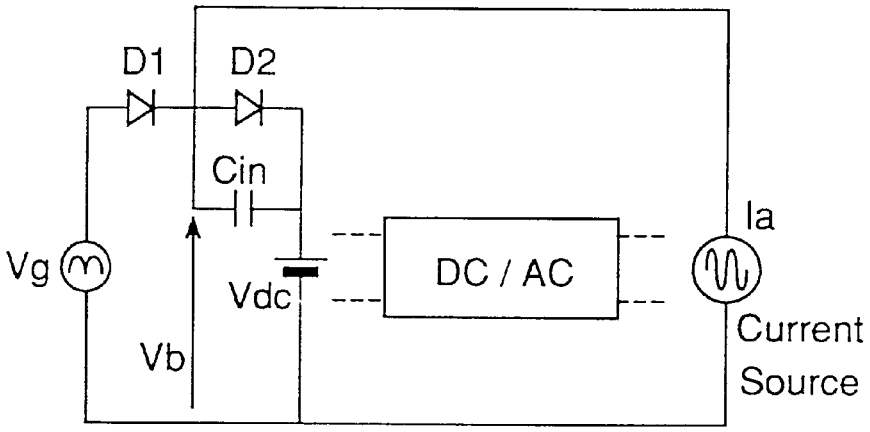
Fig.86 PRIOR ART
FIG. 86 is a circuit diagram showing an equivalent circuit of the power source device according to the Prior Art 2 from which a PFC function section is removed.
Figure 87:
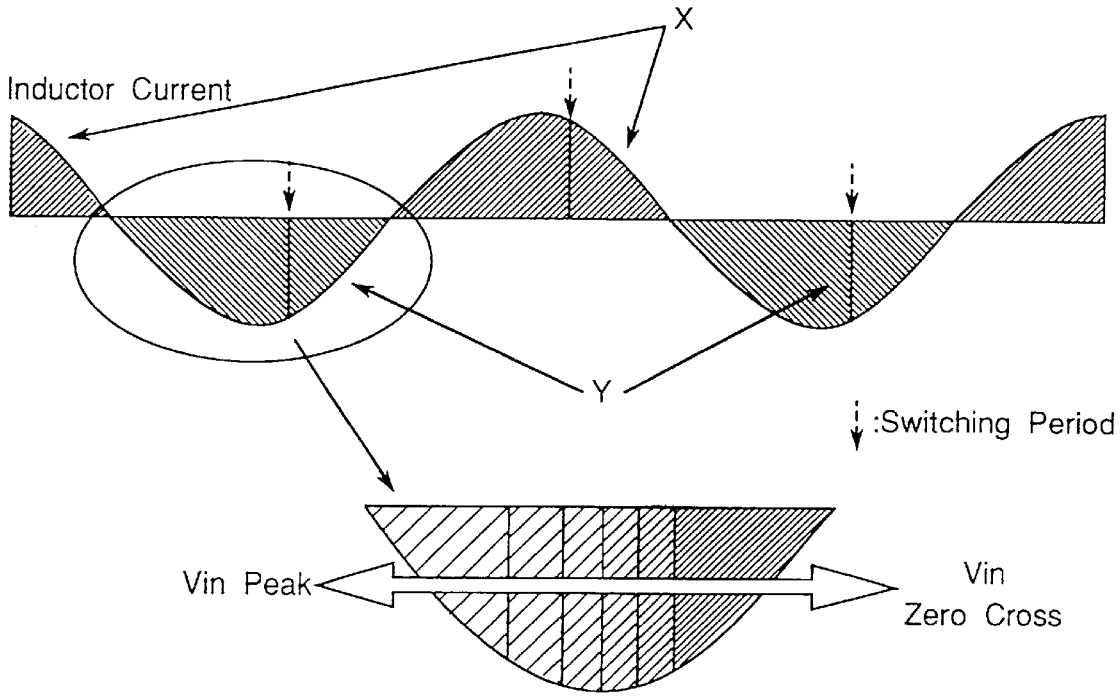
FIG. 87 is a diagram showing a relation between the input current and the resonant current in the power source device according to any of the Prior Arts 1 and 2.
Figure 88A:
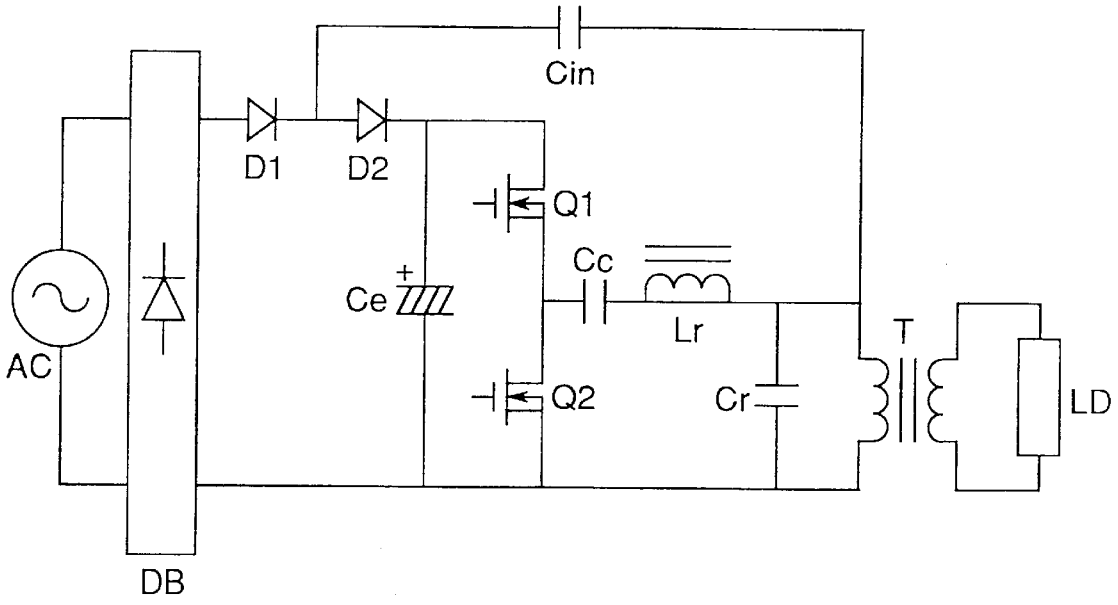
Fig.88A PRIOR ART
FIG. 88A is a circuit diagram showing the power source device according to the Prior Art 1 in which a transformer is used in an output section.
Figure 88B:
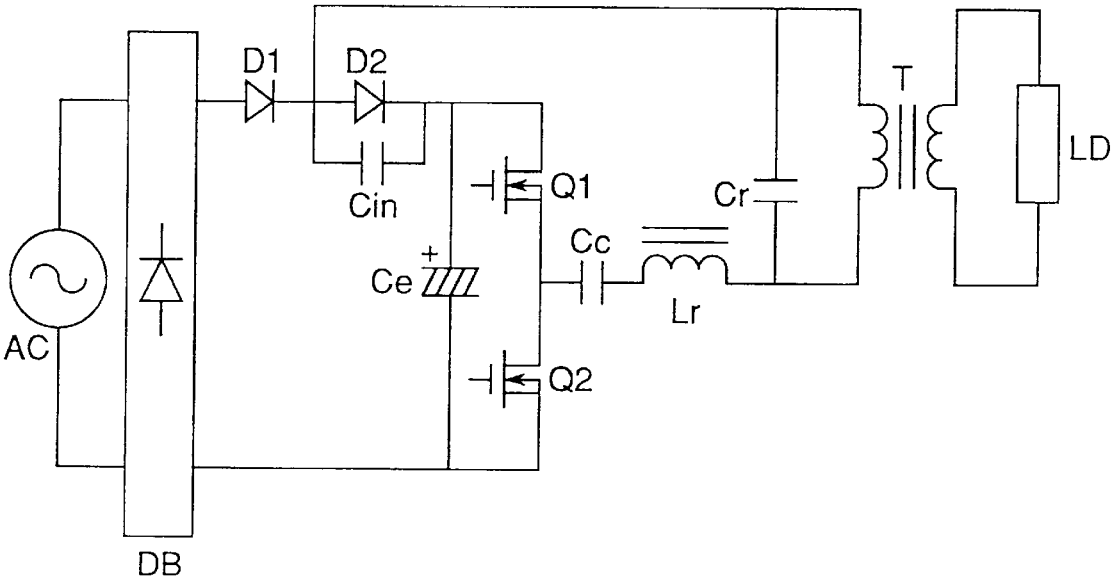
Fig.88B PRIOR ART
FIG. 88B is a circuit diagram showing the power source device according to the Prior Art 2 in which a transformer is used in an output section.
Figure 89:
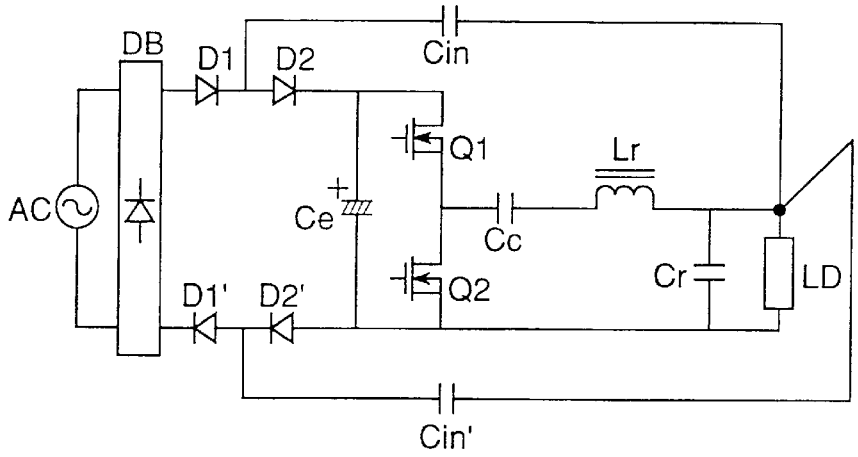
Fig.89 PRIOR ART
FIG. 89 is a circuit diagram showing the power source device according to the Prior Art 3.
Figure 90:
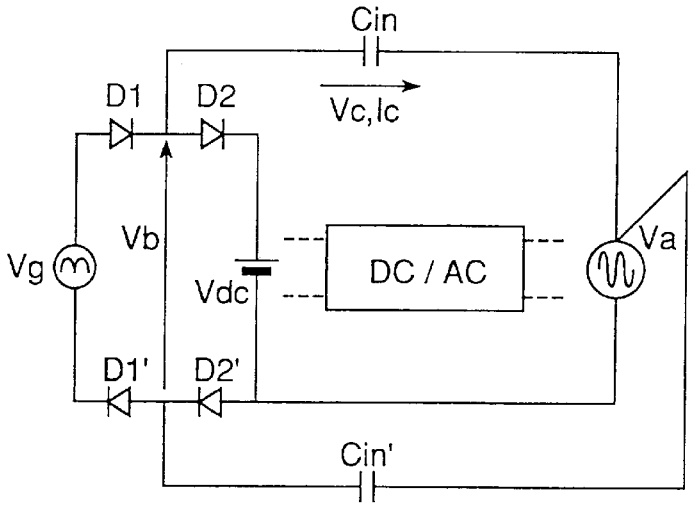
Fig.90 PRIOR ART
FIG. 90 is a circuit diagram showing an equivalent circuit of the power source device according to the Prior Art 3 from which a PFC function section is removed.
Figure 91:
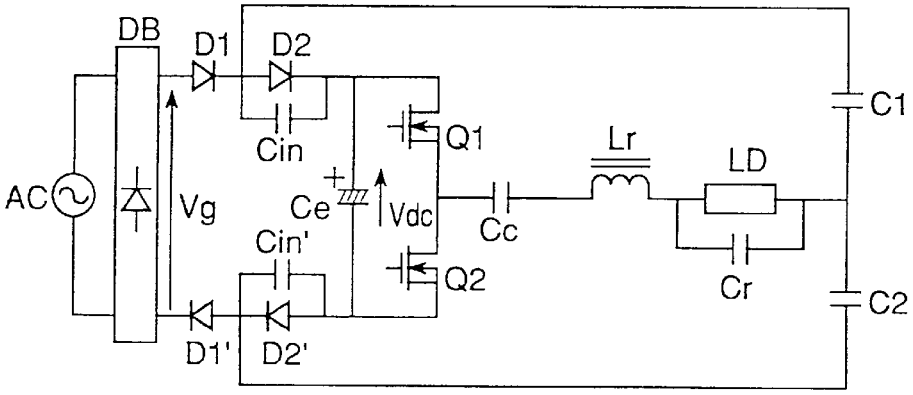
Fig.91 PRIOR ART
FIG. 91 is a circuit diagram showing the power source device according to the Prior Art 4.
Figure 92:
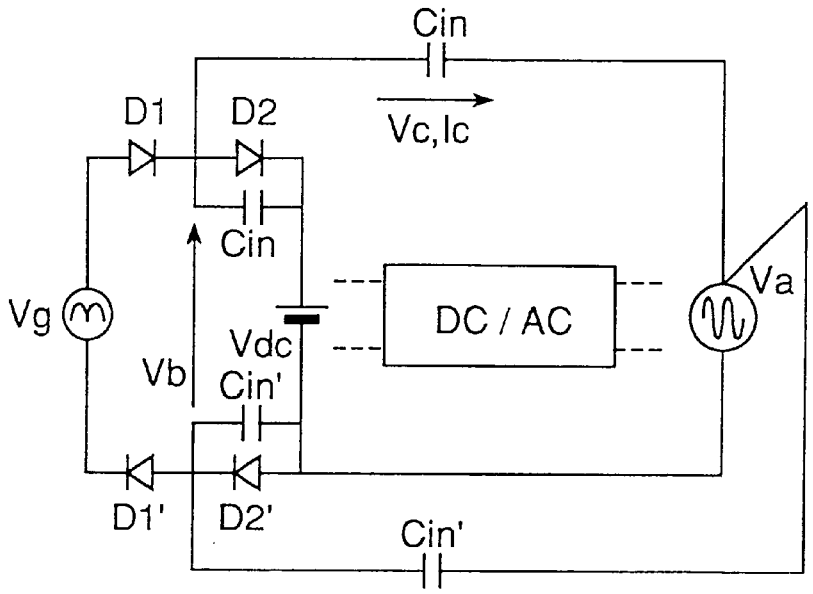
Fig.92 PRIOR ART
FIG. 92 is a circuit diagram showing an equivalent circuit of the power source device according to the Prior Art 4 from which a PFC function section is removed.
Figure 93:
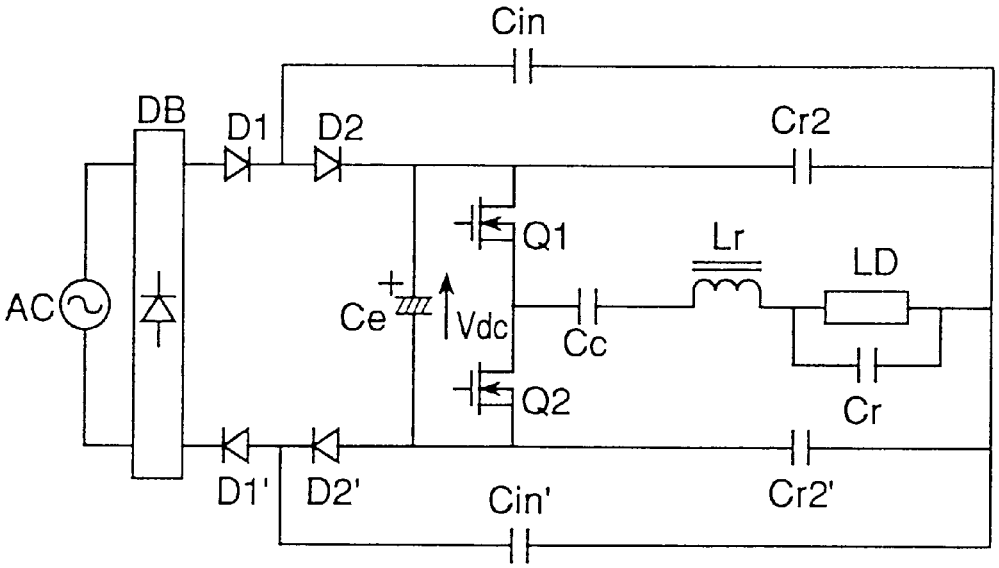
Fig.93 PRIOR ART
FIGS. 93 and 94 are circuit diagram showing the power source device according to the Prior Arts 5 and 6, respectively.
Figure 94:
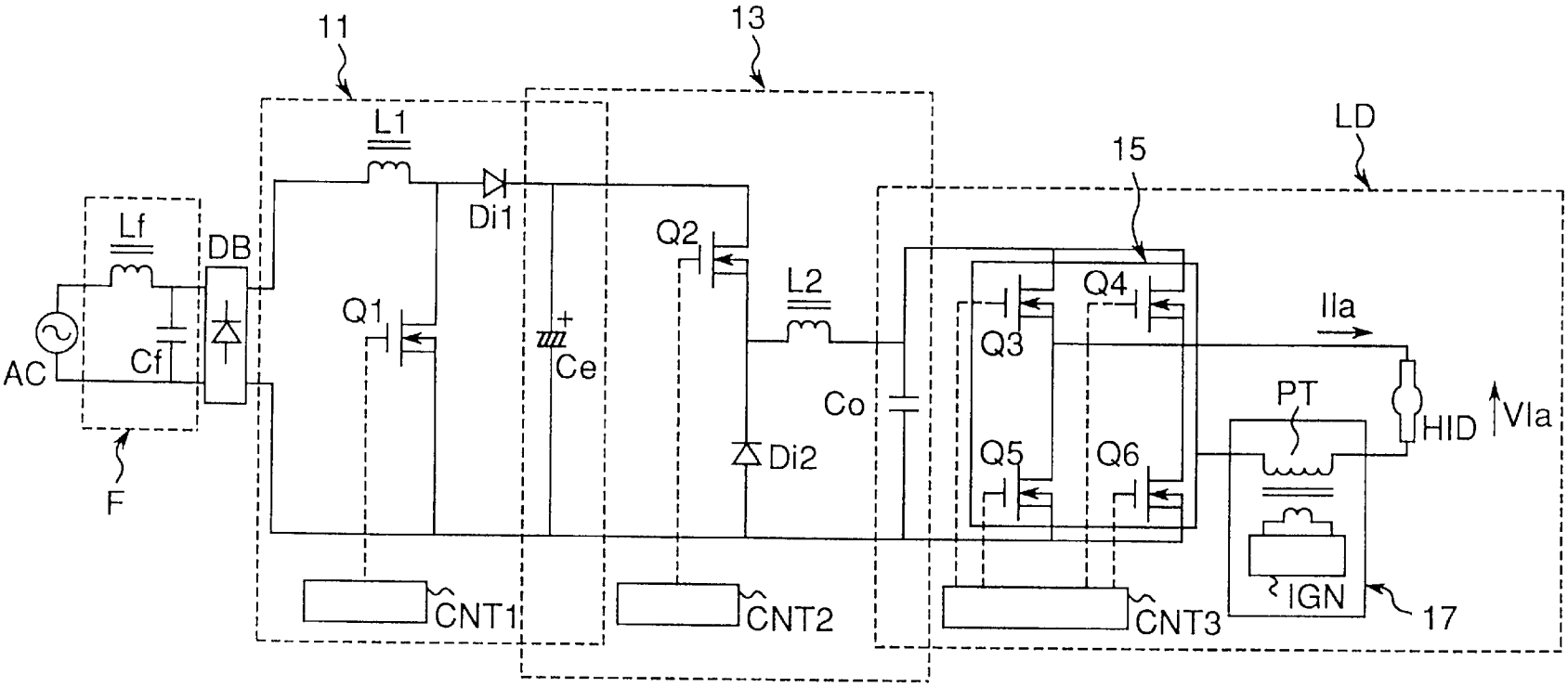
Fig.94 PRIOR ART
Figure 95:
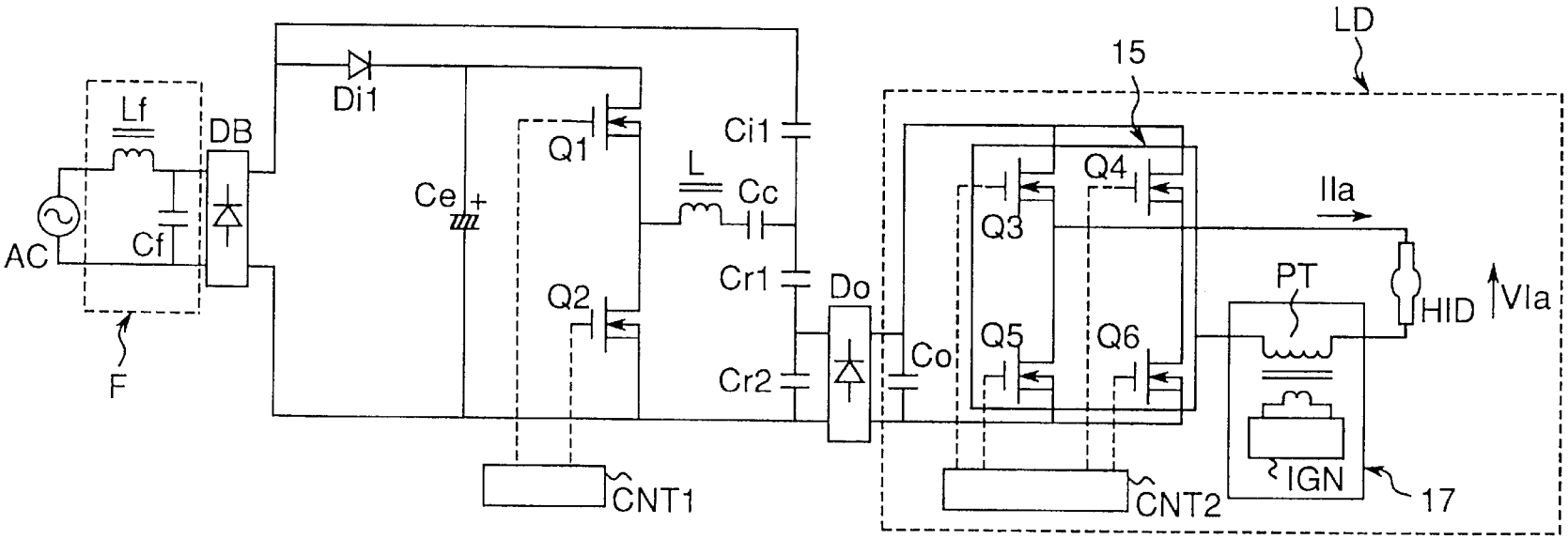
Fig.95 PRIOR ART
FIGS. 95 and 96 are circuit diagrams showing the power source device according to the Prior Art 7.
Figure 96:
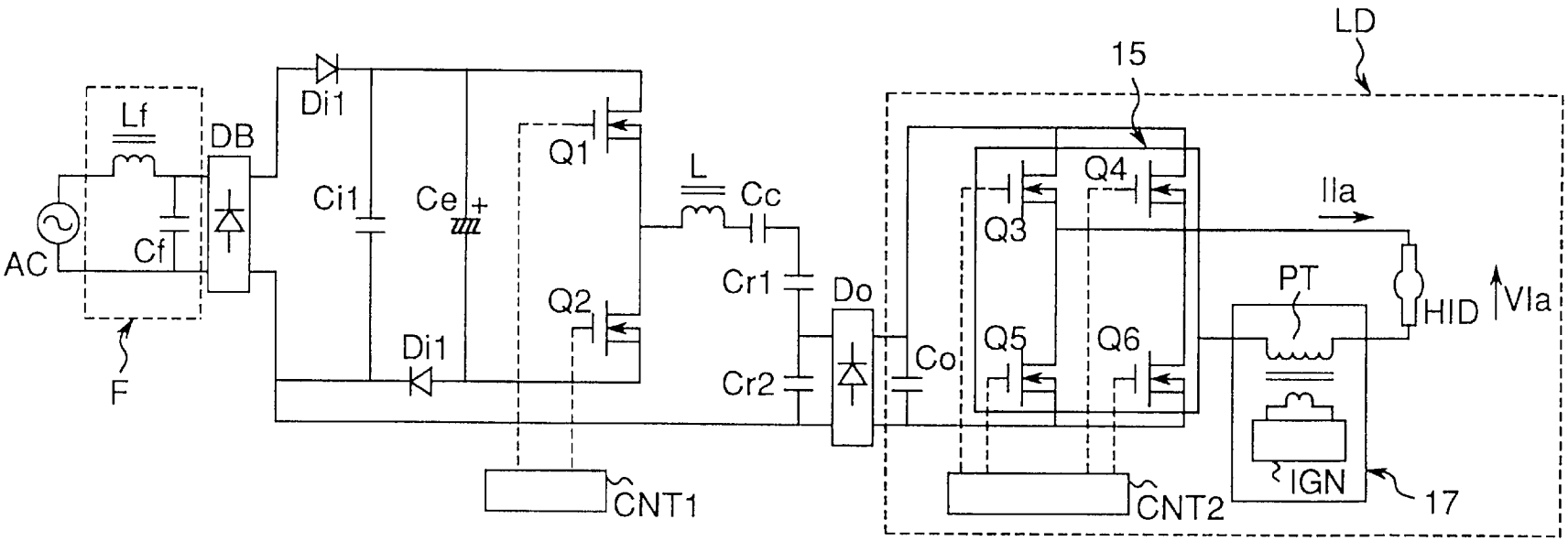
Fig.96 PRIOR ART

Also, even though the circuit construction other than the switching elements Q1 and Q2 and the smoothing capacitor Ce, disposed on a high voltage side of the smoothing capacitor Ce in the circuit of FIG. 76, is symmetrically disposed on a low voltage (ground) side of the smoothing capacitor Ce with respect to a junction between the switching elements Q1 and Q2 as shown in FIG. 80, or even though CSCP including the diodes Di3 and Di4 and the charge capacitor Cin1 is connected to the high voltage (positive pole) of the rectifier element DB as shown in FIG. 81, similar effects can be obtained.

8-5. Effects

Thus, according to the eighth embodiment of the present invention, not only can the resonant current in the inverter circuit be drawn as the input current by the effect of CPPFC to thereby improve the input power factor with a simplified structure, the voltage applied to the switching element during the switching element being turned off becomes equal to the absolute value of the input voltage at all times. Accordingly, the switching loss which occurs during the turn off of the switching element can be improved. Accordingly, any possible emission of heat resulting from the switching loss of the switching element can be suppressed, making it possible to manufacture the switching elements and radiator component parts compact in size accompanied by reduction in cost.

Moreover, even in the circuit shown in FIG. 60, by combining VSCP, discussed in connection with the Prior Art 1, or CSCP discussed in connection with the Prior Art 2 or in the U.S. Pat. No. 5,488,269, in the basic circuit, the period during which the input current can be pumped up from the AC power source during each switching cycle can be prolonged and, therefore, the breakdown strength of the various component parts such as the switching element, the inductor and the capacitors can be reduced, making it possible to provide the inexpensive and compact power source device having the PFC function. Also, no improvement in switching, when the switching elements Q1 and Q2 are turned off, which is accomplished by the circuit of FIG. 60, will be hampered.

Although the present invention has been described in connection with the preferred embodiments thereof with reference to the accompanying drawings, it is to be noted that various changes and modifications are apparent to those skilled in the art. Such changes and modifications are to be understood as included within the scope of the present invention as defined by the appended claims, unless they depart therefrom.

What is claimed is:

1. An electric power source device comprising:

a power converting circuit including a rectifier element for rectifying an input from an alternating current power source, a smoothing capacitor for smoothing an output from the rectifier element with a direct current, and a switching means for generating a high frequency voltage and a high frequency current in response to receipt of a voltage on the smoothing capacitor; and a load circuit for receiving an output from the power converting circuit; said power converting circuit comprising:

a current source type input current capturing means for capturing an input current from the alternating current power source by the utilization of a current oscillation of one of high frequency current loops generated in a circuit as a result of alternate switching on and off of the switching means, said one of high frequency current loops including said load circuit; and a voltage source type input current capturing means for capturing an input current from the alternating current power source by the utilization of a voltage oscillation in one of high frequency voltage nodes generated in the circuit as a result of alternate switching on and off of the switching means, the voltage of said one of high frequency voltage nodes varying in accordance with an output voltage to said load circuit.

2. The electric power source device as claimed in claim 1, wherein the current source type input current capturing means and the voltage source type input current capturing means are connected with different polarities of the rectifier element.

3. An electric power source device comprising:

a power converting circuit including a rectifier element for rectifying an input from an alternating current power source, a smoothing capacitor for smoothing an output from the rectifier element with a direct current, and a switching means connected parallel to the smoothing capacitor and including series-connected switching elements capable of being switched on and off in response to receipt of a voltage from the smoothing capacitor, a resonant circuit including a resonant inductor and a resonant capacitor connected in series with the resonant inductor, a junction between the switching elements being connected with one end of the resonant circuit adjacent the resonant inductor, the opposite end of the resonant circuit adjacent the resonant capacitor being connected with one of the outputs of the rectifier element; and a load circuit connected parallel to the resonant capacitor of the resonant circuit;

said power converting circuit comprising:

a voltage source type input current capturing means including a first rectifier diode connected in a forward going fashion between one of the outputs of the rectifier elements and one end of the smoothing capacitor, and a first charge capacitor connected between a junction of the resonant inductor with the resonant capacitor and a junction of the rectifier element and the first rectifier diode; and a current source type input current capturing means including a second rectifier diode connected in a forward going fashion between the other of the outputs of the rectifier element and the other end of the smoothing capacitor, and a second charge capacitor connected parallel to the second rectifier diode, and the junction of the rectifier element with the second rectifier diode is the junction of the resonant capacitor with the rectifier element.

4. The electric power source device as claimed in claim 3, wherein the second charge capacitor is connected between a junction of the first rectifier diode with the smoothing capacitor and a junction of the rectifier element with the second rectifier diode.

5. The electric power source device as claimed in claim 3 or 4, wherein the resonant capacitor comprises a plurality of series-connected capacitors and wherein the load circuit is connected parallel to one or more of the capacitors forming the resonant capacitor.

6. The electric power source device as claimed in claim 3 or 4, wherein the resonant capacitor comprises a plurality of series-connected capacitors and wherein the first charge capacitor has one end connected with one of junctions of the plural capacitors forming the resonant capacitor.

7. The electric power source device as claimed in claim 3 or 4, further comprising a transformer having a primary side connected parallel with the resonant capacitor and a secondary side connected with the load circuit.

8. The electric power source device as claimed in claim 1, wherein the power converting circuit includes a plurality of resonant means to generate a resonant current in response to an output from the switching means.

9. An electric power source device comprising:

a power converting circuit including a rectifier element for rectifying an input from an alternating current power source, a smoothing capacitor for smoothing an output from the rectifier element with a direct current, and a switching means connected parallel to the smoothing capacitor and including series-connected switching elements capable of being switched on and off in response to receipt of a voltage from the smoothing capacitor, a first resonant circuit connected parallel to one of the switching elements and including a first resonant inductor and a first resonant capacitor connected in series with the first resonant inductor, a second resonant circuit including a second resonant inductor and a second resonant capacitor connected in series with the second resonant inductor, said second resonant circuit being connected between a junction of the first resonant inductor with the first resonant capacitor and a one of outputs of the rectifier element; and a load circuit connected parallel to the second resonant capacitor of the second resonant circuit;

said power converting circuit comprising:

a voltage source type input current capturing means including a first rectifier diode connected in a forward going fashion between one of the outputs of the rectifier elements and one end of the smoothing capacitor, and a first charge capacitor connected between a junction of the first resonant inductor with the first resonant capacitor and a junction of the rectifier element and the first rectifier diode; and a current source type input current capturing means including a second rectifier diode connected in a forward going fashion between the other of the outputs of the rectifier element and the other end of the smoothing capacitor, and a second charge capacitor connected parallel to the second rectifier diode, and the junction of the rectifier element with the second rectifier diode is the junction of the second resonant capacitor with the rectifier element.

10. The electric power source device as claimed in claim 9, wherein the first resonant circuit is connected between a junction of the series-connected switching elements and the junction of the rectifier element with the second rectifier diode.

11. The electric power source device as claimed in claim 9, wherein the first resonant circuit is connected between a junction of the series-connected switching elements and the junction of the rectifier element with the second rectifier diode and the second resonant circuit is connected between a junction of the first resonant inductor with the first resonant capacitor and the smoothing capacitor.

12. The electric power source device as claimed in claim 1, wherein the current source type input current capturing means and the voltage source type input current capturing means are connected with the same polarities of the rectifier element.

13. An electric power source device comprising:

a power converting circuit including a rectifier element for rectifying an input from an alternating current power source, a smoothing capacitor for smoothing an output from the rectifier element with a direct current, and a switching means connected parallel to the smoothing capacitor and including series-connected switching elements capable of being switched on and off in response to receipt of a voltage from the smoothing capacitor, a resonant circuit including a resonant inductor and a resonant capacitor connected in series with the resonant inductor, a junction between the series-connected switching elements being connected with one end of the resonant circuit adjacent the resonant inductor; and a load circuit connected parallel to the resonant capacitor of the resonant circuit;

said power converting circuit comprising:

a voltage source type input current capturing means including first and second rectifier diodes connected in series with each other in a forward going fashion between one end of outputs of the rectifier element and one end of the smoothing capacitor, and a first charge capacitor connected from a junction between the first and second rectifier diodes to a junction between the resonant inductor and the resonant capacitor; and a current source type input current capturing means including third and fourth rectifier diode connected in series with each other in a forward going fashion between said outputs of the rectifier element and said end of the smoothing capacitor, and a second charge capacitor connected parallel to one of the third and fourth rectifier diodes, a junction between the third and fourth rectifier diodes being connected with one end of the resonant capacitor adjacent a non-resonant inductor.

14. The electric power source device as claimed in claim 3 or 13, further comprising an impedance element connected in series between one end of the resonant circuit comprised of the resonant inductor and the resonant capacitor and the first charge capacitor.

15. An electric power source device comprising:

a power converting circuit including a rectifier element for rectifying an input from an alternating current power source, a smoothing capacitor for smoothing an output from the rectifier element with a direct current, and a switching means connected parallel to the smoothing capacitor and including series-connected switching elements capable of being switched on and off in response to receipt of a voltage from the smoothing capacitor, a resonant circuit including a resonant inductor and a resonant capacitor connected in series with the resonant inductor, one end of the resonant circuit adjacent the resonant inductor being connected with a junction of the series-connected switching elements; and a load circuit connected parallel to the resonant capacitor of the resonant circuit;

said power converting circuit comprising:

a current source type input current capturing means including first and second rectifier diodes connected in series with each other between one of the outputs of the rectifier element and one end of the smoothing capacitor, and a first charge capacitor connected between a junction of the first and second rectifier diodes and a junction of the switching elements; and a voltage source type input current capturing means for capturing an input current from the alternating current power source by the utilization of a voltage oscillation at one of high frequency voltage nodes generated in the power converting circuit as a result of switching on and off of the switching means.

16. The electric power source device as claimed in claim 15, wherein the voltage source type input current capturing means includes third and fourth rectifier diodes connected in series with each other in a forward going fashion between one of the outputs of the rectifier elements and one end of the smoothing capacitor, and a second charge capacitor connected between a junction of the third and fourth rectifier diodes and a junction of the resonant inductor with the resonant capacitor.

17. The electric power source device as claimed in claim 1, wherein the power converting circuit is a single-transistor type inverter.

18. An electric power source device which comprises:

a power converting circuit including a rectifier element for rectifying an input from an alternating current power source, a smoothing capacitor for smoothing an output from the rectifier element with a direct current, a switching element capable of being switched on and off at high frequency in response to receipt of a voltage from the smoothing capacitor, a resonant circuit including a resonant inductor and a resonant capacitor connected in series with the resonant inductor, a first series circuit connected parallel to the smoothing capacitor and including a first inductor and the switching element, the resonant capacitor connected equivalently parallel to the switching element, a second series circuit which is said resonant circuit being connected with a junction between the first inductor and the switching element and including a coupling capacitor, a second inductor included in said resonant circuit and a load circuit all connected in series with each other;

said power converting circuit comprising:

a voltage source type input current capturing means including a first rectifier diode connected from one of the outputs of the rectifier element to one end of the smoothing capacitor, and a first charge capacitor connected from a junction between the first rectifier diode and the rectifier element to a junction between the load circuit and the second inductor; and a current source type input current capturing means including a second rectifier diode connected from the other of the outputs of the rectifier element to the other end of the smoothing capacitor, and a second charge capacitor connected parallel to the second rectifier diode, a junction between the rectifier element and the second rectifier diode being connected with one end of the load circuit.

19. The electric power source device as claimed in claim 1, wherein the power converting circuit is an inverter of a constant current push-pull type.

20. The electric power source device as claimed in claim 1, wherein the power converting circuit is an inverter of a full bridge type.

21. The electric power source device as claimed in claim 20, wherein the power converting circuit includes two sets of a combination of the first current source type input capturing means and the voltage source type input current capturing means, one of the sets being connected with one of the outputs of the rectifier element and the other of the sets being connected with the other of the outputs of the rectifier element.

22. An electric power source device which comprises:

a power converting circuit including a rectifier element for rectifying an input from an alternating current power source, a switching means including a pair of switching elements connected in series with each other and capable of being switched on and off at a high frequency and connected parallel to the outputs of the rectifier element, and a resonant circuit including a resonant inductor and a resonant capacitor connected in series with the resonant inductor and having one end adjacent the resonant inductor connected with a junction between the switching elements of the pair; and a load circuit connected parallel to the resonant capacitor;

said power converting circuit comprising:

a current source type input capturing means including a series circuit connected parallel to the series connected switching elements of the pair and including a smoothing capacitor and a first charge capacitor connected in series with each other, and a first rectifier diode connected between one of outputs of the rectifier element and one end of the switching elements, said resonant circuit being connected between a junction of the switching elements and a junction of the smoothing capacitor with the charge capacitor; and a voltage source type input current capturing means for capturing an input current from the alternating current power source by the utilization of a voltage oscillation at one of high frequency voltage nodes generated in the power converting circuit as a result of switching on and off of the switching means.

23. The electric power source device as claimed in claim 22, wherein the voltage source type input capturing means includes a second rectifier diode connected between the rectifier element and the first rectifier diode in a forward going fashion, and a second charge capacitor connected from a junction between the first and second rectifier diodes to a junction of the resonant inductor with the load circuit and the resonant capacitor.

24. The electric power source device as claimed in claim 22, wherein the current source type input current capturing means includes a second rectifier diode connected between the rectifier element and the first rectifier element in a forward going fashion, and a second charge capacitor connected from a junction between the first and second rectifier diodes to a junction between the switching elements.

25. The electric power source device as claimed in claim 22 or 24, wherein a non first or second rectifier diode end of the rectifier element is connected with a non first charge capacitor end of the smoothing capacitor.

26. The electric power source device as claimed in claim 22 or 24, wherein one of the ends of the rectifier element, which is not connected with the first or second rectifier diode, is connected with a non-smoothing capacitor end of the first charge capacitor.

27. An electric power source device which comprises:

a power converting circuit including a rectifier element for rectifying an input from an alternating current source, a smoothing capacitor for smoothing an output from the rectifier element with a direct current, and a switching means for generating a high frequency voltage and a high frequency current in response to receipt of a voltage from the smoothing capacitor; and a load circuit for receiving an output from the power converting circuit;

said power converting circuit comprising:

a first current source type input current capturing means for capturing an input current from the alternating current power source by the utilization of a current oscillation in a first high frequency current loop generated in the circuit as a result of switching on and off of the switching means; and a second current source type input current capturing means for capturing an input current from the alternating current power source by the utilization of a current oscillation in a second high frequency current loop generated in the circuit as a result of switching on and off of the switching means.

28. An electric power source device which comprises:

a power converting circuit including a rectifying element for rectifying an input from an alternating current power source, a smoothing capacitor for smoothing an output from the rectifier element with a direct current, a switching element connected parallel to the smoothing capacitor and including series-connected switching elements capable of being switched on and off at a high frequency in response to receipt of a voltage from the smoothing capacitor, and a resonant circuit including a resonant inductor and a resonant capacitor connected in series with the resonant inductor, a junction between the switching elements being connected with one end of the resonant circuit adjacent the resonant inductor; and a load circuit connected parallel to the resonant capacitor; the power converting circuit comprising:

a first current source type input current capturing means including first and second rectifier diodes connected in series with each other between one of the outputs of the rectifier element and one end of the smoothing capacitor, and a first charge capacitor connected from a junction between the first and second rectifier diodes to a junction between the switching elements; and a second current source type input current capturing means for capturing the input current from the alternating current power source by the utilization of a current oscillation at one of high frequency current loops generated in the power converting circuit as a result of switching on and off the switching means.

29. An electric power source device which comprises:

a power converting circuit including a rectifier element for rectifying an input from an alternating current power source, a switching means connected parallel to a smoothing capacitor and including series-connected switching elements capable of being switched on and off at a high frequency in response to receipt of a voltage from the smoothing capacitor, and a resonant circuit including a resonant inductor and a resonant capacitor connected in series with the resonant inductor, said resonant circuit having one end adjacent the resonant inductor connected with a junction between the switching elements; and a load circuit connected parallel to the resonant capacitor; the power converting circuit comprising:

a first current source type input current capturing means including first and second rectifier diodes connected in series with each other in a forward going fashion between one of the outputs of the rectifier element and one end of the smoothing capacitor, and a first charge capacitor connected between a junction of the first and second rectifier diodes and the junction of the switching elements; and a second current source type input current capturing means including third and fourth rectifier diodes connected between any one of the outputs of the rectifier element and any one of the ends of the smoothing capacitor, and a second charge capacitor connected parallel to one of the third and fourth rectifier diodes which is connected with the smoothing capacitor, a junction between the third and fourth rectifier diodes and a non resonant inductor end of the resonant capacitor being connected with each other.

30. The electric power source device as claimed in claim 29, wherein the second current source type input current capturing means includes third and fourth rectifier diodes connected in series with each other in a forward going fashion between the output of the rectifier element which is of a polarity opposite to the polarity thereof to which the first current source type input current capturing means is connected, and one end of the smoothing capacitor adjacent such different polarity, and a second charge capacitor connected from a junction between the third and fourth rectifier diodes to the junction between the switching elements.

31. An electric power source device which comprises:

a power converting circuit including a rectifier element for rectifying an input from an alternating current power source, a switching means connected parallel to a smoothing capacitor and including series-connected switching elements capable of being switched on and off at a high frequency in response to receipt of a voltage from the smoothing capacitor, and a resonant circuit including a resonant inductor and a resonant capacitor connected in series with the resonant inductor, said resonant circuit having one end adjacent the resonant inductor connected with a junction between the switching elements; and a load circuit connected parallel to the resonant capacitor; the power converting circuit comprising:

a first current source type input current capturing means including a first charge capacitor connected parallel to the series-connected switching elements and in series with the smoothing capacitor, and a first rectifier diode connected between one of the outputs of the rectifier element and one end of the switching elements said resonant capacitor and a non-inductor end of the load circuit being connected with a junction between the series-connected smoothing capacitor and charge capacitor; and a second current source type input current capturing means for capturing an input current from the alternating current source by the utilization of a current oscillation in a high frequency current loop generated in the circuit as a result of switching on and off of the switching means.

32. An electric power source device which comprises:

a power converting circuit including a rectifier element for rectifying an input from an alternating current power source, a switching means including series-connected switching elements capable of being switched on and off at a high frequency in response to receipt of a voltage from a smoothing capacitor, and a resonant circuit including a resonant inductor and a resonant capacitor connected in series with the resonant inductor, said resonant circuit having one end adjacent the resonant inductor connected with a junction between the switching elements; and a load circuit connected parallel to the resonant capacitor; the power converting circuit comprising:

a first current source type input current capturing means including first and second rectifier diodes connected in series with each other between one of the outputs of the rectifier element and one end of the smoothing capacitor, and a first charge capacitor connected parallel to one of the first and second rectifier diodes which is connected with the smoothing capacitor, and one of the ends of the switching means connected between the junction of the first rectifier diode with the second rectifier diode;

a second current source type input capturing means for capturing an input current from the alternating current source by the utilization of a current oscillation in a high frequency current loop generated in the circuit as a result of switching on and off of the switching means.

33. The electric power source device as claimed in claim 32, wherein the second current source type input current capturing means includes series-connected third and fourth rectifier diodes connected between at least one of the outputs of the rectifier element and one end of the smoothing capacitor, and a second charge capacitor connected from a junction between the third and fourth rectifier diodes to a junction of the resonant inductor, the resonant capacitor and the load circuit.

34. The electric power source device as claimed in claim 32, wherein the second current source type input current capturing means includes series-connected third and fourth rectifier diodes connected between one of the outputs of the rectifier element and one end of the smoothing capacitor, and a second charge capacitor connected between a non-resonant inductor end of the resonant circuit and at least one end of the smoothing capacitor, a junction between the third and fourth rectifier diodes being connected with the non-inductor end of the resonant circuit.

35. The electric power source device as claimed in claim 32, wherein the second current source type input current capturing means includes third and fourth rectifier diodes connected in series with each other between one of the outputs of the rectifier element and one end of the smoothing capacitor, and a second charge capacitor connected from a junction between the third and fourth rectifier diodes to the junction between the switching elements.

36. The electric power source device as claimed in claim 32, wherein the second current source type input current capturing means includes third and fourth rectifier diodes connected in series with each other between the opposite one of the outputs of the rectifier element and the opposite end of the smoothing capacitor, and a second charge capacitor connected parallel to one of the third and fourth rectifier diodes which is connected with the smoothing capacitor, a junction between the third and fourth rectifier diodes being connected with one end of the switching elements.

37. The electric power source device as claimed in claim 32, wherein the second current source type input current capturing means includes third and fourth rectifier diodes connected in series with each other between one of the outputs of the rectifier element and one end of the smoothing capacitor, a second charge capacitor connected at one end with a junction between the third and fourth rectifier diodes, and a second resonant inductor connected between the other end of the second charge capacitor and an intermediate point of the switching elements.

38. The electric power source device as claimed in claim 37, wherein a resonant frequency of the second charge capacitor and the second resonant inductor is higher than an operating frequency at which the switching elements are alternately switched on and off at a high frequency.

39. A power source device which comprises:

a power converting circuit including a rectifier element for rectifying an input from an alternating current power source, a smoothing capacitor for smoothing an output from the rectifier element with a direct current, a first switching means including series-connected first and second switching elements connected respectively with high and low voltage sides, a second switching means including series-connected third and fourth switching elements connected respectively with the high and low voltage sides, an output circuit connected from a junction between the first and second switching elements to a junction between the third and fourth switching elements and including an output inductor and an output capacitor connected in series with the output inductor, and a load circuit connected parallel to the output capacitor; and said power converting circuit comprising:

a first current source type input current capturing means including series-connected first and second rectifier diodes connected between one of the outputs of the rectifier element and one end of the smoothing capacitor, and a first charge capacitor connected parallel to one of the first and second rectifier diodes which is connected with the smoothing capacitor; and a second current source type input current capturing means including series-connected third and fourth rectifier diodes connected between the other of the outputs of the rectifier element and the other end of the smoothing capacitor, and a second charge capacitor connected parallel to one of the third and fourth rectifier diodes which is connected with the smoothing capacitor; and at least one of the switching means being connected between a junction of the first and second rectifier diodes and a junction of the third and fourth rectifier diodes.

40. The electric power source device as claimed in claim 39, wherein the first and second switching elements are alternately switched on or off and the third and fourth switching elements are alternately switched on or off, the first and third switching elements being alternately switched on or off.

41. The electric power source device as claimed in claim 39, wherein a first condition in which the first and fourth switching elements are switched on or off simultaneously and the second and third switching elements are kept off and a second condition in which the second and third switching elements are switched on or off simultaneously and the first and third switching elements are kept off are repeated at a lower frequency than switching frequency.

42. The electric power source device as claimed in claim 39, further comprising at least one switching element connected into high or/and low voltage side connection between the terminals of the two sets of the switching means connected parallel to each other.

43. The electric power source device as claimed in claim 42, further comprising a fifth switching element disposed between high voltage side terminals of the two sets of the switching means and a sixth switching element between low voltage side terminals thereof and wherein said first, fourth and fifth switching elements are switched on simultaneously and the second, third and sixth switching elements are switched on simultaneously, and wherein a first condition in which the fourth and fifth switching elements are switched on and off simultaneously at a high frequency and the first switching element is kept switched on and a second condition in which the third and sixth switching elements are switched on and off simultaneously at a high frequency and the second switching element is kept switched on are repeated at a low frequency.

44. The electric power source device as claimed in any one of claims 3, 13, 15, 18, 22, 28, 29, 31, and 32, wherein the load circuit obtains a direct current output from an additional rectifier element connected with the resonant capacitor and an additional smoothing capacitor connected with the output ends of said additional rectifier element.

45. The electric power source device as claimed in any one of claims 3, 13, 15, 18, 22, 28, 29, 31, and 32, further comprising a polarity inverting circuit operable in response to a direct current voltage across an additional smoothing capacitor to output a rectangular wave of a low frequency, and wherein the load circuit obtains a direct current output from an additional rectifier element connected with the resonant capacitor and the additional smoothing capacitor connected with the output ends of said additional rectifier element.

46. The electric power source device as claimed in any one of claims 1, 3, 13, 15, 18, 22, 27, 28, 29, 31, 32 and 39, wherein the load circuit includes a high pressure discharge lamp or a high pressure discharge lamp and a starter connected in series with the high pressure discharge lamp for starting the high pressure discharge lamp.

* * * * *